US006174150B1

(12) United States Patent
Tsubono et al.

(10) Patent No.: US 6,174,150 B1
(45) Date of Patent: Jan. 16, 2001

(54) SCROLL COMPRESSOR

(75) Inventors: Isamu Tsubono, Tochigi-ken; Masahiro Takebayashi, Tsuchiura; Hirokatsu Kohsokabe, Ibaraki-ken; Kazuo Sekigami, Tochigi-ken; Kazuya Matsuo, Tsukuba, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/161,539

(22) Filed: Sep. 28, 1998

Related U.S. Application Data

(62) Division of application No. 08/506,243, filed on Jul. 24, 1995, now Pat. No. 5,829,959.

(30) Foreign Application Priority Data

Sep. 16, 1994 (JP) ..... 6-221391
Jan. 17, 1995 (JP) ..... 7-004693

(51) Int. Cl.[7] ..... F01C 1/02
(52) U.S. Cl. ..... 418/55.5; 418/57
(58) Field of Search ..... 418/55.1, 55.2, 418/55.5, 57

(56) References Cited

U.S. PATENT DOCUMENTS 5,059,102 10/1991 Tokumitsu et al. .
5,129,798 7/1992 Crum et al. .
5,277,563 1/1994 Wen-Jen et al. .
5,458,471 * 10/1995 Ni ..... 418/55.5
5,496,161 3/1996 Machida et al. .
5,829,959 * 11/1998 Tsubono et al. ..... 418/55.5

FOREIGN PATENT DOCUMENTS 1177482 1/1989 (JP) .
1-177482 * 7/1989 (JP) .
311102 1/1991 (JP) .
5263776 10/1993 (JP) .
6264875 9/1994 (JP) .

* cited by examiner

*Primary Examiner*—Charles G. Freay
(74) *Attorney, Agent, or Firm*—Antonelli, Terry, Stout & Kraus, LLP

(57) ABSTRACT

A scroll compressor with two scrolls including respective scroll wraps to form a compression chamber therebetween so that a volume of the compression chamber is decreased to compress a fluid therein by an orbital motion between the scrolls around an axis, has a frame supporting the scrolls thereon, a drawing force generator generating a drawing force urging axially one of the scrolls toward another one thereof, and a contacting force limiter bearing at least a part of the drawing force to prevent the at least a part of the drawing force from being born by a contact between the scrolls, when an axial distance between the scrolls is not more than a predetermined axial distance.

13 Claims, 53 Drawing Sheets

SCROLL COMPRESSOR

This is a divisional application of U.S. Ser. No. 08/506,243, filed Jul. 24, 1995 now U.S. Pat. No. 5,829,959.

BACKGROUND OF THE INVENTION AND RELATED ART STATEMENT

The present invention relates to a scroll compressor in which a compression chamber is formed between two scrolls with respective scroll wraps and a volume of the compression chamber is decreased to compress a fluid therein by an orbital motion therebetween around an axis, and relates to an air conditioner including the scroll compressor.

JPA Hei-5-263776 discloses a structure for the scroll, in which an axial distance between an orbital scroll and a stationary scroll is increased by a force converting mechanism having a contact between an outer peripheral surface of the stationary scroll and a tapered guide surface of a frame to convert a radial thermal expansion force of the stationary scroll to an axial force urging the stationary scroll axially, when a temperature of the stationary scroll is increased.

JPA Hei-3-11102 discloses a scroll structure in which a pitch between the scroll wraps varies from an radially inside of the scrolls toward an radially outside thereof.

OBJECT AND SUMMARY OF THE INVENTION

An object of the present invention is to provide a scroll compressor in which an excessive contact stress between scrolls is prevented with keeping attitude relation and positional relation therebetween correct.

According to the present invention, a scroll compressor comprises,

- two scrolls including respective scroll wraps to form a compression chamber therebetween so that a volume of the compression chamber is decreased to compress a fluid therein by an orbital motion between the scrolls around an axis,
- a frame supporting the scrolls thereon,
- a drawing force generator generating a drawing force urging axially one of the scrolls toward another one thereof, and
- a contacting force limiter bearing at least a part of the drawing force to prevent the at least a part of the drawing force from being born by a contact between the scrolls, when an axial distance between the scrolls is not more than a predetermined axial distance.

Since the at least a part of the drawing force is prevented from being born by the contact between the scrolls when the axial distance between the scrolls is not more than the predetermined axial distance, an excessive contact stress between the scrolls is prevented, and a relationship in attitude and position between the scrolls is kept desirably when the axial distance between the scrolls is not more than the predetermined axial distance. Another or remainder part of the drawing force is born by a contact between the scrolls, for example, by a contact between a front end of wrap and a mirror plate surface.

The contacting force limiter may prevent the axial distance between the scrolls from being less than the predetermined axial distance so that the substantial whole of the drawing force is born by the contacting force limiter to prevent the drawing force from being born by the contact between the scrolls when the axial distance between the scrolls is equal to the predetermined axial distance. The drawing force generator may include a thrust bearing which is connected to the one of the scrolls to apply the at least a part of the drawing force therethrough to the one of the scrolls so that the one of the scrolls is urged axially toward the another one the scrolls, and the contacting force limiter may prevent an axial distance between the another one of the scrolls and the thrust bearing from being less than another predetermined axial distance so that the contacting force limiter bears the at least a part of the drawing force to prevent the at least a part of the drawing force from being born by the contact between the scrolls when the axial distance between the scrolls is not more than the predetermined axial distance.

The contacting force limiter may be fixed axially with respect to the frame and be connected to the one of the scrolls to bear the at least a part of the drawing force so that the at least a part of the drawing force is prevented from being born by the contact between the scrolls. The contacting force limiter fixed axially with respect to the frame and connected to the one of the scrolls keeps an attitude and position of the one of the scrolls desirably. If the one of the scrolls is allowed to move with respect to the contacting force limiter in such a manner that the axial distance between the scrolls is increased, the excessive contact stress between the scrolls is prevented more securely.

The contacting force limiter may be fixed axially with respect to the frame and be connected to the thrust bearing to bear the at least a part of the drawing force so that the at least a part of the drawing force is prevented from being born by the contact between the scrolls when the axial distance between the scrolls is not more than the predetermined axial distance. The contacting force limiter fixed axially with respect to the frame and connected to the thrust bearing keeps an attitude and position of the thrust bearing desirably. If the thrust bearing is allowed to move with respect to the contacting force limiter in such a manner that the axial distance between the another one of the scrolls and the thrust bearing is increased, the excessive contact stress between the scrolls is prevented more securely. If the one of the scrolls is allowed to move with respect to the thrust bearing in such a manner that the axial distance between the scrolls is decreased, the scrolls can contact each other while the at least a part of the drawing force is prevented from being born by the contact between the scrolls.

The drawing force generator includes a spring and/or the fluid (lubricant and/or refrigerant) compressed by the compression chamber, for generating the drawing force. A creep member may be arranged between the one of the scrolls and the contacting force limiter to be deformed plastically in accordance with a lapse of compressor operating time by a compression force therebetween to decrease the axial distance between the scrolls in accordance with the lapse of compressor operating time. It is preferable that the drawing force applied to a relatively radially-outer portion of the scrolls is smaller than the drawing force applied to a relatively radially-inner portion of the scrolls. It is also preferable that the scrolls includes respective mirror plate surfaces which extend substantially parallel to each other and face to the wraps respectively to form the compression chamber, a thickness of each of the wraps varies from the relatively radially-outer portion of the scrolls to the relatively radially-inner portion of the scrolls, and an axially projecting height of each of the wraps from the respective mirror plate surface at the relatively radially-outer portion of the scrolls is larger than that at the relatively radially-inner portion thereof. The creep member may be arranged between the thrust bearing and the contacting force limiter to be deformed plastically in accordance with the lapse of compressor operating time by the compression force therebetween to decrease the axial distance between the another one of scrolls and the thrust bearing in accordance with the lapse of compressor operating time.

The contacting force limiter may be arranged on the another one of scrolls so that the at least a part of the drawing force is applied to the another one of scrolls without passing through the one of scrolls to prevent the at least a part of the drawing force from being born by the contact between the scrolls. If the thrust bearing is rotatable with respect to the frame, an abrasion between the thrust bearing and the one of the scrolls is restrained.

If the contacting force limiter has a positioning surface extending substantially perpendicularly to the axis, one of the scrolls and the drawing force generator has another positioning surface extending substantially perpendicularly to the axis, and a contact between the positioning surfaces bears the at least a part of the drawing force to prevent the at least a part of the drawing force from being born by the contact between the scrolls, a relationship in attitude and position between the contacting force limiter and the one of the scrolls or between the contacting force limiter and the drawing force generator is kept significantly correctly.

DETAILED DESCRIPTION OF THE PREFERRED EMBODIMENTS

Figure 1:
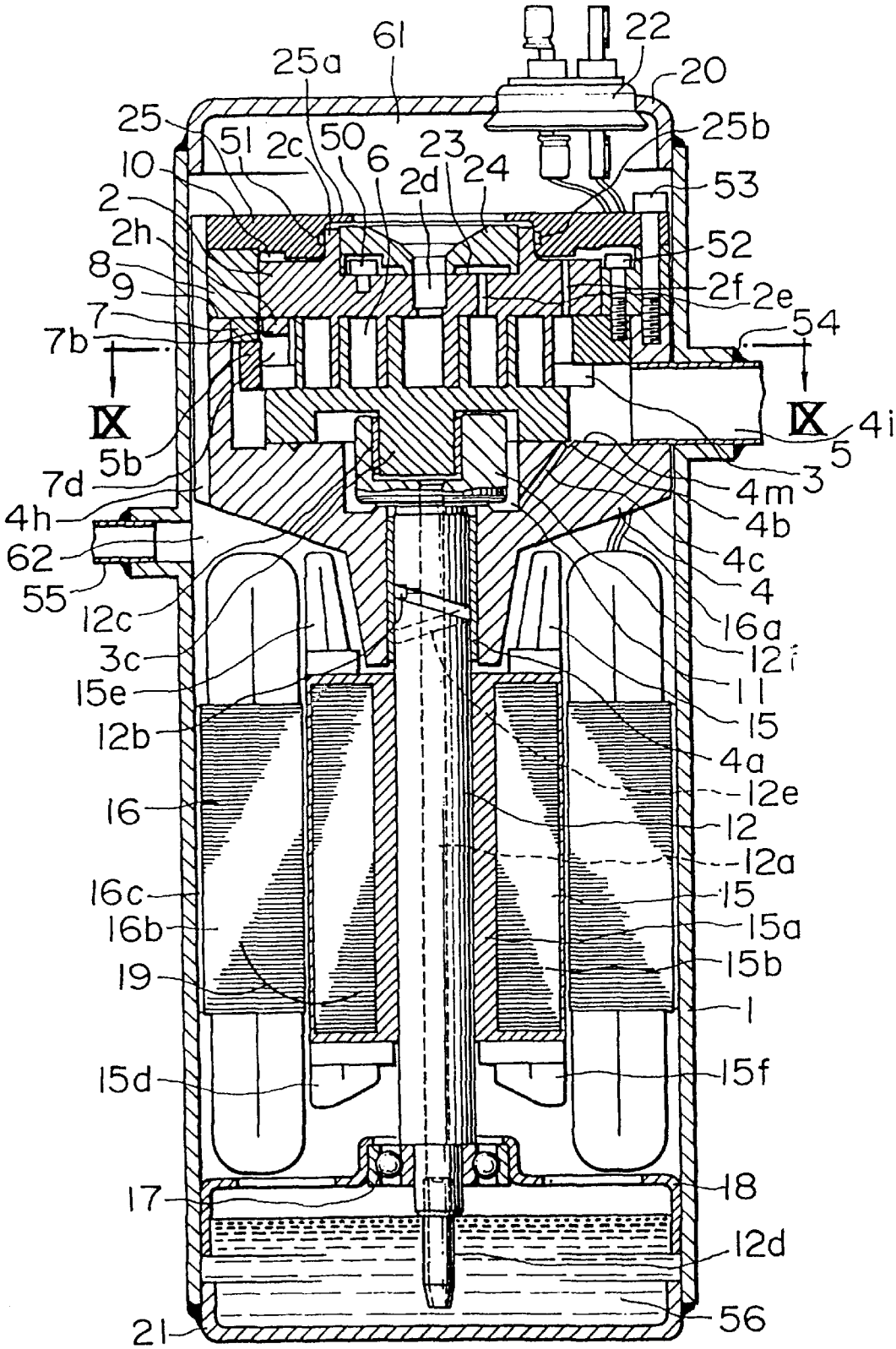
FIG. 1 is a longitudinal cross-sectional view of a scroll fluid compressor according to a first embodiment of the invention.
Figure 2:
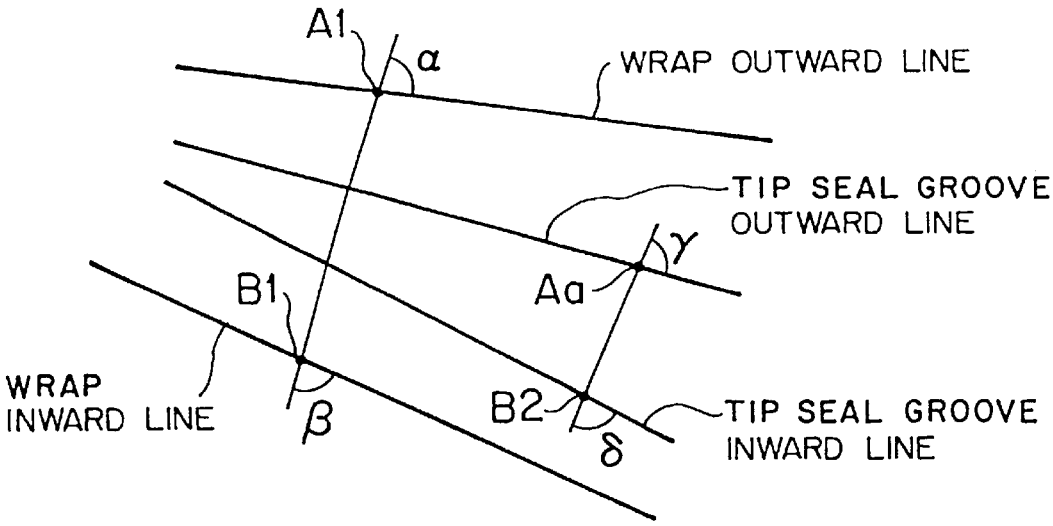
FIG. 2 is an explanatory view of a width of a wrap and a width of each of tip-seal insertion grooves in a scroll wrap in the embodiment.
Figure 3:
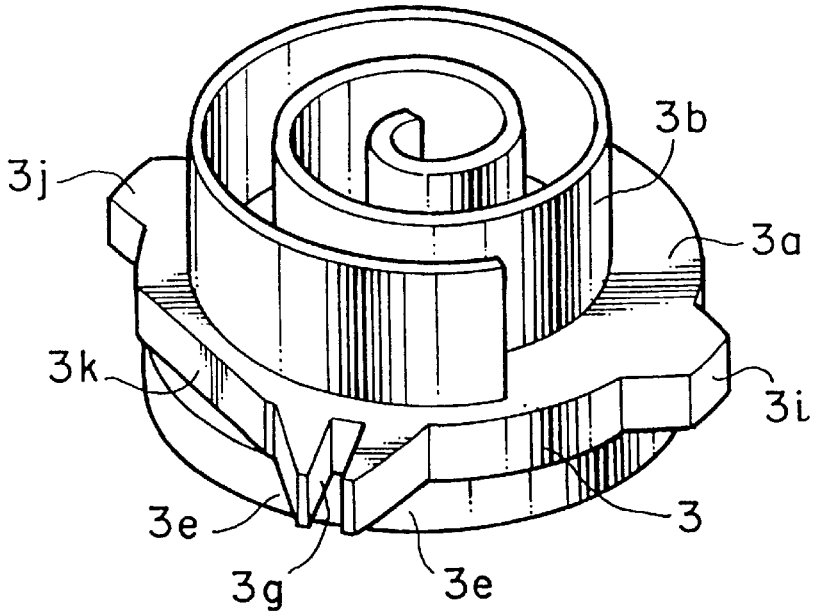
FIG. 3 is a perspective view of a swing or turning scroll member in the embodiment as viewed from the upper.
Figure 4:
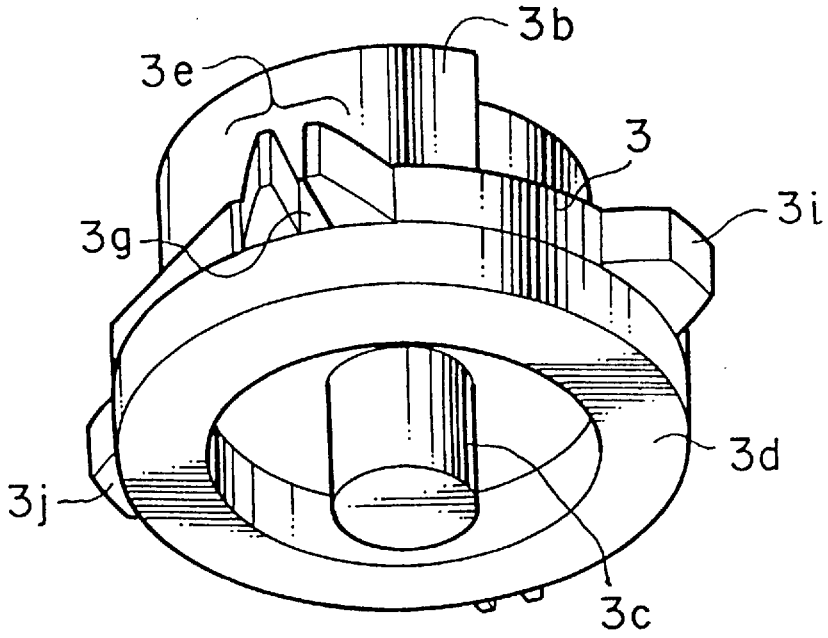
FIG. 4 is a perspective view of the turning scroll member in the embodiment as viewed from the lower.
Figure 5:
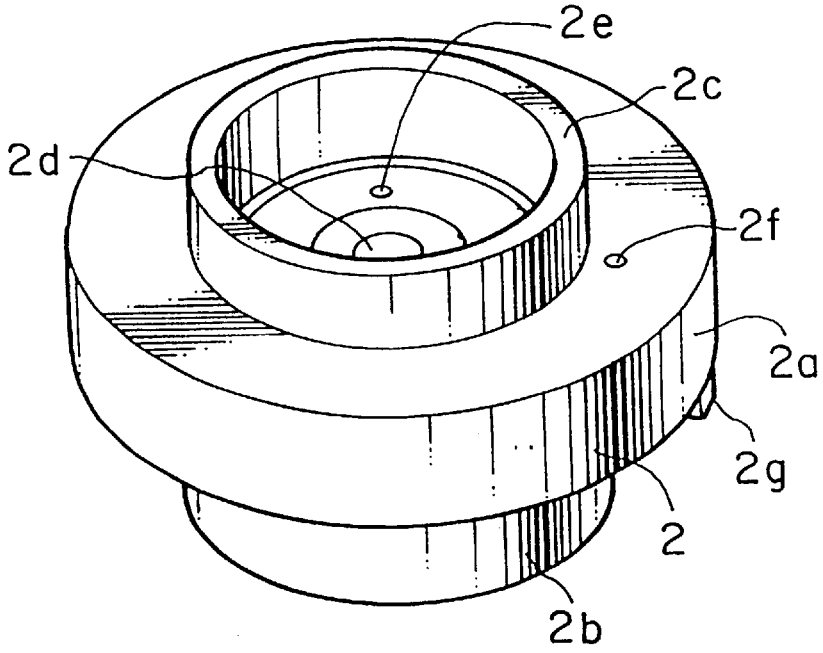
FIG. 5 is a perspective view of a float scroll member in the embodiment as viewed from the lower.
Figure 6:
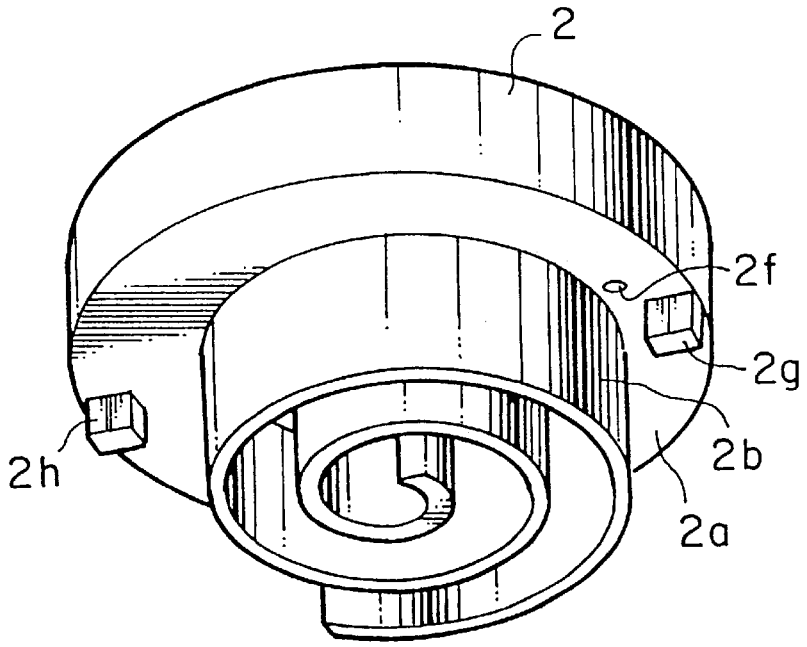
FIG. 6 is a perspective view of the float scroll member in the embodiment as viewed from the upper.
Figure 7:
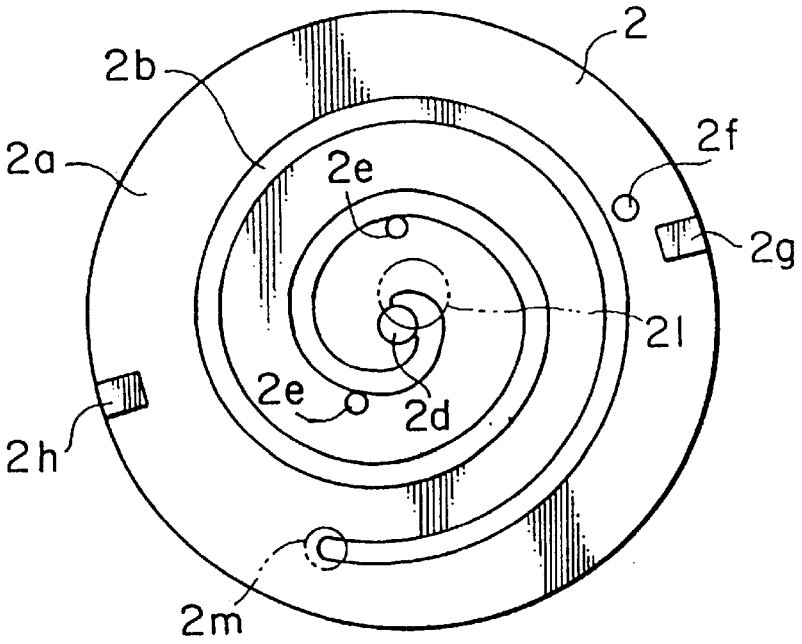
FIG. 7 is a bottom plan view of the float scroll member in the embodiment.
Figure 8:
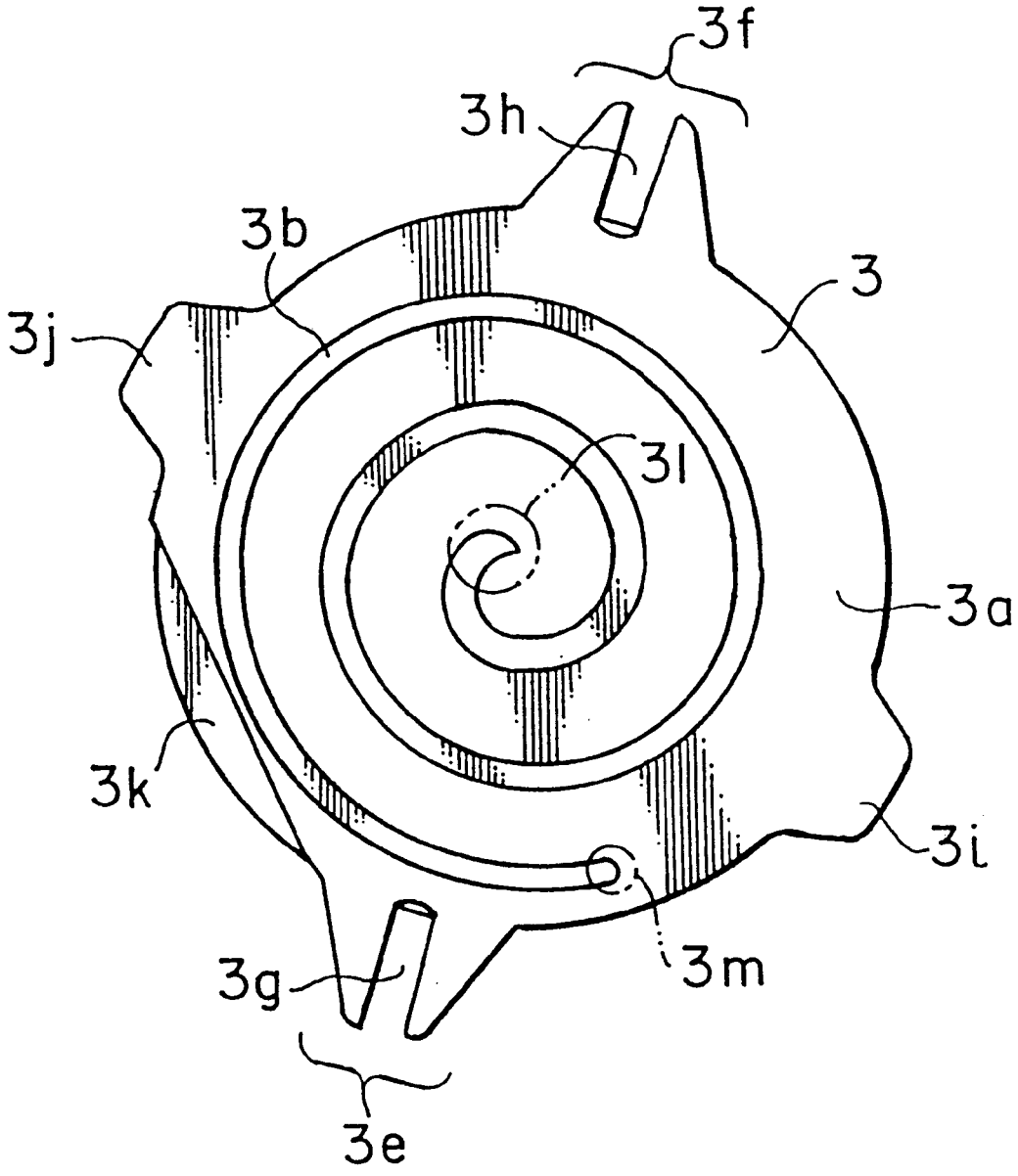
FIG. 8 is a top plan view of the turning scroll member in the embodiment.
Figure 9:
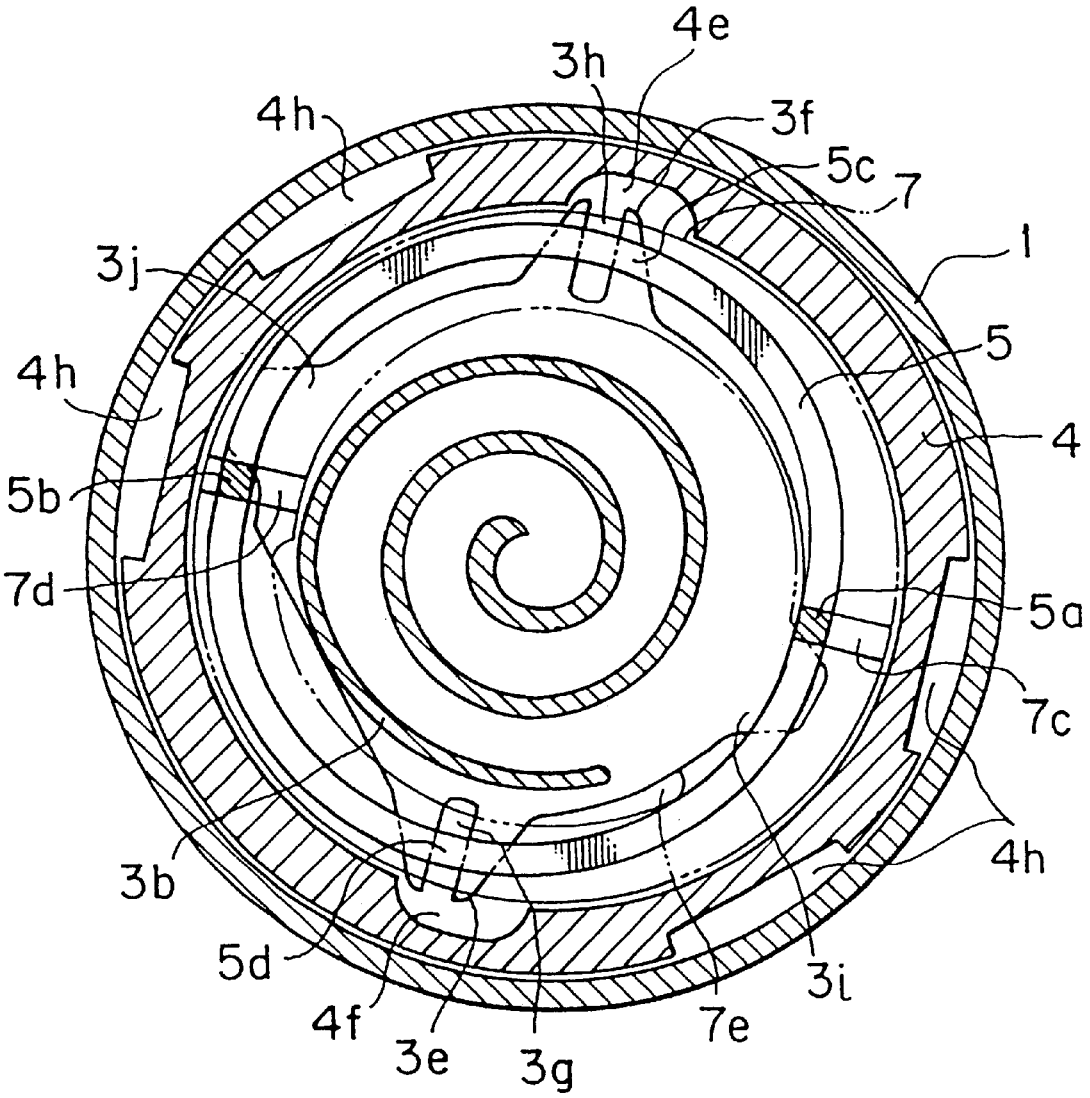
FIG. 9 is a transverse-cross-sectional view of the embodiment, indicated by an arrow IX—IX in FIG. 1.
Figure 10:
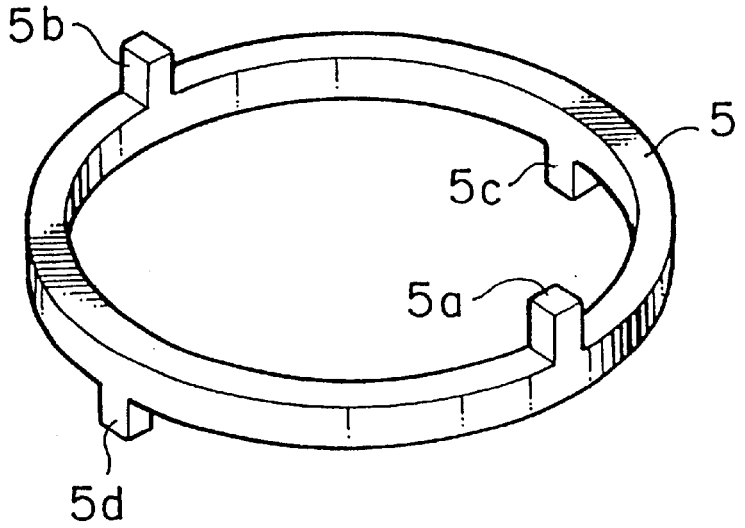
FIG. 10 is a perspective view of an Oldham's ring in the embodiment as viewed from the upper.
Figure 11:
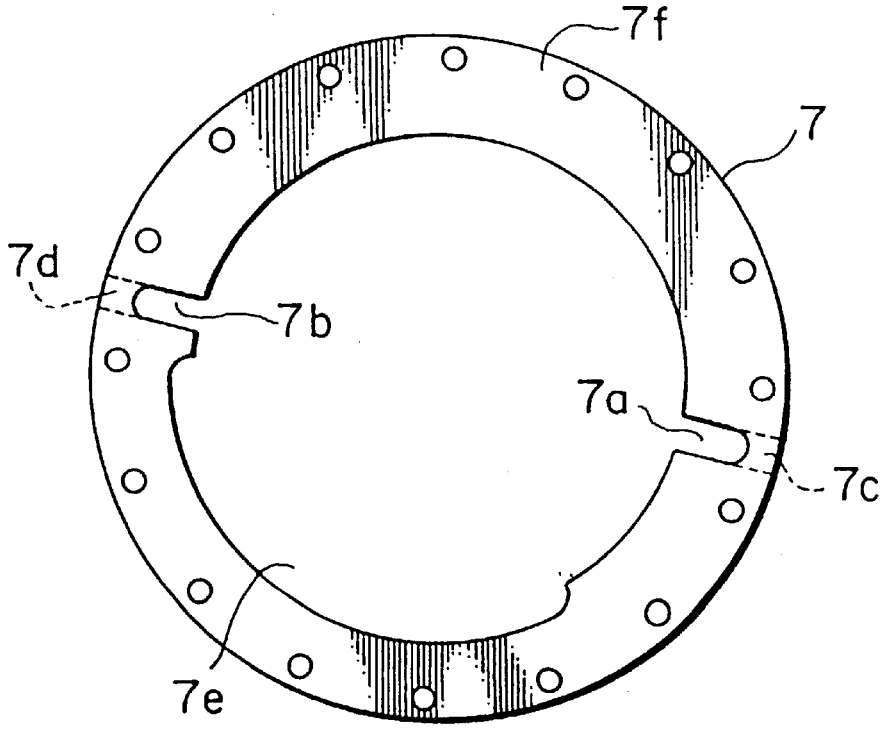
FIG. 11 is a top plan view of a float stopper in the embodiment.
Figure 12:
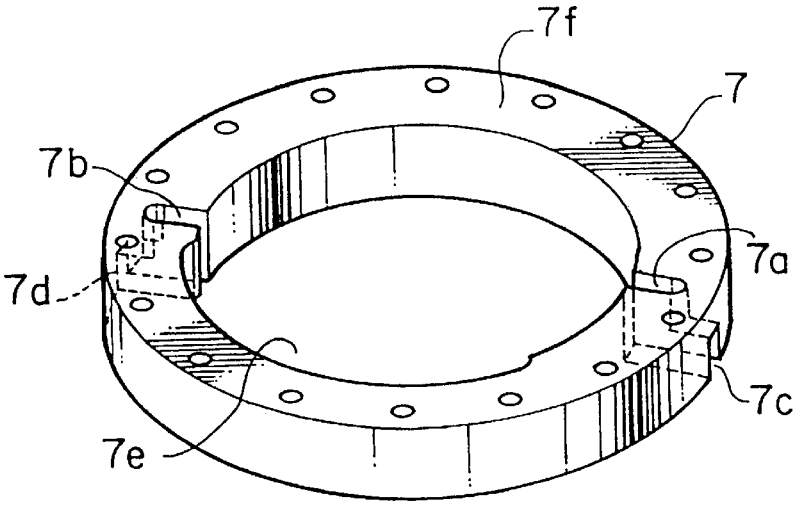
FIG. 12 is a perspective view of the float stopper in the embodiment as viewed from the upper.
Figure 13:
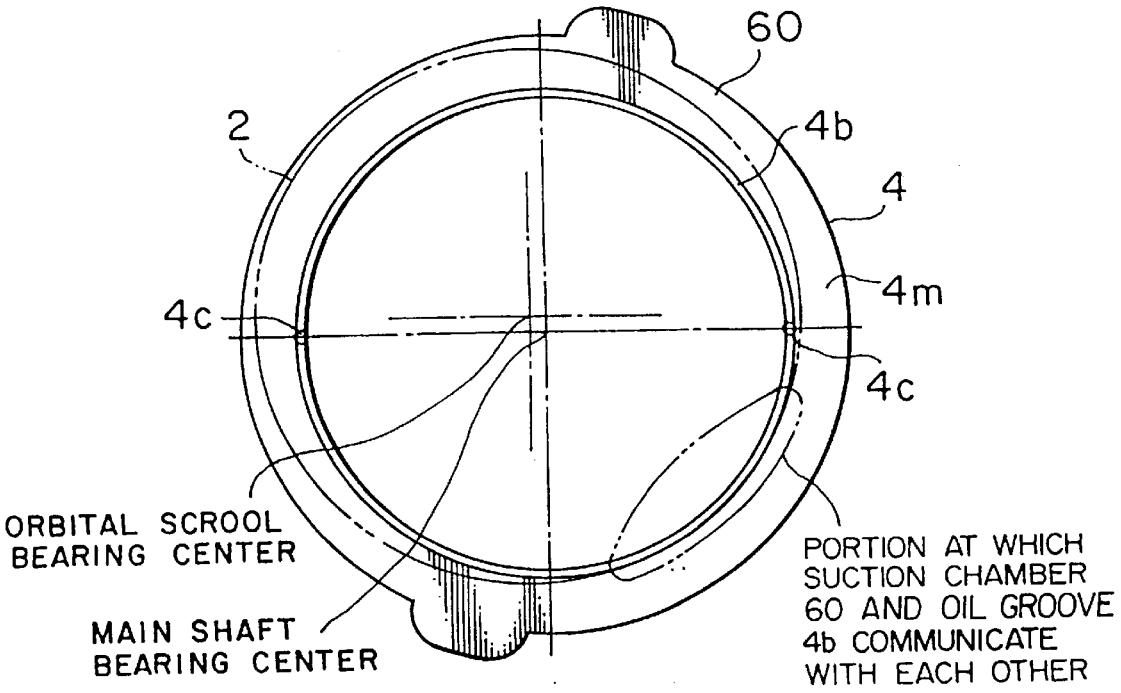
FIG. 13 is an explanatory view of an oil-groove position in the embodiment.
Figure 14:
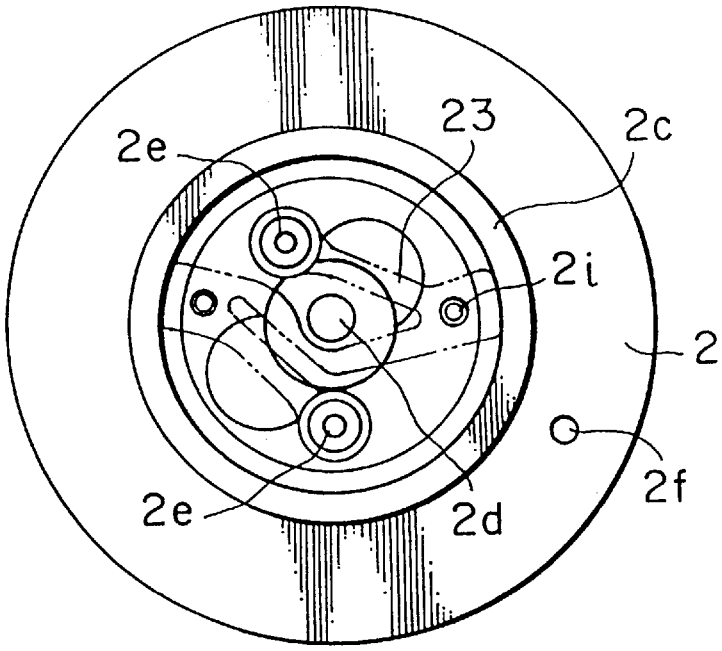
FIG. 14 is a top plan view of the float scroll member in the embodiment.

A first embodiment of the invention will be described with reference to FIGS. 1 to 14. The present embodiment will be described, taking an example of a float-type turning scroll compressor in which a first scroll member is prevented from being rotated and moves in turning around an axis while axial movement thereof is prevented, and a second scroll member is movable axially. FIG. 1 is a longitudinal cross-sectional view of the compressor, while FIG. 2 is a view describing the relationship between a wrap outward line and a wrap inward line. FIG. 3 is a perspective view of a turning scroll member as viewed from the upper. FIG. 4 is a perspective view of the turning scroll member as viewed from the lower. FIG. 5 is a perspective view of a float scroll member as viewed from the upper. FIG. 6 is a perspective view of the float scroll member as viewed from the lower. FIG. 7 is a bottom plan view of the float scroll member. FIG. 8 is a top plan view of the turning scroll member. FIG. 9 is a transverse cross-sectional view of a pump as viewed from an arrow IX—IX in FIG. 1. FIG. 10 is a perspective view of an Oldham's ring as viewed from the upper. FIG. 11 is a top plan view of a float stopper. FIG. 12 is a perspective view of the float stopper as viewed from the upper. FIG. 13 is a top plan view showing the outline or summary of a thrust bearing surface of a frame. FIG. 14 is a top plan view of the float scroll member.

The entire or whole arrangement of a scroll fluid machine according to the embodiment is as shown in FIGS. 1, 3 and 4. A turning scroll member 3 is arranged such that a scroll wrap 3*b* is provided in standing on an end plate 3*a*, a boss 3*c* is provided at the center of an opposite surface, and a thrust bearing 3*d* formed by a slide bearing is provided at the outer periphery of the surface thereof. Oldham's projections 3*e* and 3*f* project from an outer periphery of the end plate 3*a*. Turning Oldham's grooves 3*g* and 3*h* are provided respectively in the Oldham's projections 3*e* and 3*f*. Further, Oldham's support projections 3*i* and 3*j* for resting the Oldham's ring on the outer periphery of the end plate 3*a* are provided thereon. As shown in FIG. 8, the scroll wrap 3*b* is formed such that the thickness of the wrap decreases from the center toward the outer periphery thereof, except an end 31 on the center side and an end 3*m* on the outer peripheral side. Here, as shown in FIG. 2, the thickness of the scroll wrap 3*b* is set to a length of a line segment A1 and B1 in which angles a and B defined between the wrap outward line and the wrap inward line are equal to each other. Moreover, in order to take balance of the scroll wrap 3*b*, a balance cut-out 3*k* in which a top surface of the end plate 3*a* is cut out in a manner of a straight line is provided. Since the outer periphery of a lower part of the end plate 3*a* is cylindrical in shape, it is possible to use the outer periphery of the lower part of the end plate 3*a* as a chucking surface upon working and carrying of the scroll wrap. Thus, handling upon working is facilitated, and the workability of the compressor can be improved.

As shown in FIGS. 5 to 7, a float scroll member 2 is arranged such that a scroll wrap 2*b* is provided in upstanding on an end plate 2*a*, and a seal projection 2*c* is provided at the center of the upper surface. A discharge hole 2*d* is formed in the vicinity of the center in the interior of the seal projection 2*c*. Two release holes 2*e* for preventing over-compression are provided on the outer peripheral side of the seal projection 2*c*. As shown in FIG. 14, an integrated release valve 23 is fixedly mounted on the float scroll member 2 by a screw 50 so as to cover the release holes 2*e*. When pressure in the compression chamber at a compression process increases more than the discharge pressure, the release valve 23 opens so that compressed gas is released. The release holes 2*e* open in a surface substantially coplanar with the screw holes 2*j* in the screw 50. Here, the maximum lift of the release valve 23, that is, opening thereof is prescribed by a center cover 24. Furthermore, a portion on the outside of the seal projection 2*c* is provided with an equalizer hole 2*f* for retaining an upper chamber 10 to suction pressure. Detents 2*g* and 2*h* project on the lower surface side of the end plate 2*a*. The scroll wrap 2*b* is formed such that the thickness of the wrap gradually decreases in accordance with the fact that a point approaches the outer periphery from the center except for an end 2*l* at the center side and an end 2*m* on the outer peripheral side. Here, back pressure of the float scroll member 2 is set such that the float scroll member 2 does not move upwardly from a stopper surface 7*f* by the pressure within the compression chamber upon normal running, and the height of each of the scroll wraps 2*b* and 3*b* is set such that the scroll wraps 2*b* and 3*b* do not come in contact with the end plates 3*a* and 2*a* under such a condition that the lower surface of the end plate 2*a* is urged against the stopper surface 7*f*. In this connection, fixing of the release valve 23 and the float scroll 2 may be a caulking pin, adhesion, welding or silver brazing, in place of screwing.

As shown in FIGS. 11 and 12, a float stopper 7 is provided at the upper surface side thereof with detent grooves 7*a* and 7*b* for slidably engaging respectively with the detents 2*g* and 2*h* to permit the float scroll 2 to move in the axial direction while preventing the float scroll 2 from being rotated. The float stopper 7 is provided at the lower surface side thereof with fixed Oldham's grooves 7*c* and 7*d* for slidably engaging with projections 5*a* and 5*b* to permit an Oldham's ring 5 to move in one direction with respect to the float stopper 7. The detent grooves 7*a* and 7*b* and the fixed Oldham's grooves 7*c* and 7*d* are formed to have substantially the same width, and surfaces on both sides of each of the grooves can simultaneously be worked. Further, in order to avoid that the turning scroll member 3 moves in turning to thereby interfere with the outer periphery of the scroll wrap 3*b*, an inner peripheral cut-out 7*e* is provided. The float stopper 7 is so assembled as to be screwed into an upper fixed table 8 which is fixedly mounted on the upper surface of a frame 4, by a table screw 52, to form a fixed table 9. In this connection, the float stopper 7 and the upper fixed table 8 may not be fixed to each other by screwing, but may be fixed to each other by a caulking pin, adhesion, welding or silver brazing. The float stopper 7 and the upper fixed table 8 may be formed integrally.

An outer peripheral cover 25 extends from an upper part of the seal projection 2*c* to the outer peripheral side. A cover presser 25*a* extends toward the inner side of the outer peripheral cover 25. A ring groove 25*b* is provided in an inner periphery of the outer peripheral cover 25. A seal ring 51 whose material has heat resistance and which is soft is inserted into the ring groove 25, to form a gas-tight seal to thereby partition a radially outer part and a radially inner part in a back surface of the float scroll 2 from each other.

As shown in FIG. 10, the Oldham's ring 5 is provided, on the upper surface side thereof, with the fixed projections 5*a* and 5*b* which are slidably engaged respectively with the grooves 7*c* and 7*d*, and, on the lower surface side thereof, with turning projections 5*c* and 5*d* which are slidably engaged respectively with the grooves 3*g* and 3*h* in the turning scroll member 3 to permit the turning scroll member 3 to move only in one direction with respect to the Oldham's ring 5.

As shown in FIGS. 1 and 13, the frame 4 is provided with an oil groove 4*b* in a thrust surface 4*m* thereof. The oil groove 4*b* is provided with an opening of each of oil-supply holes 4*c* which communicate with a back chamber 4*d*. In the present embodiment, case is illustrated where four oil-supply holes 4*c* are provided. When the pressure in the back chamber 4*d* is desired to be set higher, however, the number of oil-supply holes 4*c* is reduced, or each of the oil-supply holes 4*c* is reduced in diameter. Moreover, each of the oil-supply holes 4*c* may be formed such that a vertical hole and a horizontal hole are intersected with each other. In case of being arranged in this manner, constraint of a position where the oil-supply holes 4*c* are installed is reduced. Furthermore, the inner peripheral surface of the frame 4 is provided therein with inner peripheral grooves 4*e* and 4*f* each of which serves as a relief or a running-off for the corresponding Oldham's projection 3*e* or 3*f* which is provided on the turning scroll 3. Further, the outer peripheral surface of the frame 4 is provided therein with gas grooves 4*h* each of which serves as a flow passage for the gas, and the side surface side of the frame 4 is provided with a suction hole 4*i* which forms a suction chamber 60.

A shaft 12 is inserted into a main bearing 4*a* of the frame 4. A rotor 15 is fixedly mounted on the shaft 12. The turning scroll member 3 has the boss 3*c* thereof which is inserted into a turning bearing 12*c*. The frame 4 has the thrust surface 4*m* thereof on which the thrust bearing 3*d* which serves as a sliding bearing is rested. Moreover, the back surface of the turning scroll member 3 is formed with a back chamber 11 between the back surface of the turning scroll member 3 and the frame 4. The Oldham's ring 5 is retained between the end plate 3*a* and the float stopper 7 in such a manner that the turning projections 5*c* and 5*d* are inserted respectively into the turning Oldham's grooves 3*g* and 3*h*. The fixed table 9 is rested on the upper surface of the frame 4 in such a manner that the fixed projections 5*a* and 5*b* are inserted respectively into the fixed Oldham's grooves 7*c* and 7*d*. The suction chamber 60 is defined at the periphery of the turning scroll member 3. The float scroll member 2 is urged by pressure difference in which the detents 2*g* and 2*h* are inserted respectively into the detent grooves 7*a* and 7*b* to put the float scroll member 2 between the side facing toward the turning scroll member 3 and the opposite side, between the stopper surface 7*f* of the float stopper 7 which forms the fixed table 9. A clearance between the outer periphery of the float scroll member 2 and the inner periphery of the upper fixed table 8 is clearance fitting of a degree of 5 &Lm as converted to a diameter difference. The outer peripheral cover 25 is rested on the upper surface of the fixed table 9 in such a manner that the outer peripheral surface of the seal projection 2*c* is slidable on the seal ring 51 which is provided within the ring groove 25*b*. The fixed table 9 and the outer peripheral cover 25 are fixed to the frame 4 by a cover screw 53. However, when the fixing is practiced, if the cover screw 53 is gradually tightened successively while torque management is practiced while the shaft 12 or the rotor 15 is rotated, the inner periphery of the upper fixed table 8, the inner periphery of the outer peripheral cover 25 and the axis of the shaft 12 are accurately aligned with each other. Between the upper radial outer part of the float scroll member 3 and the outer peripheral cover 25, the upper chamber 10 is defined which communicates with the suction chamber 60 through the equalizer hole 2*f*. With the arrangement described above, it is prevented that a space or an interval between the turning scroll member 3 and the float scroll member 2 is reduced less than a predetermined space, without being accompanied by contact therebetween.

The shaft 12 is provided therein with an oil-supply hole 12*a* so as to pass through the shaft 12. An oil-supply pipe 12*d* is fixedly mounted on a lower end of the shaft 12. In order to supply oil to the main bearing 4*a* which is provided on the frame 4, a lateral oil-supply hole 12*b* is provided which communicates with the oil-supply hole 12*a*. A helical groove 12*e* is provided in the shaft 12 in communication with the lateral oil-supply hole 12*b*. A bearing retainer 12*f* which is larger in diameter than the shaft 12 is formed on an engagement between the shaft 12 and the turning scroll member, integrally with the shaft 12. The turning bearing 12*c* is forcibly fitted in the bearing retainer 12*f* at a position eccentric from the axis of the shaft 12.

A rotor 15 is formed by an inside laminated steel plate 15*a* and an outside un-magnetized ferromagnetic substance 15*b* (modified in the future to a permanent magnet). An upper balance weight 15*c* is fixedly mounted on the upper surface of the rotor 15. The balance weight 15*c* is formed into a cylindrical shape. An upper compensation balance weight 15*e* which is made of material less in specific weight than the balance weight 15*c* is fixedly mounted on the upper balance weight 15*c*. Furthermore, a lower balance weight 15*d* is fixedly mounted on the lower surface of the rotor 15. The lower balance weight 15*d* is formed into a cylindrical shape. A lower compensation balance weight 15*f* of material which is less in specific weight than the lower balance weight 15*d* is fixedly mounted on the lower balance weight 15*d*. As the material of the balance weights 15*c* and 15*d*, zinc or brass is selected, while, as the material of the compensation balance weights 15*e* and 15*f*, an aluminum alloy is selected. Further, the compensation balance weights 15*e* and 15*f* may fixedly be mounted directly on the laminated steel plate 15*a*.

A stator 16 is provided with an oil groove 16*c* at an outer periphery of a laminated steel plate 16*b*. Moreover, in place of the oil groove 16*c*, the arrangement may be such that a longitudinal hole is provided in the laminated steel plate 16*b* and serves as an oil flow passage.

The frame 4 and the stator 16 are fitting in shrinkage or fitting in press so as to be inserted into a cylindrical casing 1 and be fixedly mounted thereon. A wiring 16*a* which is mounted on the stator 16 passes through one of the gas grooves 4*h*, and is wired such that a wiring terminal of the wiring 16*a* is inserted into an internal terminal of a hermetic terminal 22 of an upper casing 20 to which the hermetic terminal 22 is beforehand welded on the upper side of the frame 4. The upper casing 20 and the cylindrical casing 1 are fixedly mounted on each other by welding or brazing. A suction pipe 54 is inserted into the suction hole 4*i*, and is fixedly mounted on the cylindrical casing 1 by welding or brazing. A discharge pipe 55 is also fixedly mounted on the cylindrical casing 1. An upper chamber 61 is formed at an upper part of the outer peripheral cover 25. A lower part of the shaft 12 is inserted into an inner ring of a subsidiary bearing 17. A bearing support 18 on which the subsidiary bearing 17 is fixedly mounted is fixedly mounted on the cylindrical casing 1. The lower casing 21 is fixedly mounted on the cylindrical casing 1 by welding or brazing. Lubricating oil 56 is reserved or stored at the bottom of the lower casing 21. A motor chamber 62 is defined between the frame 4 and the lower cover 2*l*. However, a motor 19 causes current to flow to the stator 16 after assembling to change the ferromagnetic substance within the rotor 15 to the permanent magnet 15*b*.

Operation of the scroll fluid machine arranged as described above will be described. When energization is made to the motor 19 so that the rotor 15 is rotated, the gas which is sucked into the suction chamber 60 from the suction pipe 54 is compressed within a compression chamber 6 by the turning or orbital motion of the turning scroll member 3, and is discharged from the discharge hole 2*d* into the upper chamber 61 which is defined above the float scroll member 2. The discharged gas flows into the motor chamber 62 to cool the motor. The lubricating oil is separated from the gas and, thereafter, the discharged gas is discharged from the discharge pipe 55 to the outside of the compressor. Moreover, under a running condition in which the pressure ratio between the suction pressure and the discharge pressure is low, the release valve 23 opens to avoid that successive compression occurs.

The turning scroll member 3 is subjected to a force in a direction spaced away from the float scroll member 2, by the gas pressure within the compression chamber 6. However, since the thrust bearing 3*d* is in contact with the thrust bearing surface 4*m* and is subjected to the thrust forces the turning scroll member 3 can be prevented from being spaced axially away from the float scroll member 2. As a result, a gap between the addendum and the bottom of the scroll member does not increase. Thus, it is possible to maintain compression operation which is less in leakage.

The inward line and the outward line of each of the scroll wraps 2*b* and 3*b* are formed by spirals which are formed in such a manner that, with a spiral increasing under such a condition that a distance with respect to the origin increases under a convex state, together with an increase of an argument, serving as a reference, points spaced an identical distance from an optional point on the spiral are joined to each other. Here, what is meant by the point which is spaced the identical distance b from an optional point A on the spiral S is a point on the normal at the point A and spaced b away from the spiral S. Furthermore, as the above-described spiral in which the distance with respect to the origin increases under the convex state, together with the increase of the argument, an algebraic spiral, a logarithmic spiral and a spiral in which a distance with respect to the origin is changed and increases along a hyperbola together with an increase of the argument can be considered. A wrap formed in this manner comes into a wrap in which a thickness decreases as a point approaches an outer periphery from the center. Since the wrap shape is such that the wrap thickness at the wrap outer periphery is reduced as compared with a scroll wrap in which the thickness of the wrap is uniform, it is possible to reduce the diameter of the outermost periphery at which the scroll wrap is provided in upstanding. Accordingly, there is provided an advantage that the compressor can be sized in small and can be reduced in weight. Moreover, since the diameter of the scroll wrap at the outermost periphery can be reduced, it is possible to largely reduce an urging force or an attractive force between two scrolls for gas tightness of the compression chamber 6. As a result, a friction loss at the thrust bearing 3*d* can be reduced. Thus, there are provided advantages that the compressor can be raised in efficiency and the reliability can be raised.

Even in case where the scroll wrap is deformed upon running of the compressor so that contact occurs between the addendum and the bottom (end plate surfaces) of the wrap, the float scroll member 2 moves away from the turning scroll member 3. Accordingly, there is an advantage that damage is prevented from being generated between the addendum and the bottom, and the reliability of the compressor can be raised. Further, the center of the wrap in a radial direction is elevated in temperature. Since the wrap is high in thermal expansion, contact between the addendum and the bottom is apt to occur at the center of the wrap in the radial direction. However, since the wrap at the center is formed thick, there is also an advantage that the reliability of the compressor can be secured.

Moreover, since the float stopper 7 is used, it is prevented that the distance between the scroll members is reduced less than a predetermined distance. Upon normal running, it is possible to operate the compressor without the fact that the addendum and the bottom of the wrap are in strong contact with each other. For this reason, since the friction loss between the addendum and the bottom of the wrap can be reduced, there is an advantage that the compressor can be raised in efficiency. Moreover, there is an advantage that surface coating having familiarity or intimacy is provided on the turning scroll member 3, whereby it is possible to easily machine the compressor having high performance.

Furthermore, since a force acting downwardly by the discharge pressure which acts on the inner periphery of the seal projection 2*c* is applied to the float scroll member 2, exclusive parts become unnecessary or useless. Thus, there is an advantage that the number of parts of the compressor can be reduced. Further, since the radial outer part of the seal projection 2*c* becomes the suction pressure, the center of the end plate ha comes into the discharge pressure, while the outer periphery thereof comes into the suction pressure. Since the lower surface and the upper surface of the end plate 2*a* (both sides in the axial direction) come respectively into pressure distributions substantially similar to each other, pressure deformation of the end plate 2*a* is restrained. As a result, there is an advantage that the compressor can be raised in efficiency over a wide running range.

Furthermore, since the release valve is provided, there is an advantage that efficiency can be raised even under a running condition in which the pressure ratio is low. Moreover, there is an advantage that, since the Oldham's ring 5 is rested on the upper surface of the end plate 3*a*, the compressor can be reduced in diameter.

The lubricating oil 56 which is stored at the bottom of the compressor passes through the shaft oil-supply hole 12*a* by the pressure difference between the discharge pressure in the motor chamber 62 and the pressure in the back chamber 11 which communicates with the suction chamber 60 through the oil-supply hole 4*c* provided in the frame 4, and is supplied to the turning bearing 12*c*. The lubricating oil passes through the lateral oil-supply hole 12*b* and is supplied to the main bearing 4*a*. Moreover, the lubricating oil 56 passes through the back pressure chamber 11 and the oil-supply hole 4*c*, and enters the oil groove 4*b*, to lubricate the thrust bearing 3*d*. As shown in FIG. 13, since at least one of the plurality of oil grooves 4*b* is always in communication with the suction chamber 60, the lubricating oil 56 always flows into the suction chamber 60. The lubricating oil 56 enters the compression chamber 6 together with the suction gas, and is discharged from the discharge hole 2*d* to the upper chamber 61 together with the compressed gas. As described above, the lubricating oil 56 is separated from the gas at the motor chamber 62, and is again accumulated at the bottom.

In connection with the above, the arrangement may be such that the shape of the oil groove 4*b* is made to the circular shape eccentric from the center of the main bearing, the oil groove 4*b* is covered by the thrust bearing 3*d* when the axial load is high, and the oil-supply hole 4*c* is isolated from the suction chamber. 60 to raise the pressure in the back chamber 11 so that lubricating fluid pressure between the thrust surface 4*m* and the thrust bearing 3*d* is raised. The center of the circular oil groove 4*b* is made eccentric to a center position of the turning bearing at the time the load acting on the thrust surface 4*m* is high, whereby there is an advantage that the reliability of the compressor can be improved.

Moreover, there are the following advantages. That is, since the oil is supplied to the turning bearing 12*c* and the thrust bearing 3*d*, the circumstance of the boss 12*c* becomes substantially the discharge pressure. Since the discharge pressure acts upon the center of the rear surface of the turning scroll member 3, it is possible to reduce the load of the thrust bearing 3*d*. Since the friction loss at the thrust bearing 3*d* can be reduced, the compressor is raised in efficiency. Furthermore, since the back chamber 11 is pressure intermediate between the suction pressure and the discharge pressure, the radial center of the lower surface of the end plate 3*a* becomes the discharge pressure, while the radial intermediate part thereof becomes intermediate pressure. Since the lower surface and the upper surface of the end plate 3*a* (axial both sides) become the pressure distributions substantially similar to each other, pressure deformation of the end plate 3*a* is restrained. As a result, there is an advantage that the compressor can be raised in efficiency over the wide running range.

Since the lubricating oil 56 within the back chamber 11 is exhausted to the suction chamber 60, there is an advantage that viscous loss accompanied with the rotation of the turning retainer 12*f* can be reduced. Further, in case where the turning retainer 12*f* is formed into a cylindrical shape holding, in common, the axis with the shaft 12, there is an advantage that the viscous loss accompanied with the rotation of the turning retainer 12*f* can further be reduced. Moreover, since the gas layer is formed between the center cover 24 and the outer peripheral cover 25, and the turning scroll member, there is an advantage that heat from the discharge gas of high temperature within the upper chamber 61 can be prevented from being transmitted to the compression chamber 6.

Furthermore, the center cover 24 and the outer peripheral cover 25 have an advantage that an impulsive tone accompanied with the fact that the release valve 23 opens and is closed is isolated. Further, since the lower surface of the upper fixed table 8 is in fixed contact both with the stopper surface 7*f* and the upper surface of the frame 4, the stopper surface 7*f* of the float stopper 7 which is connected to the frame 4 through the upper fixed table 8 is arranged at an accurate position with respect to the frame 4. Thus, there is an advantage that management of the gap between the addendum and the bottom of each of the scroll wraps 2*b* and 3*b* is facilitated. Moreover, since the detents 7*a* and 7*b* and the Oldham's grooves 7*c* and 7*d* are formed to have respective widths thereof substantially the same as each other, simultaneous working is made possible. Thus, there is an advantage that accuracy of the arranged angle of the two scroll members can be improved. Furthermore, since the detents 2*g* and 2*h* are formed integrally on the end plate, there is an advantage that accuracy of the positional relationship with respect to the scroll wrap 2*b* is improved.

By the way, since the scroll wraps 2*b* and 3*b* intend to be inclined radially outwardly of the scroll by the gas pressure which acts upon the side surfaces of the scroll wraps 2*b* and 3*b* (radially of the scrolls 2 and 3), curvature occurs in the end plates 2*a* and 3*a* so that the gap in the radial direction between the wraps is enlarged. The curvature of the end plate becomes a mode so as to be curved in the left and the right with a line passing through the vicinity of the end plate center and the winding end of the scroll wrap serving as the center. In the present embodiment, since the Oldham's support projections 3*i* and 3*j* are provided at this position, there is an advantage that deformation of the end plate 3*a* can be restrained. Furthermore, since the outer diameter of the release valve 23 is set to the size substantially the same as the inner diameter of the seal projection 2*c*, there is an advantage that positioning of the release valve 23 is facilitated.

Further, surface coating having abrasiveness and lubricity, for example, surface coating due to nitrosulphurizing treatment and manganese phosphate coating treatment may be provided on the upper surface of the end plate 3*a* of the turning scroll member 3 and the whole surface of the scroll wrap 3*b*. Thus, there are the following advantages. That is, it is possible to reduce the gaps between the side surfaces of the scroll wraps 3*b* and 2*b* and between the addendum and the bottom. It is possible to reduce internal leakage and to reduce the friction loss. Since the slidability at the contact part between the scroll wraps 3*b* and 2*b* is improved, the performance of the compressor can be improved.

Moreover, surface coating having abrasiveness and lubricity, for example, surface coating due to nitrosulphurizing treatment and manganese phosphate coating treatment may be provided on the lower surface of the end plate 2*a* of the float scroll member 2 and the whole surface of the scroll wrap 2*b*. Thus, there are the following advantages. That is, it is possible to reduce the gaps between the side surfaces of the scroll wraps 3*b* and 2*b* and between the addendum and the bottom. Since the slidability at the contact part between the scroll wraps 3*b* and 2*b* can be improved, it is possible to reduce internal leakage and to reduce the friction loss. As a result, there is an advantage that the performance of the compressor can be improved.

Furthermore, surface coating having abrasiveness and lubricity, for example, surface coating due to nitrosulphurizing treatment and manganese phosphate coating treatment may be provided on the upper surface of the end plate 3*a* of the turning scroll member 3 and the whole surface of the scroll wrap 3*b* and, further, on the lower surface of the end plate 2*a* of the float scroll member 2 and the whole surface of the scroll wrap 2*b*. Thus, it is possible to easily reduce the gaps between the side surfaces of the scroll wraps 3*b* and 2*b* and between the addendum and the bottom. Since the slidability at the contact part between the scroll wraps 3*b* and 2*b* is further improved, it is possible to reduce internal leakage and to reduce the friction loss. As a result, there is an advantage that the running-in period of the compressor can be reduced, and the performance thereof can further be improved.

Further, surface coating whose thickness is reduced by the compression force together with the passage of running time may be provided on the surface of the end plate 2*a* which is urged against the stopper surface 7*f* of the float stopper 7. As such surface coating, there is surface coating due to, for example, nitrosulphurizing treatment and manganese phosphate coating treatment. Since these coatings have therein void holes, if a compression force acts thereon for a long period of time, the void holes therewithin are gradually broken. Accordingly, the thickness thereof is reduced with the passage of the running time. With the arrangement, since the hard layers between the addendum and the bottom of the scroll member 2 and between the addendum and the bottom of the scroll member 3 gradually approach each other with the passage of the running time, even if the addendum and the bottom of the scroll member 2 and the addendum and the bottom of the scroll member 3 are accidentally in contact with each other and are worn or abraded, it is possible to subsequently reduce the gap between the addendum and the bottom. Accordingly, there is an advantage that the high performance can be maintained over a long period of time.

Moreover, surface coating due to nitrosulphurizing treatment and manganese phosphate coating treatment may be provided on the whole surface of the float scroll member 2. It is made possible to treat in coating the float scroll member 2 without masking. Furthermore, it is possible to reduce the gaps between the side surfaces of the scroll wraps 3*b* and 2*b* and between the addendum and the bottom. Slidability at the contact part between the scroll wraps 3*b* and 2*b* can be improved. Since the hard layers between the addendum and the bottom and the addendum and the bottom of both the scroll members 2 and 3 gradually approach each other with the passage of the running time, it is possible to reduce that the addendum and the bottom of each of the two scroll members 2 and 3 are accidentally in contact with each other and are abraded. Since the gap between the addendum and the bottom can be reduced, there is an advantage that it is possible to easily manufacture'the compressor which is high in performance and which can maintain high performance for a long period of time.

Furthermore, the arrangement may be such that surface coating due to nitrosulphurizing treatment and manganese phosphate coating treatment is provided on the whole surface of the float scroll member 2 and, thereafter, a surface to which the screw hole 2*i* opens and on which the release valve 23 is arranged is polished. Thus, it is ensured that the release hole 2*f* is shielded by the release valve 23. As a result, there is an advantage that the performance of the compressor under the excessively compressive condition can be improved.

Further, surface coating having abrasion resistance, or tissues having abrasion resistance due to heat treatment, or material having abrasion resistance may be provided on the slide thrust bearing 3*d* of the turning scroll member 3. Thus, there is a peculiar advantage that, since spacing between the addendum and the bottom of each of both the scroll members 2 and 3 is restrained, high performance can be maintained for a long period of time.

Moreover, surface coating superior in lubricating ability, or tissues superior in lubricating ability due to heat treatment, or material having superior lubricating ability may be provided on the thrust bearing 3*d*. Thus, there is an advantage that, since the sliding loss of the thrust bearing 3*d* is reduced, it is possible to improve the performance of the compressor.

Furthermore, the arrangement may also be such that the detents 2*g* and 2*h* of the float scroll member 2 are formed by grooves, and the detent grooves 7*a* and 7*b* in the float stopper 7 are projections. In this case, there is an advantage that, since the strength of the float stopper 7 increases, the reliability of the compressor can be improved.

Further, the arrangement may be such that the center cover 24 is formed by material higher in coefficient of thermal expansion than material of the end plate 2*a*, and a portion between the outer periphery of the center cover 24 and the inner periphery of the seal projection 2*c* is clearance fitting of a degree of the maximum 10 &Lm. In this case, when the center cover 24 is elevated in temperature upon running so as to be thermally expanded, the compressor is deformed in a direction in which the seal projection 2*c* is expanded. Accordingly, the upper surface of the end plate 2*a* is extended relatively as compared with the lower surface thereof. As a result, the center of the scroll wrap of the end plate 2*a* is spaced away from the bottom surface of the turning scroll 3. The center of the scroll wrap is elevated in temperature. It is possible to avoid contact between the addendum and the bottom of the wrap due to the fact that the scroll wrap is extended. Thus, there are advantages that high efficiency and high reliability of the compressor can be realized. For example, the float scroll member 2 may be formed by cast iron, and the center cover 24 may be formed by brass, zinc or an aluminum alloy. Particularly, the float scroll member 2 may be formed by an aluminum alloy whose silicon content is of a degree of 10 !A 30% and whose Young's modulus is high.

Moreover, the arrangement may be such that a portion between the outer peripheral surface of the float stopper 7 and the inner peripheral surface of the frame 4 is clearance fitting of a degree of 5 &Lm, an axis of the outer peripheral surface of the float stopper 7 and an axis of the inner peripheral surface of the upper fixed table 8 are put together, and the float stopper 7 and the upper fixed table 8 are fixed to each other to form the fixed table 9. With the arrangement, positioning of the float scroll member 2 is determined only by the part forms. Accordingly, when the fixed table 9 and the outer peripheral cover 25 are fixed to the frame 4 by the cover screw 53, it is possible to omit process to rotate the shaft 12 or the rotor 15 to manage the torque thereof. Thus, there is an advantage that assembling is facilitated.

Furthermore, coating of abrasion resistance, or tissues having abrasion resistance due to heat treatment, or material having abrasion resistance may be provided on the surface of the boss 3*c* of the turning scroll member 3. Thus, there is an advantage that, since the durability of the boss 3*c* is improved, the reliability of the compressor can be improved.

Further, coating superior in lubricating ability, or tissues of abrasion resistance due to heat treatment, or material of abrasion resistance may be provided on the surface of the boss 3*c* of the turning scroll member 3. Thus, there is an advantage that, since a sliding loss of the turning bearing is reduced, it is possible to improve the performance of the compressor.

Further, a separate member made of material having abrasion resistance may mechanically be fixed to the boss 3*c* of the turning scroll member 3, or a separate member made of material having abrasion resistance may mechanically be fixed thereto by welding or fusion. Thus, there is an advantage that, since working of the boss 3*c* having the durability is facilitated, it is possible to improve the workability of the compressor.

Figure 15:
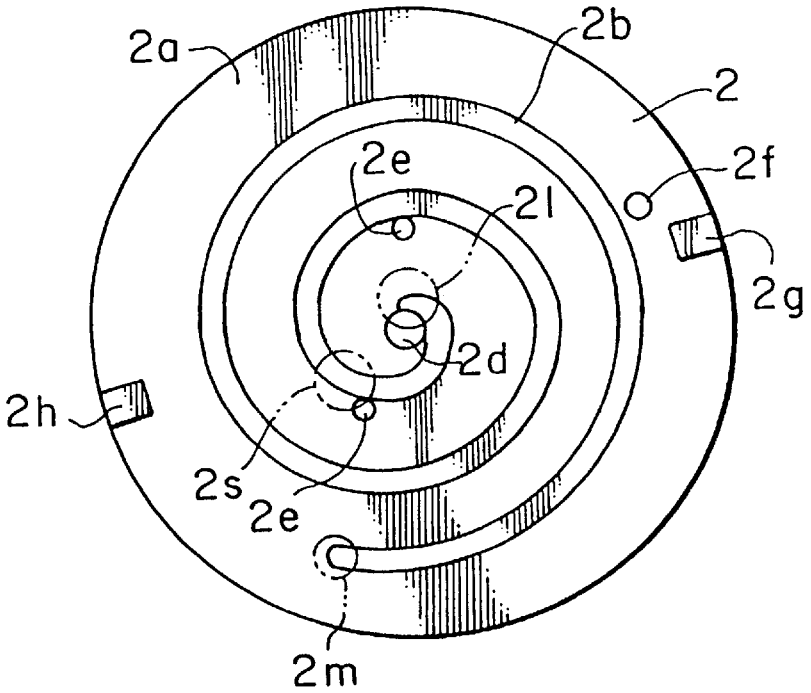
FIG. 15 is a bottom plan view of a float scroll member in a second embodiment of the invention.
Figure 16:
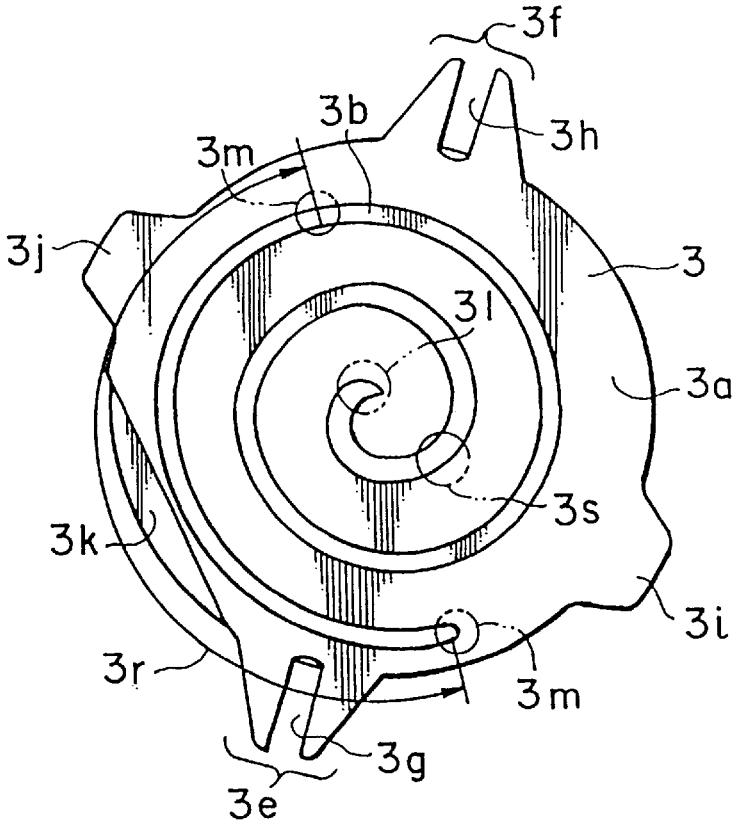
FIG. 16 is a top plan view of a turning scroll member in the embodiment.
Figure 17:
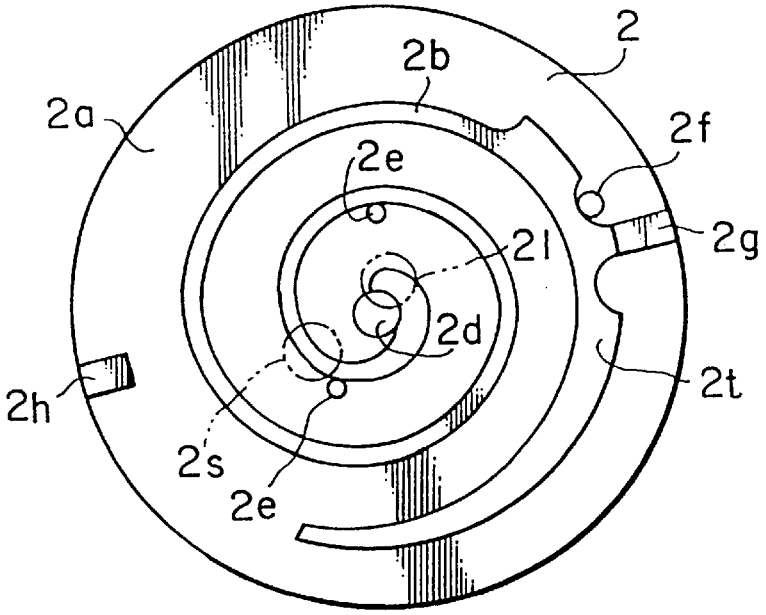
FIG. 17 is a bottom plan view of the float scroll member in is the embodiment.
Figure 18:
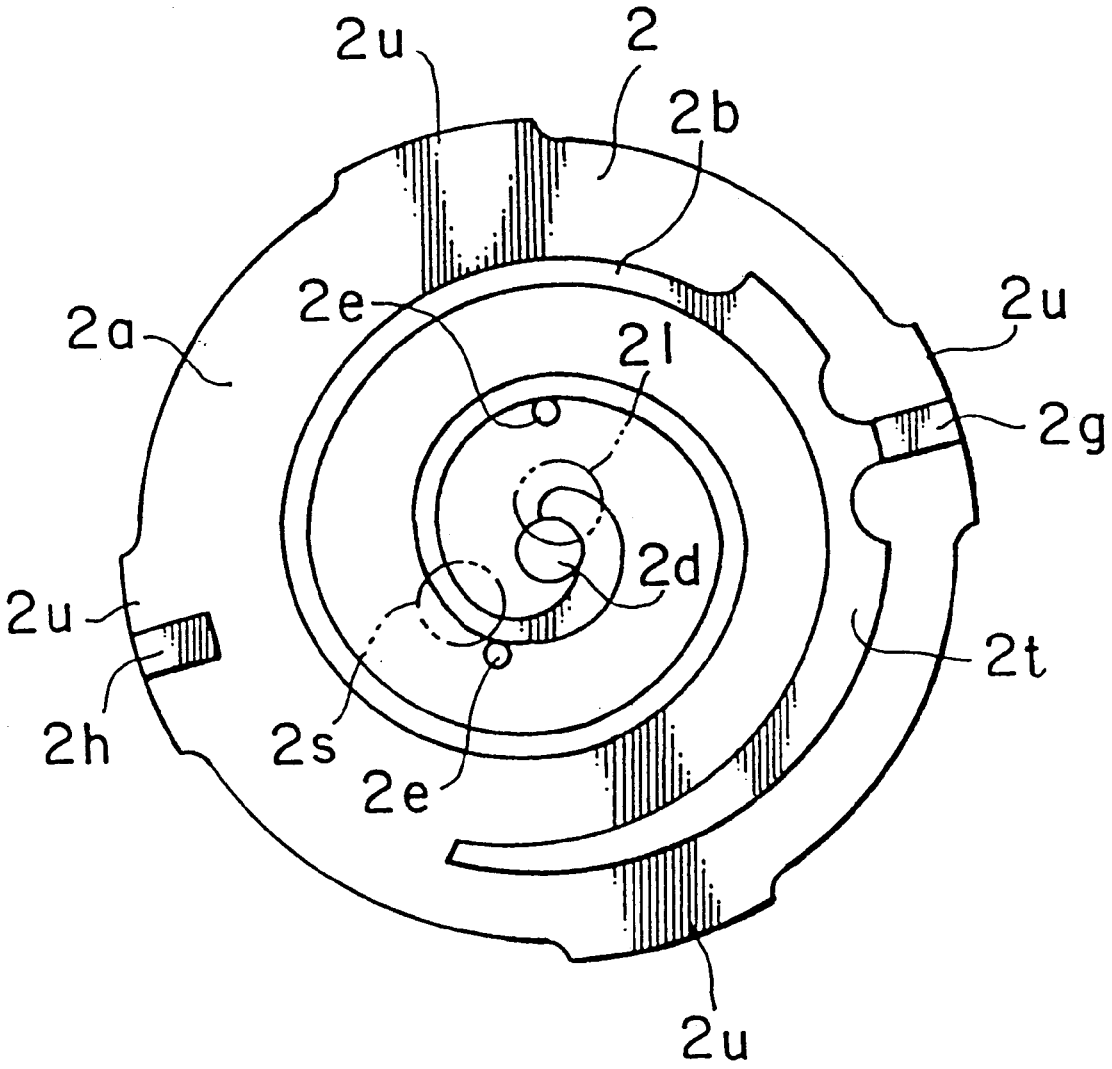
FIG. 18 is a bottom plan view of the float scroll member in the embodiment.
Figure 19:
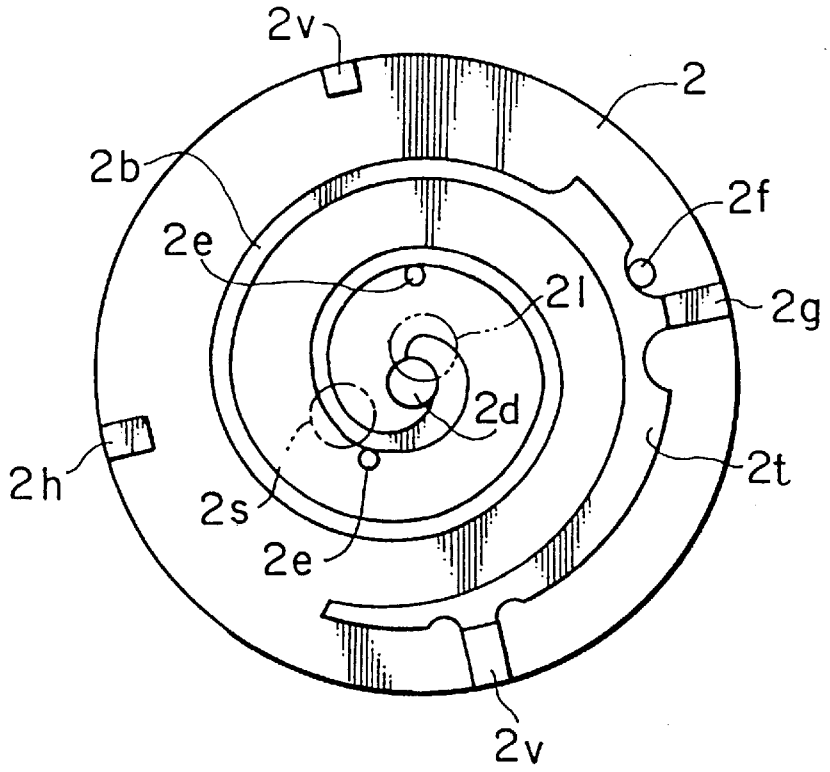
FIG. 19 is a bottom plan view of the float scroll member in the embodiment.
Figure 20:
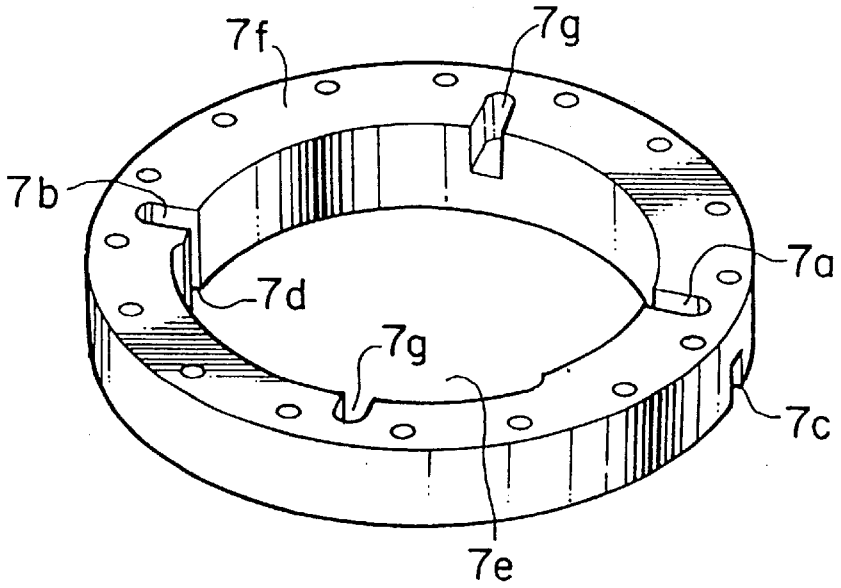
FIG. 20 is a perspective view of a float stopper in the embodiment as viewed from the upper.
Figure 21:
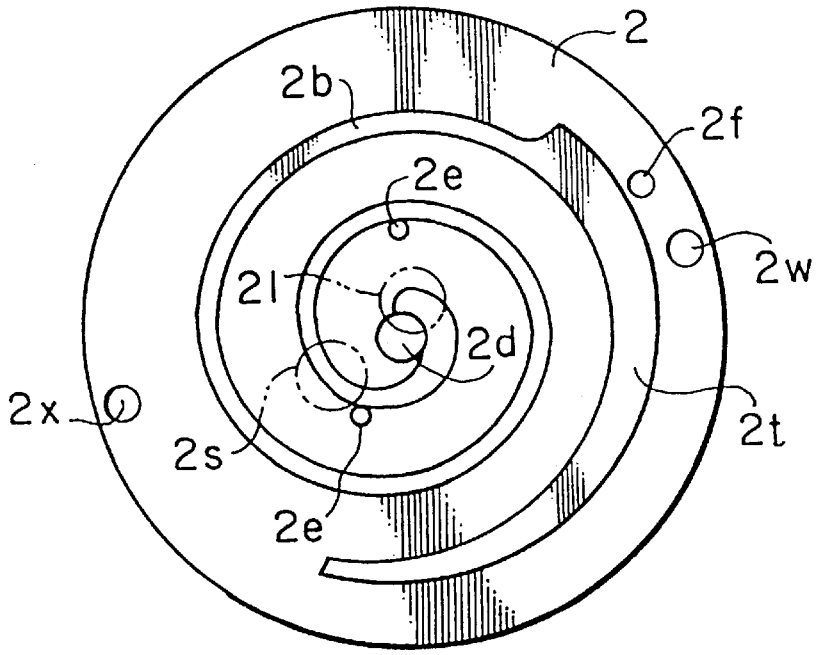
FIG. 21 is a bottom plan view of the float scroll member in the embodiment.
Figure 22:
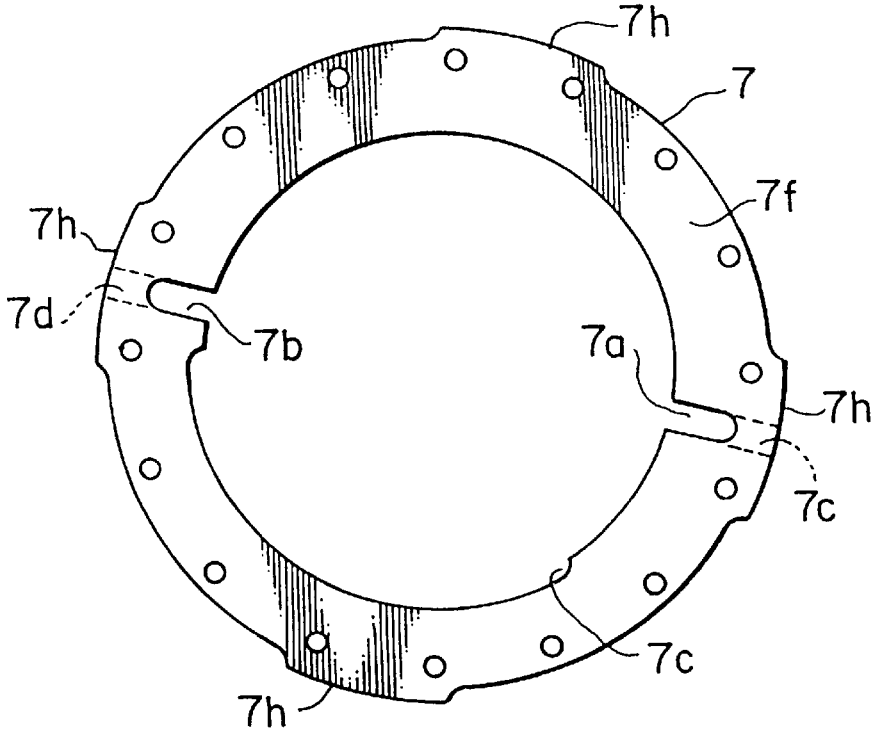
FIG. 22 is a top plan view of the float stopper in the embodiment.

A second embodiment of the invention will be described with reference to FIGS. 15 to 22. The present embodiment relates to a float scroll member and a turning scroll. FIG. 15 is a bottom plan view of the float scroll member. FIG. 16 is a top plan view of a turning scroll member. FIG. 17 is a bottom plan view of the float scroll member. FIG. 18 is a bottom plan view of the float scroll member. FIG. 19 is a bottom plan view of the float scroll member. FIG. 20 is a perspective view of the float stopper 7 from the upper. FIG. 21 is a bottom plan view of the float scroll member. FIG. 22 is a top plan view of the float stopper 7.

As compared with the first embodiment, the present embodiment differs therefrom in the form of the radial center of the scroll wrap 2*b*, and the form of the radial center and the radial outer part of the scroll wrap 3*b*. Other than the same, the present embodiment is arranged similarly to the first embodiment. The present embodiment uses a curved line in which the outward lines of the radial centers 21 and 31 of the respective scroll wraps 2*b* and 3*b* are locally bulged outwardly. With the arrangement, minimum parts 2*s* and 3*s* of the thickness (width) of the wrap are formed on the way of the scroll wrap. However, it is possible to increase the diameter of the discharge port 2*d* while a volume ratio thereof is secured. As a result, there is an advantage that, since the discharge flow-passage resistance can be reduced, the pressure loss at the discharge process is reduced so that the compressor can be improved in efficiency. Moreover, in the embodiment, the outward line which does not participate in formation of the compression chamber 6 in the scroll wrap 3*b* is formed to the same thickness in an outer periphery 3*r*. For this reason, a straight-line part or a circular part is provided on an end 3*n* at the outer periphery. As a result, there is an advantage that, since the thickness of the outer periphery of the scroll wrap can be secured, it is possible to improve the reliability of the scroll wrap.

A modification will be described with reference to FIG. 17. The modification is arranged similarly to the embodiment shown in FIGS. 15 and 16. However, the present modification is different from the embodiment in the form of the scroll wrap 2*b* on the outer peripheral side. Specifically, a wrap thickness of an outer periphery 2*t* of the outward line which does not participate in the formation of the compression chamber 6 in the scroll wrap 2*b* increases. As a result, there is an advantage that, since the strength of the scroll wrap 2*b* is improved, the reliability of the compressor can be raised.

A further modification will be described with reference to FIG. 18. The modification is arranged similarly to the modification shown in FIG. 17. However, sliding parts 2*u* for being fitted into the inner periphery of the upper fixed table 8 project to remove the equalizer hole 2*f*. As a result, there is an advantage that, since fitting to the fixed table 9 is facilitated, it is possible to easily assembly the compressor. Moreover, there is an advantage that, since the suction chamber 60 and the upper surface chamber 10 communicate with each other by the gap at the outer periphery, working of the equalizer hole 2*f* becomes useless.

A further modification will be described with reference to FIGS. 19 and 20. The modification is arranged similarly to the modification shown in FIG. 18. However, two projections 2*v* for positioning are provided on the end plate of the float scroll member 2, and float positioning grooves 7*g* into which the projections 2*v* are respectively fitted are provided on the float stopper 7. As a result of such arrangement, there is provided an advantage that, since fitting at the outer peripheries of the fixed table 9 and the float scroll member 2 becomes useless, assembling of the compressor can be facilitated. Furthermore, the projection or projections 2*v* for the positioning, and the float positioning groove or grooves 7*g* may be a single or may be three or more.

A further modification will be described with reference to FIG. 21. The modification is arranged similarly to the modification shown in FIG. 18. However, the detents 2*g* and 2*h* are made, respectively, to separate detent pins 2*w* and 2*x*. With the arrangement, there is an advantage that workability of the float scroll member 2 is improved.

A further modification will be described with reference to FIG. 22. The modification is arranged similarly to the embodiment shown in FIG. 15. However, sliding parts 7*h* which are fitted into the inner periphery of the frame 4 are provided on the outer periphery of the float stopper 7. As a result, there is an advantage that, since positioning of the float stopper 7 with respect to the frame 4 is facilitated, assembling of the compressor is facilitated.

Figure 23:
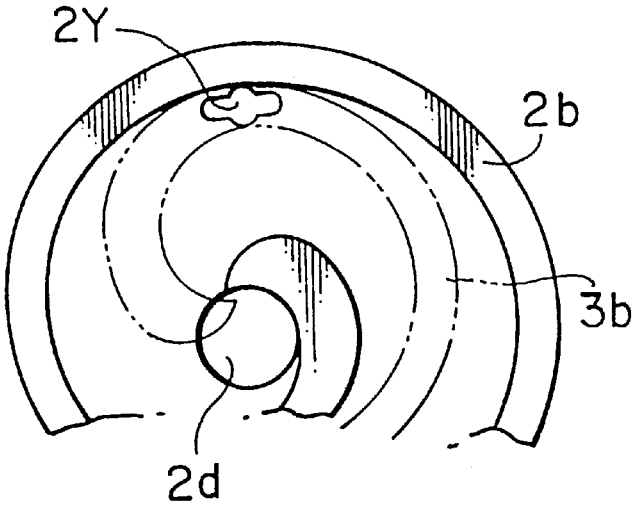
FIG. 23 is a bottom plan view in the vicinity. of a release hole in a float scroll member in a third embodiment of the invention.
Figure 24:
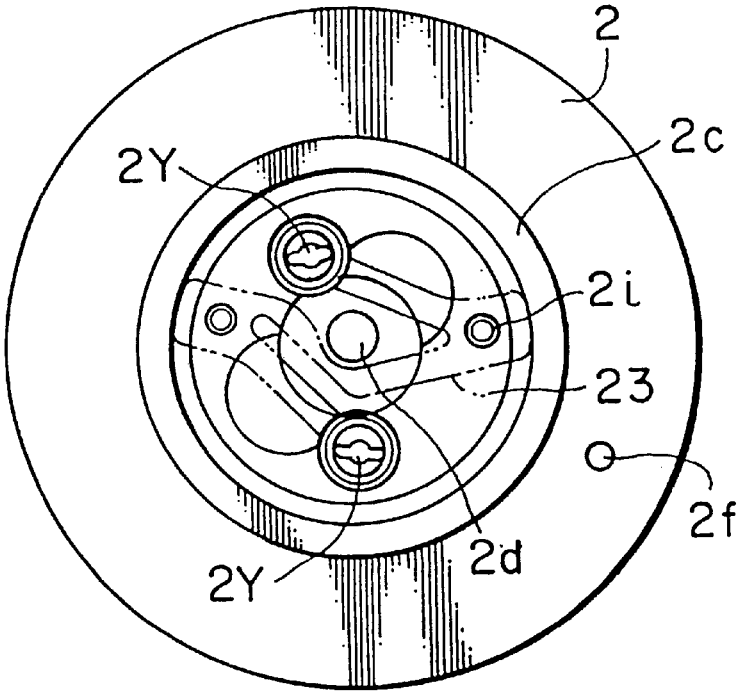
FIG. 24 is a top plan view of the float scroll member in the embodiment.
Figure 25:
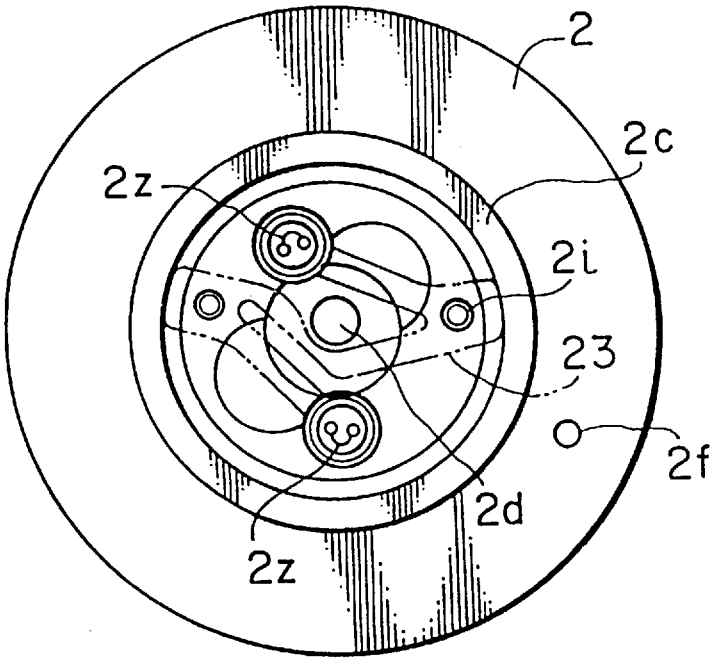
FIG. 25 is a top plan view of the float scroll member in the embodiment.

A third embodiment of the invention will be described with reference to FIGS. 23 to 25. FIG. 23 is a bottom plan view in the vicinity of the release hole in the float scroll member 2. FIG. 24 is a top plan view of the float scroll member 2, while FIG. 25 is a top plan view of the float scroll member 2.

The present embodiment is arranged similarly to the first embodiment. However, the release holes are made respectively to long sideways release holes 2*y*. As a result, there is an advantage that, since it is possible to open a release hole which is large in cross-section without the fact that a compression chamber different in pressure communicates therewith, it is possible to avoid excessive compression reliably and rapidly. In a compressor which loads a scroll wrap in which the thickness of the wrap varies, there are many cases where the thickness of the scroll wrap is reduced except for the vicinity of the center thereof. Accordingly, since it is difficult for a circular release hole to largely secure the cross-sectional area, the long sideways release holes 2*y* in the present embodiment are particularly effective in order to reduce the pressure loss upon release.

A modification will be described with reference to FIG. 25. The present modification is arranged similarly to the embodiment shown in FIG. 24. In the present modification, however, each of the release holes is formed by two parallel release holes 2*z* which approach each other. With the arrangement, there is an advantage that, since it is easily open the release hole which is large in cross-section without the fact that a compression chamber having different pressure communicates therewith, it is possible to avoid excessive compression reliably and rapidly. In a compressor which loads a scroll wrap in which the thickness of the wrap varies, there are many cases where the thickness of the scroll wrap is reduced except for the vicinity of the center thereof. Accordingly, it is difficult for a circular release hole to open the hole large in cross-section, and the parallel release holes 2*z* are particularly effective.

Figure 26:
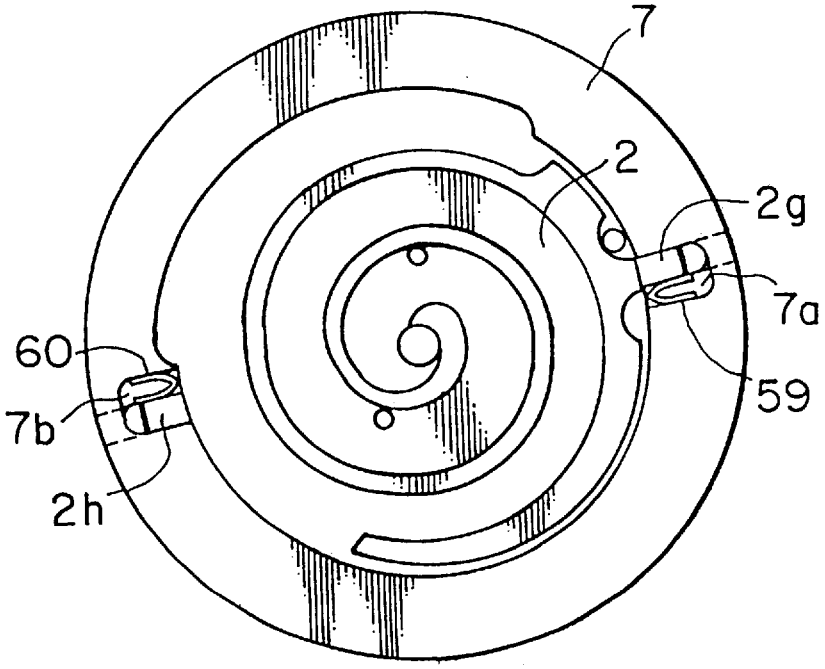
FIG. 26 is a bottom plan view of an assembly including a float scroll member and a float stopper, in a fourth embodiment of the invention.

A fourth embodiment of the invention will be described with reference to FIG. 26. FIG. 26 is a bottom plan view of assembly including the float scroll member 2 and the float stopper 7.

The present embodiment is arranged similarly to the first embodiment. However, springs 59 and 60 are inserted respectively between the detent grooves 7*a* and 7*b* and the detents 2*g* and 2*h*, to generate a circumferential force. As a result, there is an advantage that, since the position of the float scroll member 2 in the rotational direction can be prescribed accurately without backlash, it is possible to improve the efficiency of the compressor.

Figure 27:
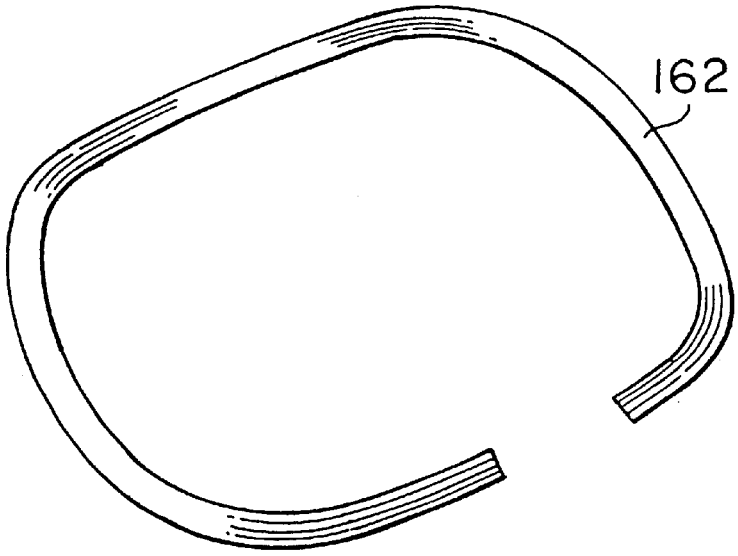
FIG. 27 is a perspective view of a leaf spring in the embodiment.

In connection with the above, a wavy leaf spring 162 shown in FIG. 27 may be arranged in the upper chamber 10 to bias the float scroll member 2 toward the turning scroll member 3. As a result, even in case where the discharge pressure is extremely low, and only the gas pressure in the upper chamber 61 does not force down the float scroll member 2 toward the turning scroll member 3, it is made possible to force down the float scroll member 2 by a resilient force of the leaf spring 162. Accordingly, there is an advantage that it is possible to widen, in area, the running range of high efficiency of the compressor.

Figure 28:
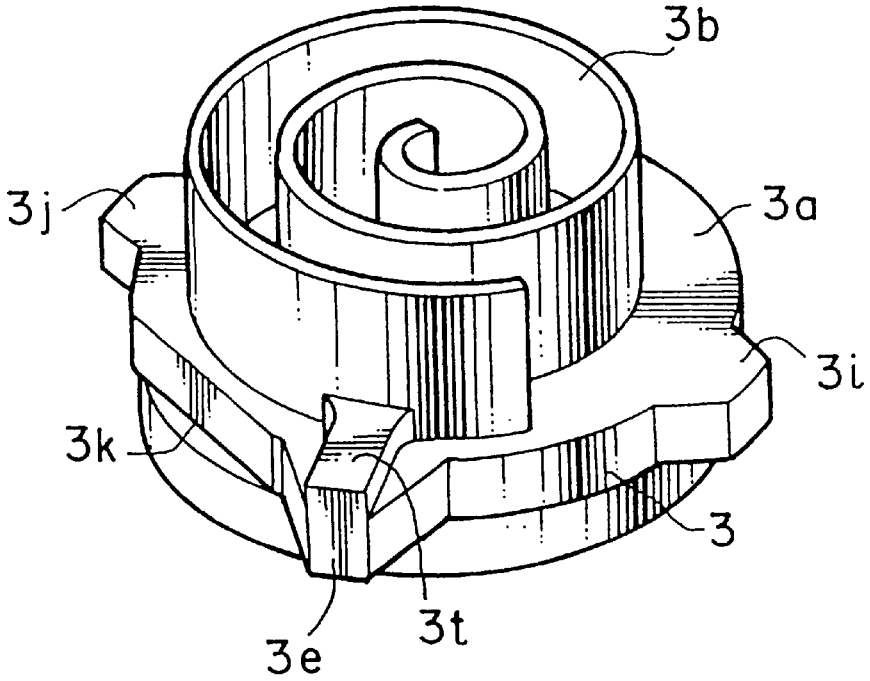
FIG. 28 is a perspective view of a turning scroll member in a fifth embodiment of the invention, as viewed from the upper.
Figure 29:
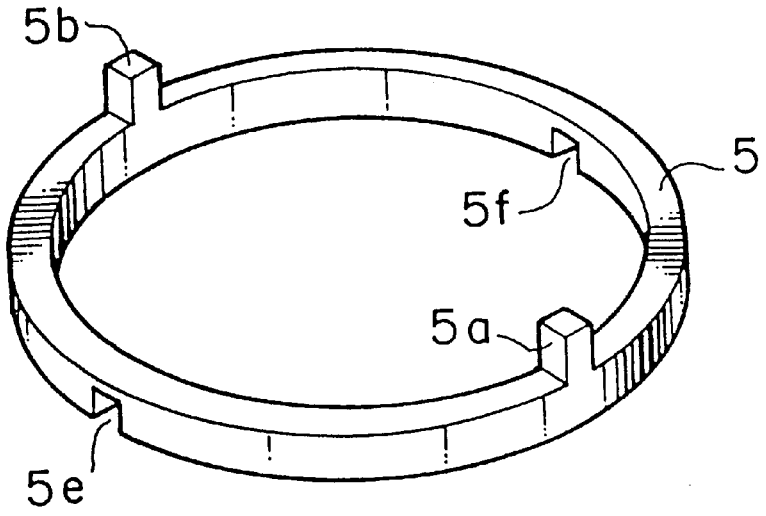
FIG. 29 is a perspective view of an Oldham's ring in the embodiment, as viewed from the upper.

A fifth embodiment of the invention will be described with reference to FIGS. 28 and 29. FIG. 28 is a perspective view of the turning scroll member 3 from the upper, while FIG. 29 is a perspective view of the Oldham's ring 5 from the upper.

The present embodiment is arranged similarly to the first embodiment. However, Oldham's sliding projections 3*t* and 3*u* (3*u* is not shown) are provided on the upper surface of the end plate 3*a*, and turning grooves 5*e* and 5*f* are provided in the Oldham's ring 5. As a result, since a sliding part-of the turning scroll member 3 with respect to the Oldham's ring is not groove, it is possible to work the sliding part by a cutter identical with an end mill large in diameter, which works the scroll wrap 3*b*. Accordingly, it is possible to secure the positional relationship between the scroll wrap 3*b* and the Oldham's ring 5 accurately. As a result, there is an advantage that the compressor is made high in efficiency.

Figure 30:
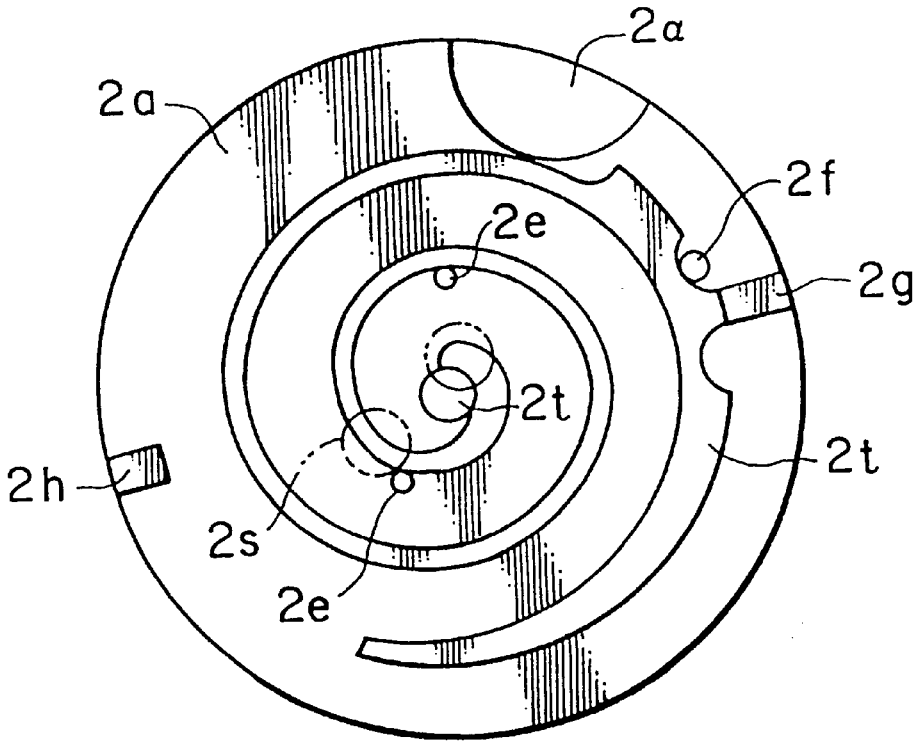
FIG. 30 is a bottom plan view of a float scroll member in a sixth embodiment of the invention.
Figure 31:
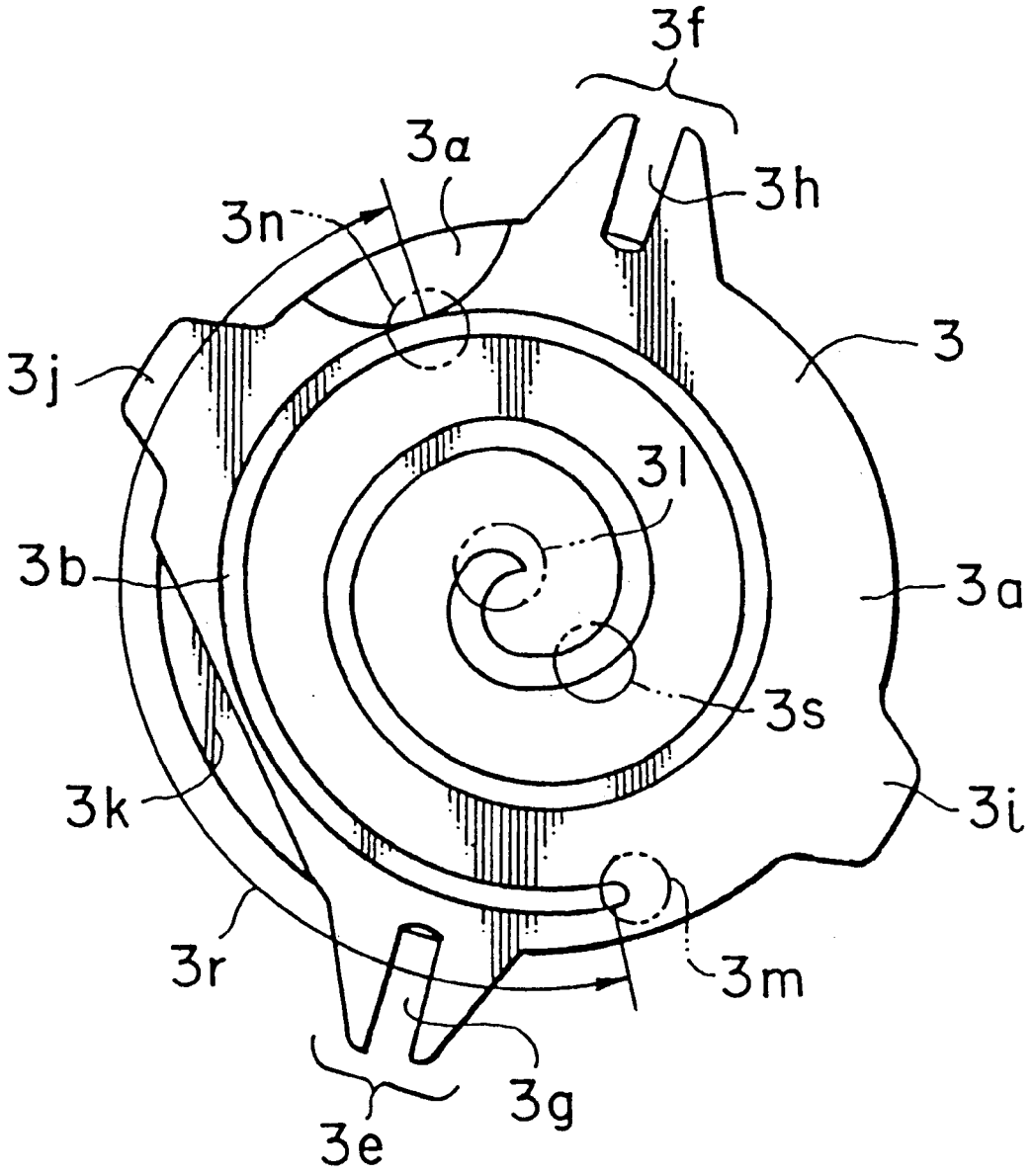
FIG. 31 is a top plan view of a turning scroll member in the embodiment.

A sixth embodiment of the invention will be described with reference to FIGS. 30 and 31. FIG. 30 is a top plan view of the float scroll member 2, while FIG. 31 is a top plan view of the turning scroll member 3.

The present embodiment is arranged similarly to the first embodiment. However, suction steps 2α and 3*a* are provided respectively on the upper surfaces of the end plates 2*a* and 3*a*. As a result, there is an advantage that, since gas flow-passage resistance upon gas suction into the compressor chamber is reduced, the compressor is made high in efficiency. Here, the suction steps 2α and 3α are a circular form. However, the invention should not be limited to this. The suction steps 2α and 3α may be an elliptic form or a polygonal form.

Figure 32:
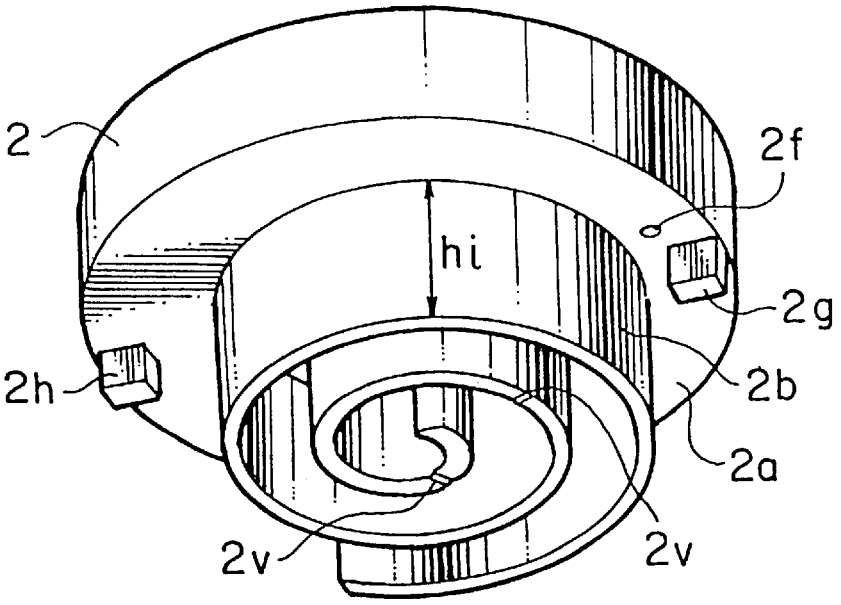
FIG. 32 is a perspective view of a float scroll member in a seventh embodiment of the invention, as viewed from the lower.
Figure 33:
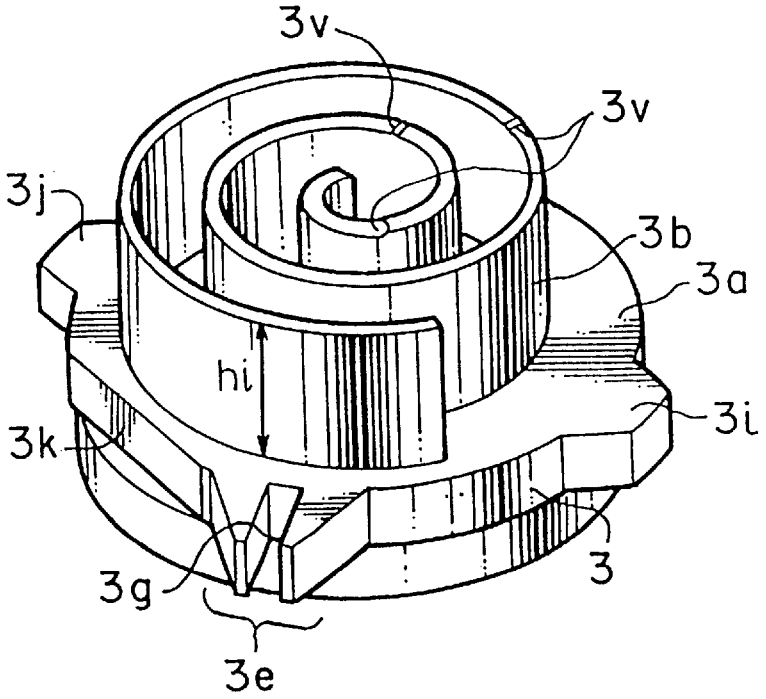
FIG. 33 is a perspective view of a turning scroll member in the embodiment as viewed from the upper.
Figure 34:
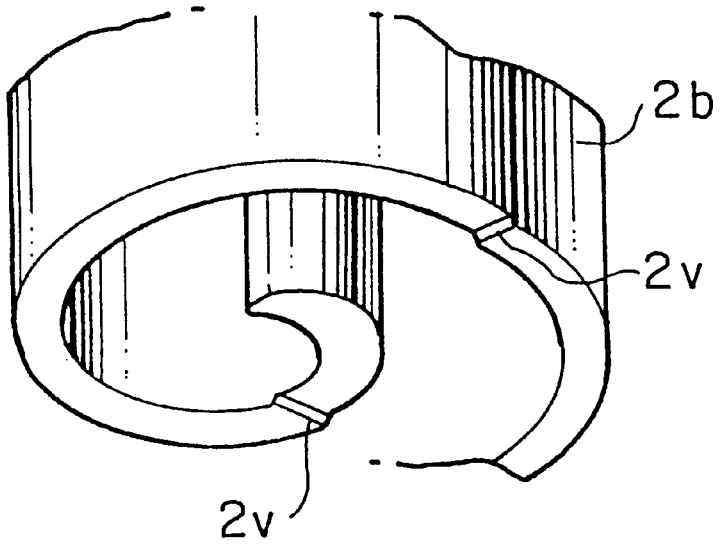
FIG. 34 is an enlarged perspective view of the float scroll member in the embodiment, from the lower of a wrap forward end thereof.
Figure 35:
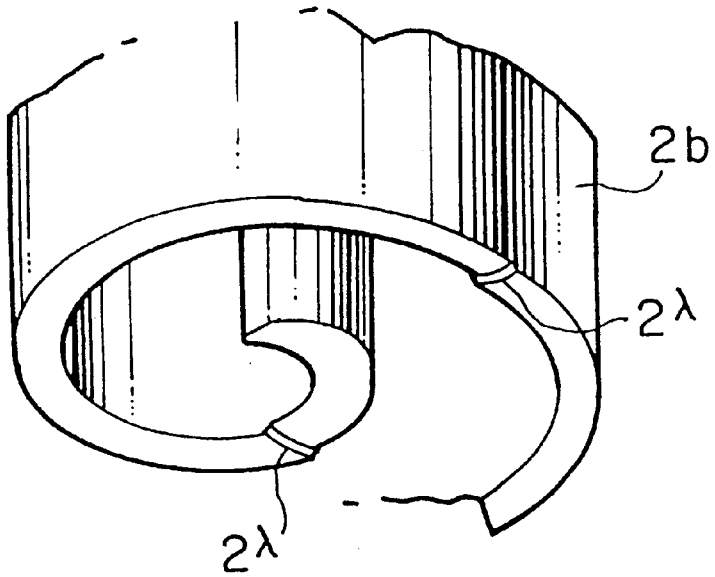
FIG. 35 is an enlarged perspective view of the float scroll member in the embodiment, from the lower of the wrap forward end.
Figure 36:
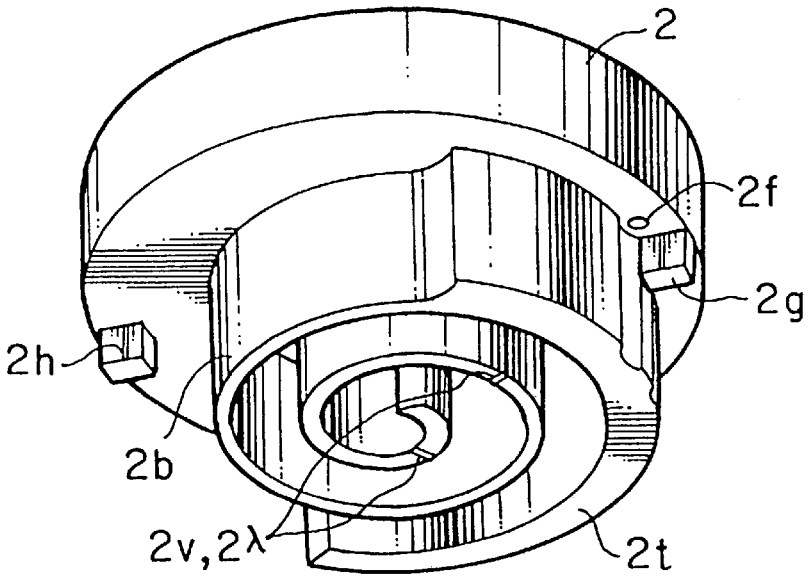
FIG. 36 is a perspective view of the float scroll member in the embodiment as viewed from the lower.

A seventh embodiment of the invention will be described with reference to FIGS. 32 to 36. FIG. 32 is a perspective view of the float scroll member 2 from the lower. FIG. 33 is a perspective view of the turning scroll member 3 from the upper. FIG. 34 is an enlarged view of a wrap forward end of the float scroll member 2. FIG. 35 is an enlarged view of the wrap forward end of the float scroll member 2. FIG. 36 is a perspective view of the float scroll member 2 from the lower.

The present embodiment is arranged similarly to the first embodiment. However, the present embodiment is arranged such that a projection height hi from bottom surfaces of the scroll wraps 2*b* and 3*b* decreases stepwise radially inwardly, whereby rectilinear addendum steps 2*v* are provided, and similar rectilinear addendum steps 3*v* are provided also on the addendum of the scroll wrap 3*b*. As a result, there is an advantage that, since it is possible to give an initial gap (particularly in a radially inward part) to two contact parts between the addendum and the bottom which are formed by intermeshing or interlocking between the scroll wraps 2*b* and 3*b* while the bottoms of both the scrolls are maintained to planar shapes, the compressor high in reliability can easily be manufactured. Normally, the step is made to a step of a degree of 1 &Lm !A 10 &Lm. Further, in the present embodiment, the steps may be two or three. However, the invention should not be limited to this. The steps may any number of steps. Moreover, the steps are not a step-like form, but the wrap height may continuously be changed gradually.

A modification will be described with reference to FIG. 35. The modification is arranged similarly to the embodiment shown in FIG. 34. However, the modification is arranged such that circular addendum steps 2&K are provided on the scroll wrap 2*b*, and similar circular addendum steps 3&K (not shown) are provided on the addendum of the scroll wrap 3*b*. As a result, the height of the end mill cutter is changed while the end mill cutter having a diameter thereof equal to or more than the thickness of the wrap moves schematically along the center of the wrap thickness, whereby step working is made possible. Accordingly, there is an advantage that the compressor can easily be worked.

A modification will be described with reference to FIG. 36. The modification is arranged similarly to the embodiment and the modification shown in FIGS. 34 and 35 that are enlarged views of the wrap forward end of the float scroll member 2. However, the present modification is arranged such that the outer periphery 2*t* in which the thickness or the width of the wrap is enlarged is provided on the scroll wrap 2*b*. For this reason, the strength of the scroll wrap 2*b* is improved. Accordingly, there is an advantage that the reliability of the compressor can be raised.

Figure 37:
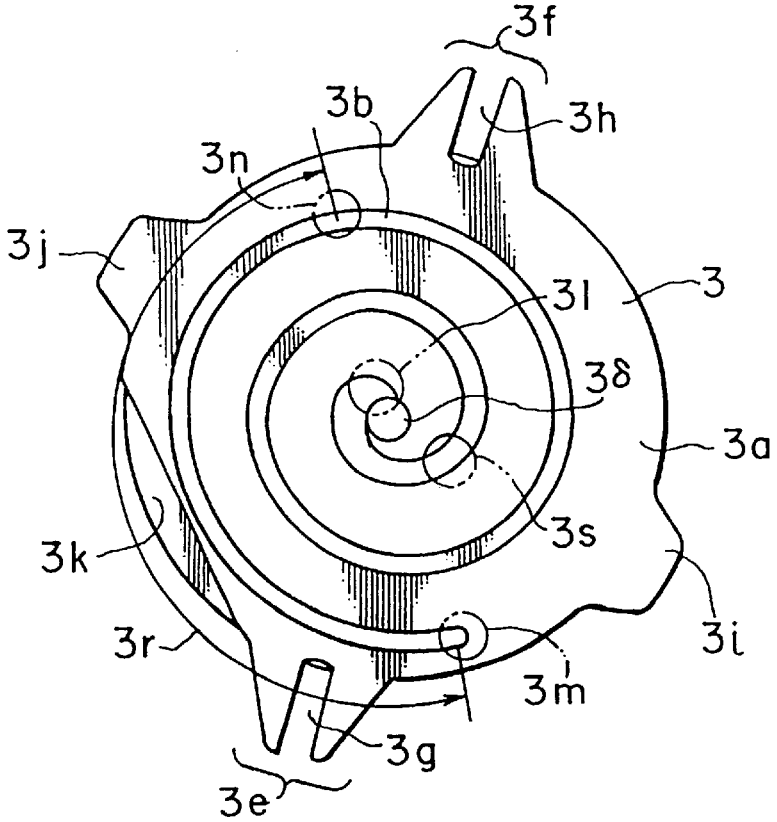
FIG. 37 is a top plan view of a turning scroll member in an eighth embodiment of the invention.

An eighth embodiment of the invention will be described with reference to FIG. 37. FIG. 37 is a top plan view of the turning scroll member 3.

The present embodiment is arranged similarly to the first embodiment. However, the present embodiment is arranged such that a bottom hole 38 which does not pass through is provided in the vicinity of the center of the end plate 3*a*. The relative positional relationship between the bottom hole 36 and the scroll wrap 3*b* is the same as the relative positional relationship between the discharge hole 2*d* and the scroll wrap 2*b* of the float scroll member 2. As a result, there is an advantage that, since a flow passage through the bottom hole 36 is newly added as the discharge path of the gas within the compression chamber 6 which is defined by the inward line of the turning scroll member 3, the discharge flow-passage resistance is reduced and, accordingly, the compressor can be raised in efficiency.

Figure 38:
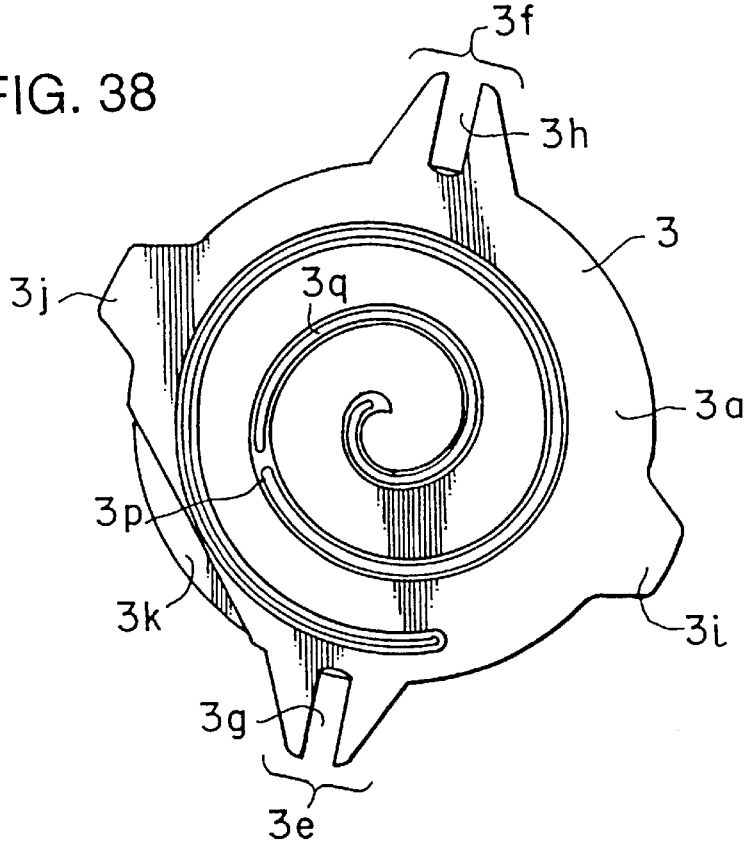
FIG. 38 is a top plan view of a turning scroll member in a ninth embodiment of the invention.

A ninth embodiment of the invention will be described with reference to FIG. 38. FIG. 38 is a top plan view of the turning scroll member 3.

The present embodiment is arranged similarly to the first embodiment. However, tip seals 3*p* and 3*q* are provided on the addendum of the scroll wrap 3*b*. As a result, there is an advantage that, since leakage between the addendum and the bottom is reduced, the compressor can be raised in efficiency. Further, there is an advantage that, since, in the present embodiment, the tip seal 3*q* which is different from the tip seal 3*p* at the outer periphery and which is wider than the same is used at the center, sealing ability is improved and, accordingly, the compressor can further be raised in efficiency.

Figure 39:
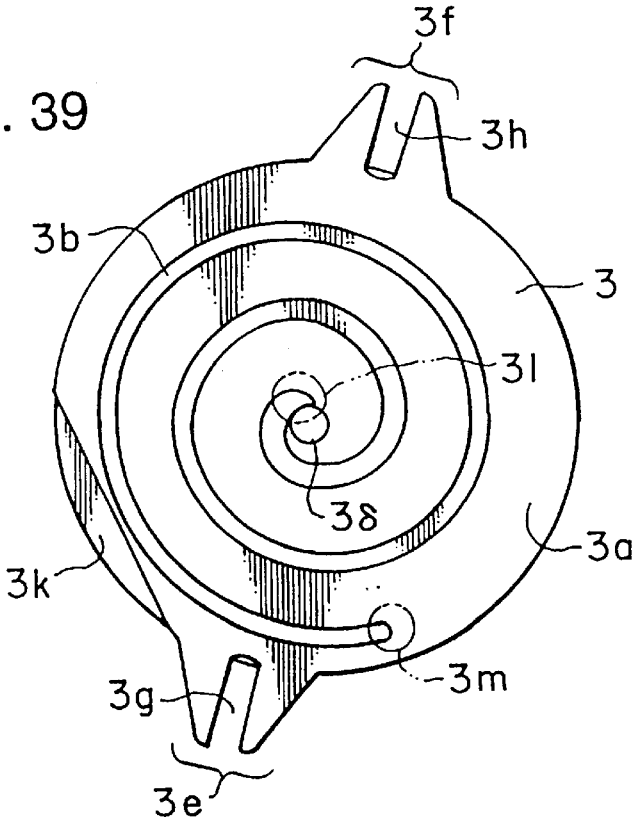
FIG. 39 is a top plan view of the turning scroll member in a tenth embodiment of the invention.
Figure 40:
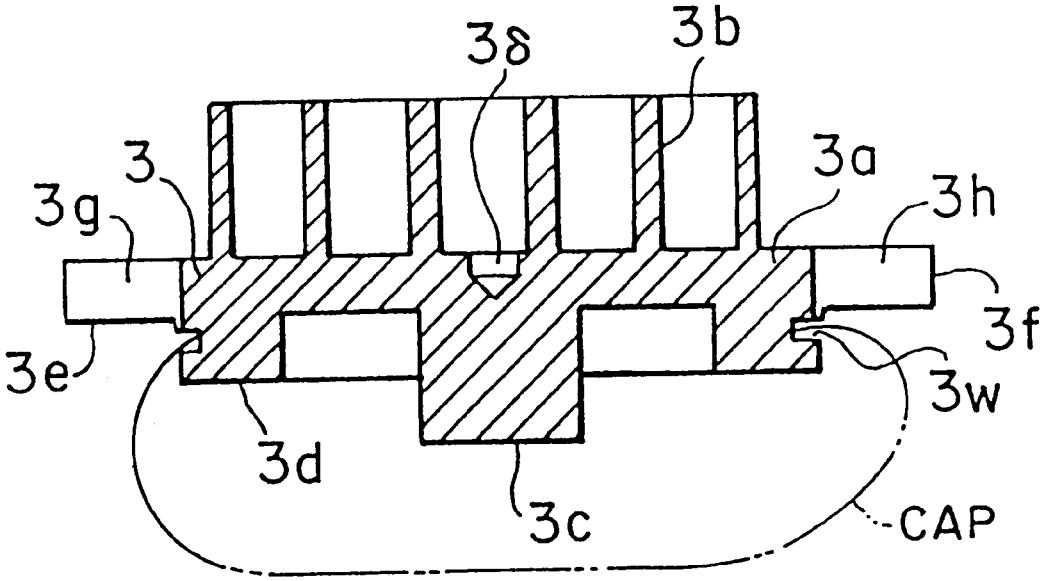
FIG. 40 is a longitudinal cross-sectional view of a turning scroll member in a modification of the embodiment.
Figure 41:
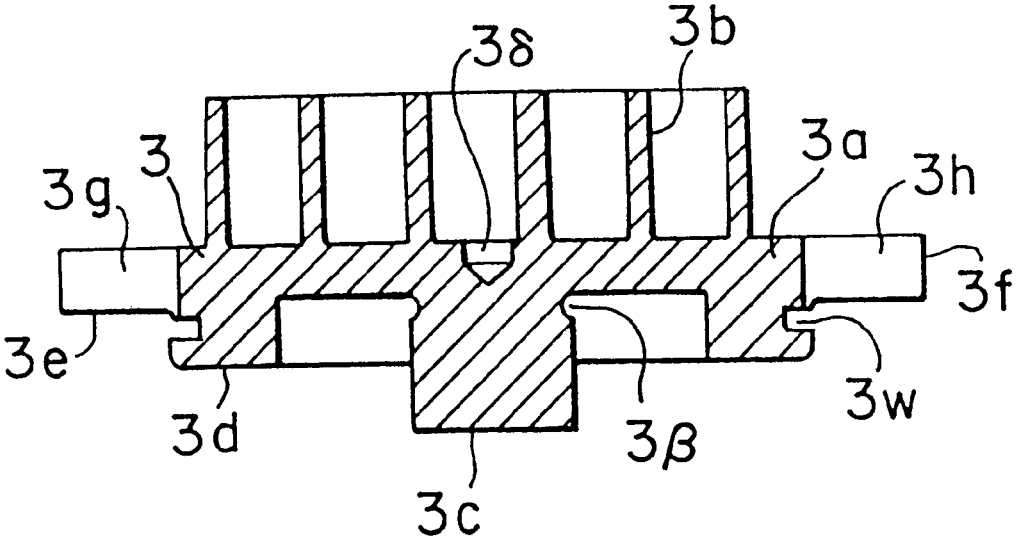
FIG. 41 is a longitudinal cross-sectional view of the turning scroll member in the embodiment.
Figure 42:
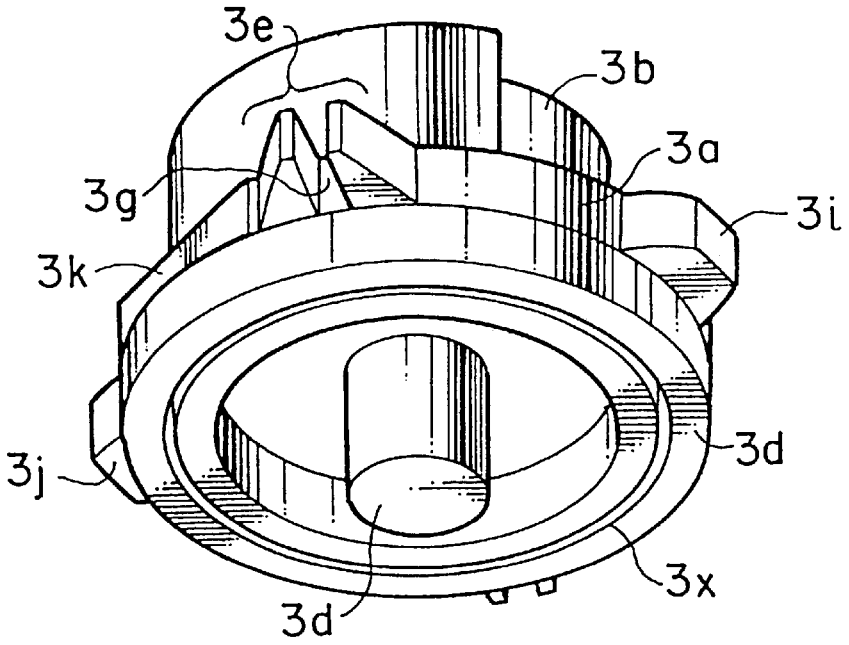
FIG. 42 is a perspective view of the turning scroll member in the embodiment as viewed from the lower.

A tenth embodiment of the invention will be described with reference to FIGS. 39 to 42. FIG. 39 is a top plan view of the turning scroll member 3. FIG. 40 is a longitudinal cross-sectional view of the turning scroll member 3. FIG. 41 is a longitudinal cross-sectional view of the turning scroll member 3. FIG. 42 is a perspective view of the turning scroll member 3 from the lower.

The present embodiment is arranged similarly to the embodiment illustrated in FIG. 37. However, the Oldham's support projections 3*i* and 3*j* are omitted. As a result, there is an advantage that, since the workability of the turning scroll member is improved, the compressor can easily be worked. Moreover, it is also of course that the bottom hole 3δ is excepted.

A modification will be described with reference to FIG. 40. The modification is arranged similarly to the first embodiment. However, an outer peripheral groove 3*w* is provided. A cap shown by the two-dot-and-chain line in FIG. 40 is applied to the outer peripheral groove 3*w* so as to be made possible to practice surface treatment. It is made easy to ensure that coating having concordance is formed on the surface except for the thrust bearing 3*d* and the boss 3*c*. Furthermore, it is possible to use the outer peripheral groove 3*w* also for chucking upon working of the scroll wrap 3*b*. As a result, there is an advantage that the compressor high in efficiency can easily be manufactured.

A further modification will be described with reference to FIG. 41. The modification is arranged similarly to the first embodiment. However, a boss groove 35 is provided. As a result, since the boss groove 38 serves as a relief of a grindstone when a surface of the boss 3*c* is ground, grinding working is made easy. Thus, there is an advantage that the compressor high in efficiency can easily be manufactured.

A modification will be described with reference to FIG. 42. The modification shown in this figure is arranged similarly to the first embodiment. However, a bearing groove 3*x* is provided. Since lubricating oil flows into the bearing groove 3*x*, lubrication at the thrust bearing 3*d* is further made superior. Accordingly, friction loss thereat is reduced. As a result, there is an advantage that the efficiency of the compressor can be improved.

Figure 43:
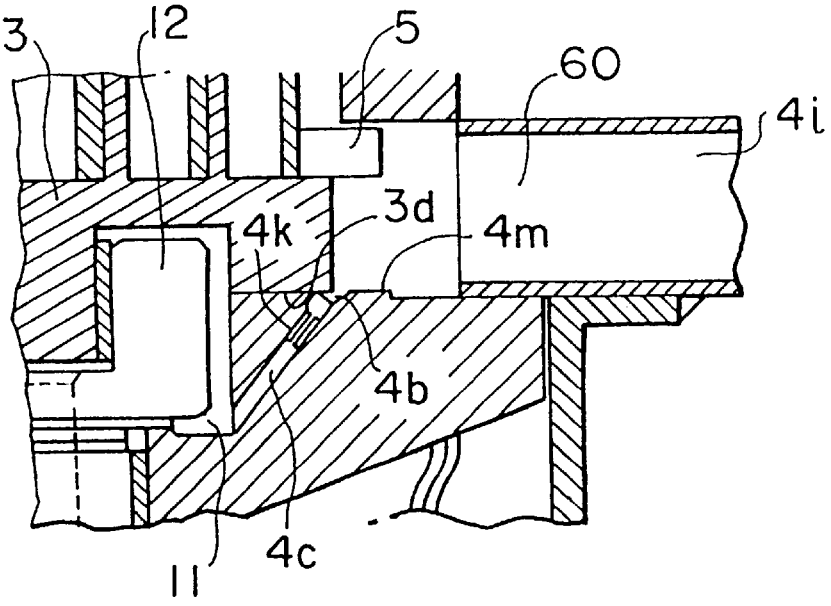
FIG. 43 is a longitudinal cross-sectional view in the vicinity of an oil-supply hole in an eleventh embodiment of the invention.

An eleventh embodiment of the invention will be described with reference to FIG. 43. FIG. 43 is a longitudinal cross-sectional view of the vicinity of the oil-supply hole 4*c*.

The present embodiment is arranged similarly to the first embodiment. However, a restriction 4*k* is provided within the oil-supply hole 4*c*. Since pressure within the back chamber 11 is raised by the restriction 4*k*, load on the thrust bearing 3*d* is reduced. Accordingly, friction loss thereat is reduced. As a result, there is an advantage that the compressor can be raised in efficiency.

Figure 44:
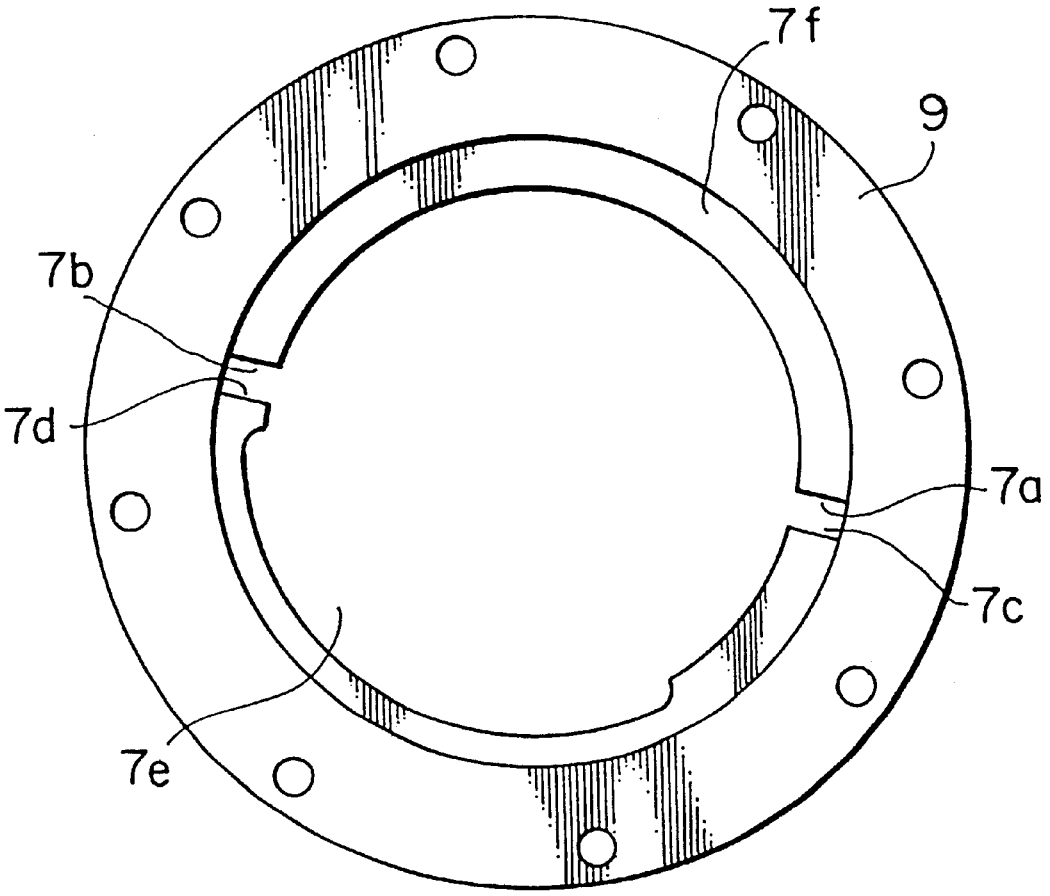
FIG. 44 is a top plan view of a fixed table in a twelfth embodiment of the invention.
Figure 45:
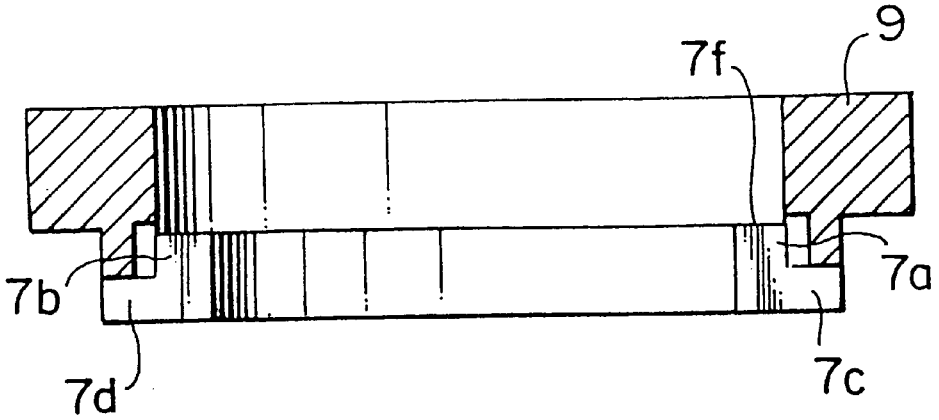
FIG. 45 is a longitudinal cross-sectional view of the fixed table in the embodiment.
Figure 46:
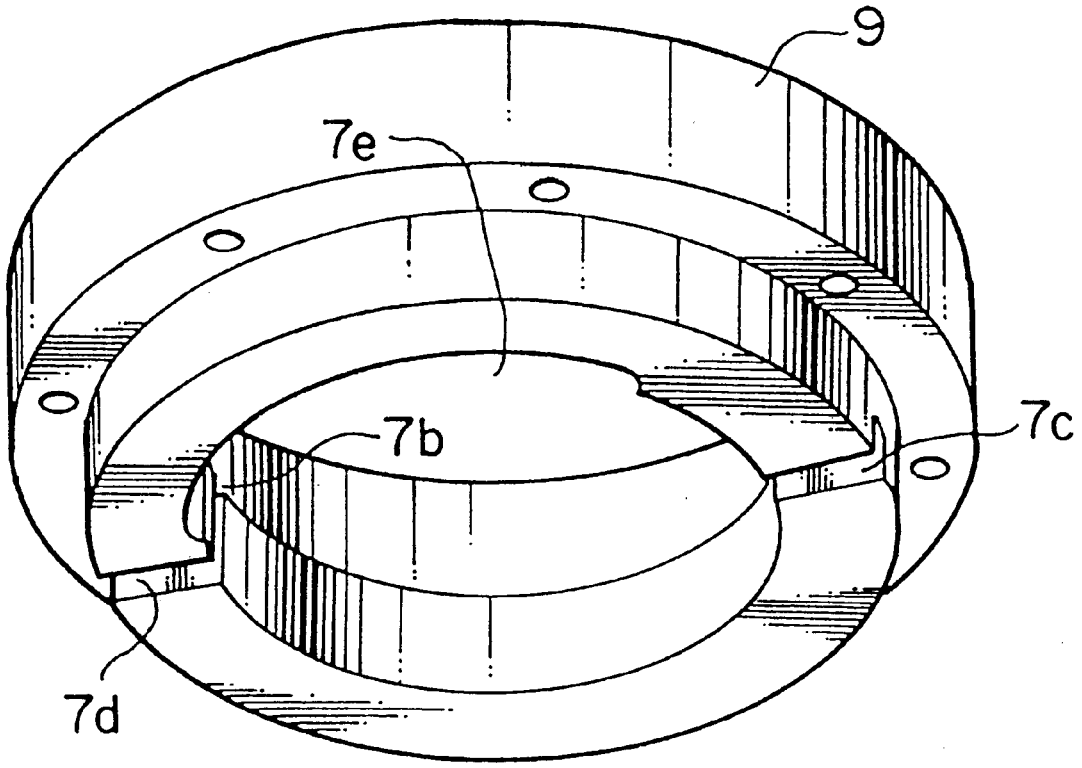
FIG. 46 is a perspective view of the fixed table in the embodiment as viewed from the lower.

A twelfth embodiment of the invention will be described with reference to FIGS. 44 to 46. FIG. 44 is a top plan view of the fixed table 9. FIG. 45 is a longitudinal cross-sectional view. FIG. 46 is a perspective view from the lower.

The present embodiment is arranged similarly to the first embodiment. However, the float stopper 7 and the upper fixed table 8 are united to each other. Thus, there is an advantage that, since assembling of the float stopper 7 and the upper fixed table 8 becomes useless, the assembling ability of the compressor can be improved.

Figure 47:
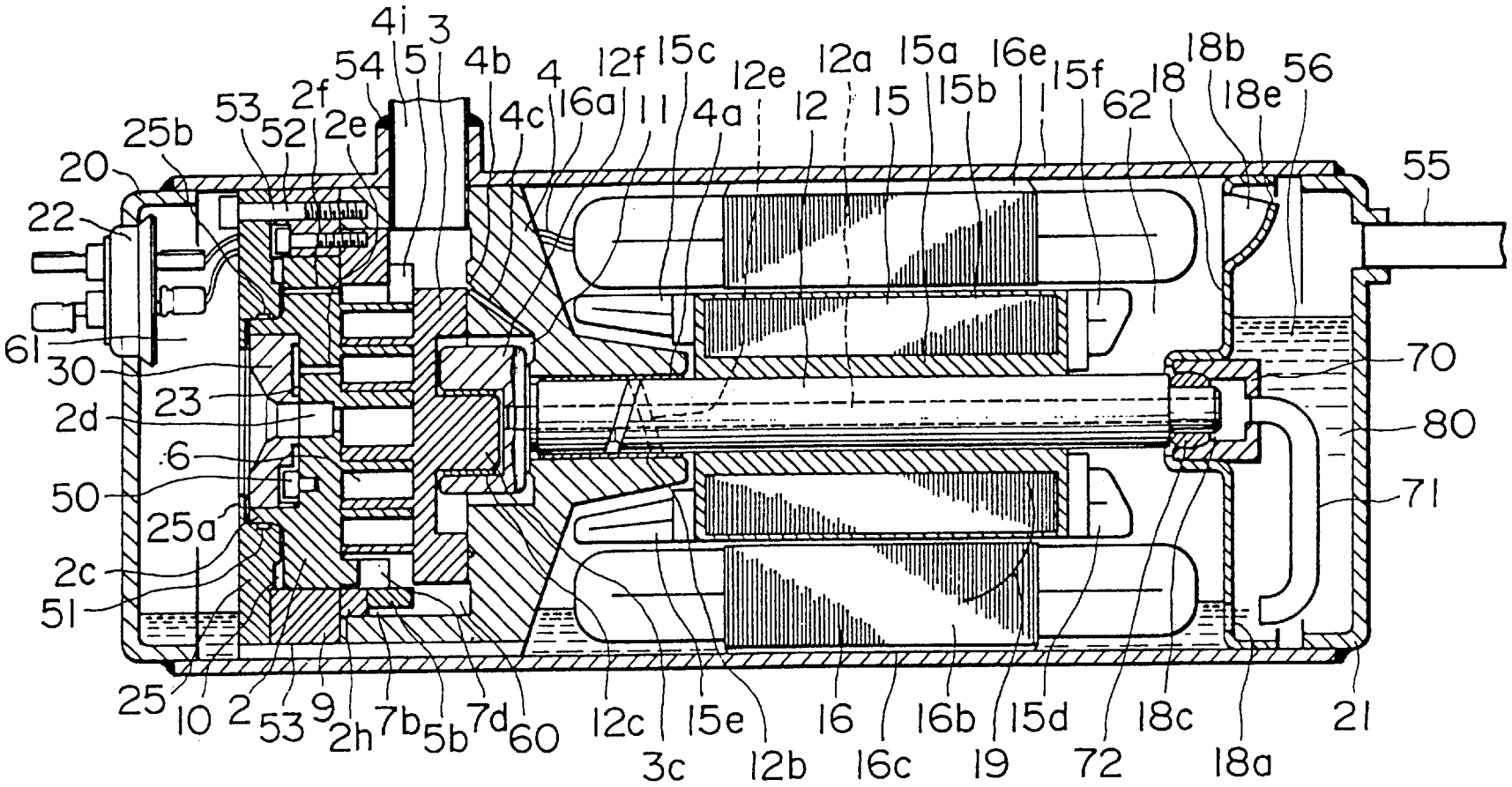
FIG. 47 is a longitudinal cross-sectional view of a thirteenth embodiment of the invention.

A thirteenth embodiment of the invention will be described with reference to FIGS. 47 and 48. FIG. 47 is a longitudinal cross-sectional view, while FIG. 48 is a top plan view of the bearing support.

The present embodiment is an example of the compressor of horizontal type in which an axis is arranged substantially horizontally, and is arranged similarly to the first embodiment except for a mechanism for storing the oil and a mechanism for supplying the oil. The bearing support 18 provided, at an upper part thereof, with an air hole 18*b* and an air cover 18*e*, at a lower part thereof, with an oil guide hole 18*a*, and at a center part thereof, with a bearing hole 18*c* is fixed to the cylindrical casing 1 to form an oil accumulation chamber 80. Further, the discharge pipe 55 is put out from the oil accumulation chamber 80. Furthermore, a bearing housing 70 having fixed thereto a fixed oil-supply tube 71 is fitted in force into the bearing hole 18*c*. Compression gas in the motor chamber 62 passes through the air hole 18*b* while impinging against the air cover 18*e* and flows into the oil accumulation chamber 80. Thus, since pressure in the motor chamber 62 is raised as compared with the pressure in the oil accumulation chamber 80, the lubricating oil 56 in the motor chamber 62 passes through the oil guide hole 18*a* and flows into the oil accumulation chamber 80. The lubricating oil 56 passes through the fixed oil-supply tube 71 to lubricate a subsidiary bearing 72, and to flow into the oil-supply hole 12*a*. As a result, there is an advantage that, since it is made possible to store the lubricating oil 56 within the small compressor without the fact that the oil level within the motor chamber 62 is splashed against the rotor 15 or the shaft 12, the horizontal compressor high in reliability can be realized with a small size.

Figure 49:
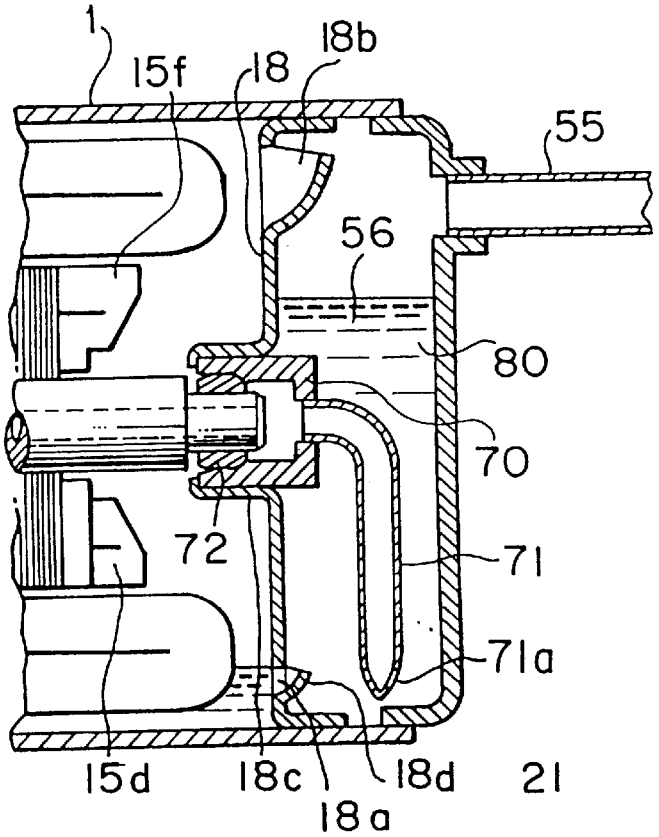
FIG. 49 is a longitudinal cross-sectional view in the vicinity of an oil storage chamber in a fourteenth embodiment of the invention.

A fourteenth embodiment of the invention will be described with reference to FIG. 49. FIG. 49 is a longitudinal cross-sectional view in the vicinity of the oil accumulation chamber.

Figure 48:
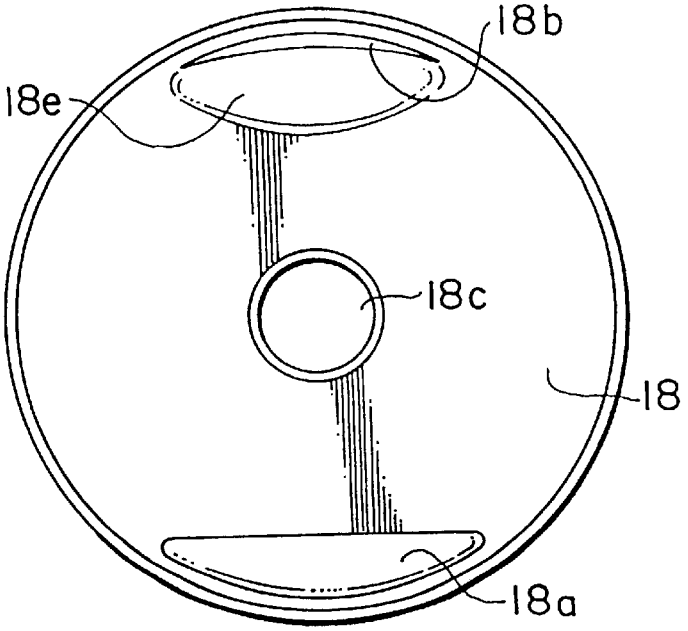
FIG. 48 is a top plan view of a bearing support in the embodiment.

The present embodiment is arranged similarly to the embodiment shown in FIGS. 47 and 48. However, an end of the fixed oil-supply tube 71 is closed. An oil hole 71*a* is provided on the side opposite to the oil guide hole 18*a*. Further, an oil-guide cover 18*d* is provided. Since gas flows in from the oil guide bore 18*a* together with the lubricating oil, the gas flows from a lower part of the lubricating oil 56 in the oil accumulation chamber 80 toward an upper part thereof. For this reason, there is caused a danger that the gas flows into the fixed oil-supply tube 71, and oil supply to the bearing is inhibited. Since the present embodiment is arranged such that the oil hole 71*a* is provided in the side surface opposite to the oil guide bore 18*a* in the fixed oil-supply tube 71, such a danger that the gas flows into the fixed oil-supply tube 71 is reduced. Moreover, since the oil guide cover 18*d* is provided, the gas rises along the bearing support 18. Accordingly, such a danger that the gas flows into the interior of the fixed oil-supply tube 71 is reduced. As a result, there is an advantage that the reliability of the compressor can be improved. Here, the present embodiment is arranged such that both the oil hole 71*a* and the oil guide cover 18*d* are provided. However, even if only one of them is provided, it is possible to improve the reliability.

Figure 52:
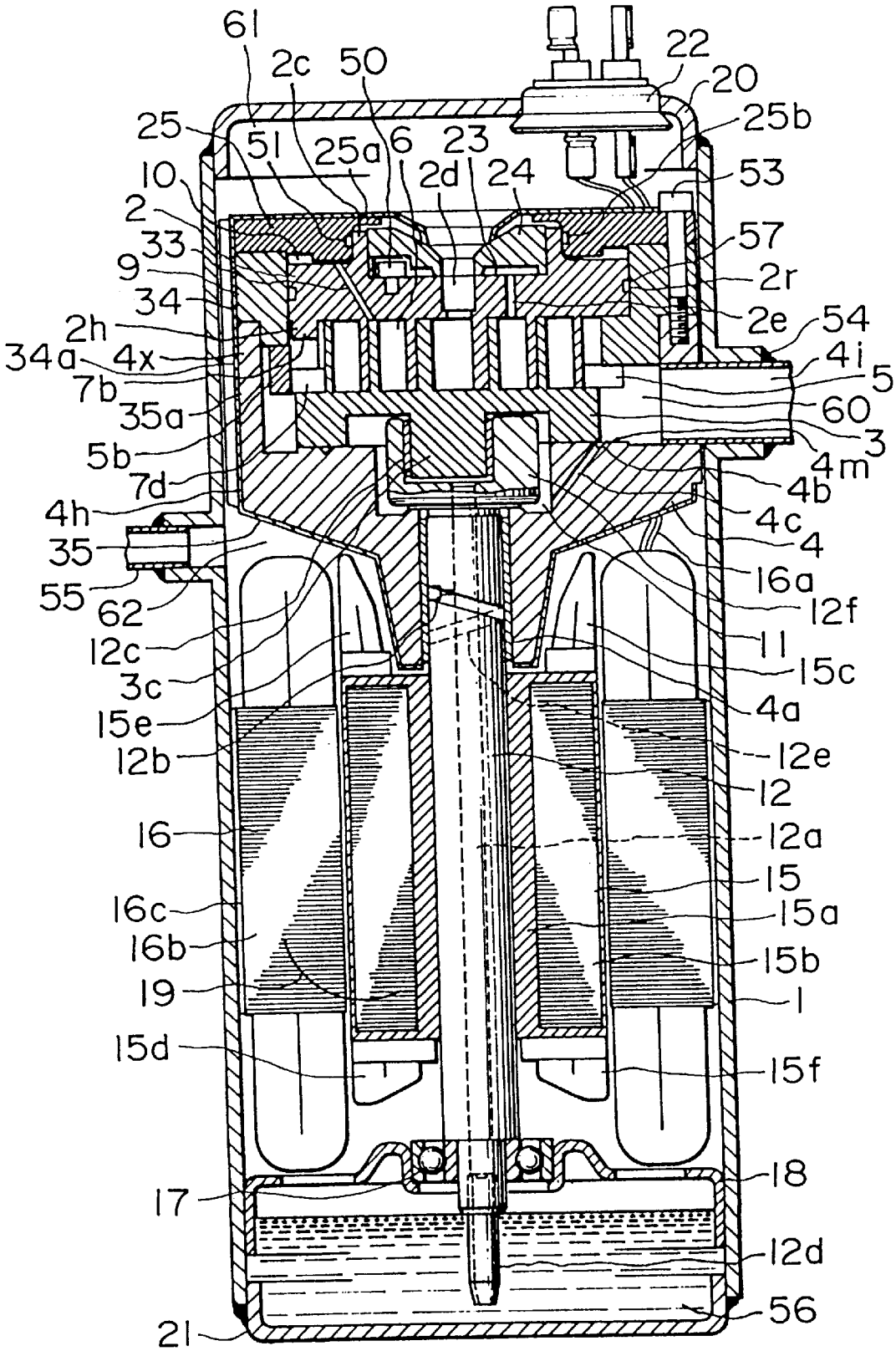
FIG. 52 is a longitudinal cross-sectional view of the scroll fluid machine in the embodiment.
Figure 53:
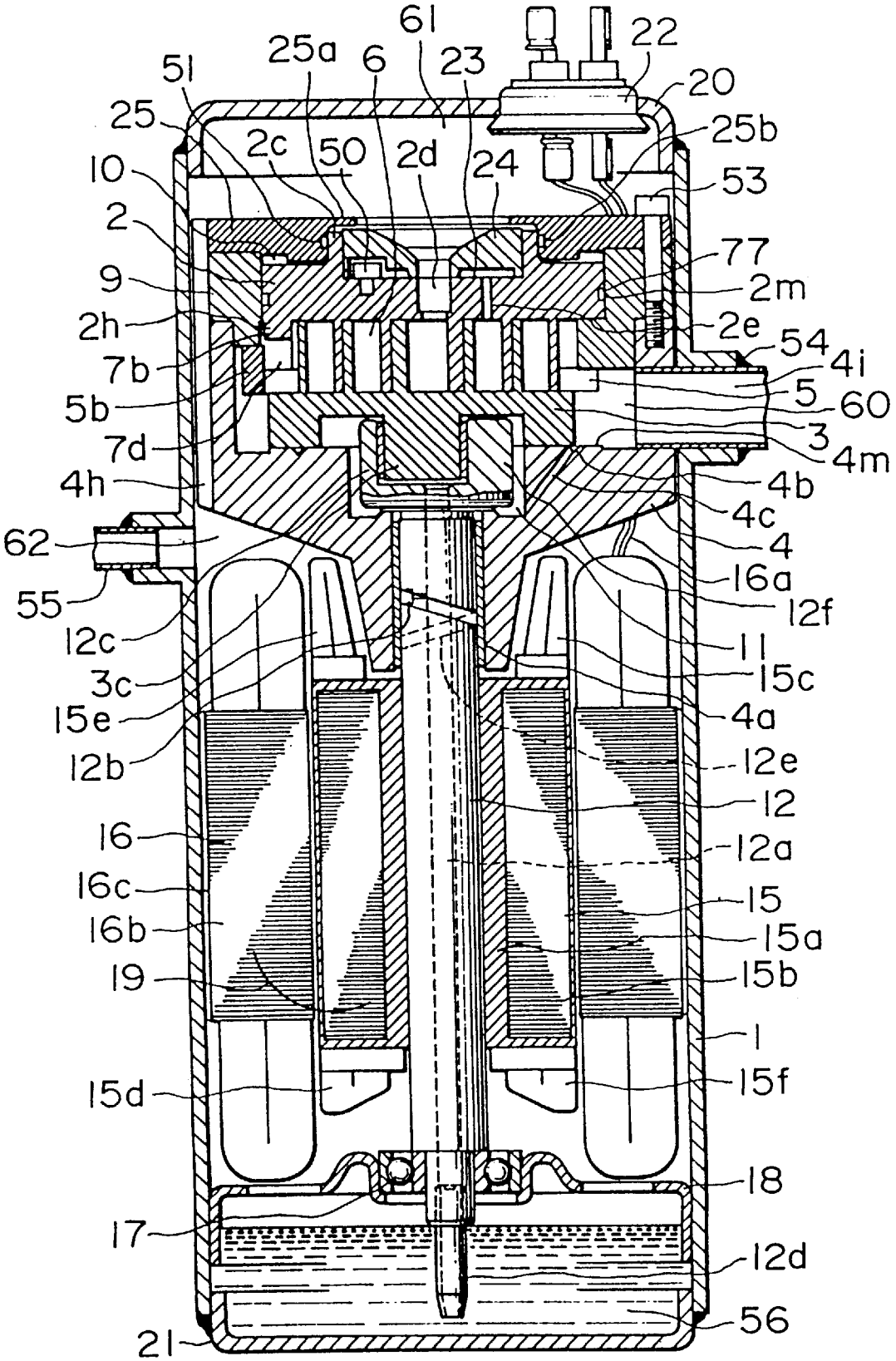
FIG. 53 is a longitudinal cross-sectional view of the scroll fluid machine in the embodiment.
Figure 54:
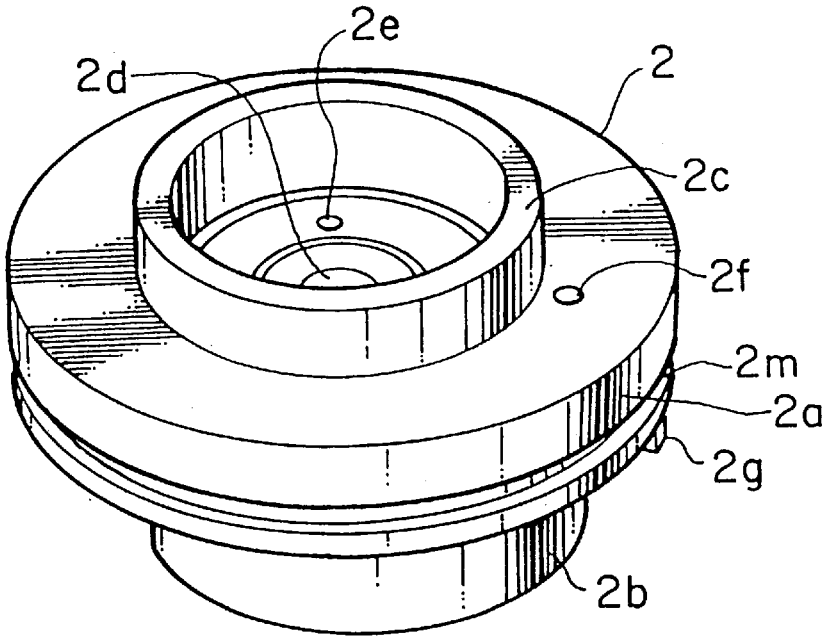
FIG. 54 is a perspective view of a float scroll member in the embodiment as viewed from the upper.
Figure 55:
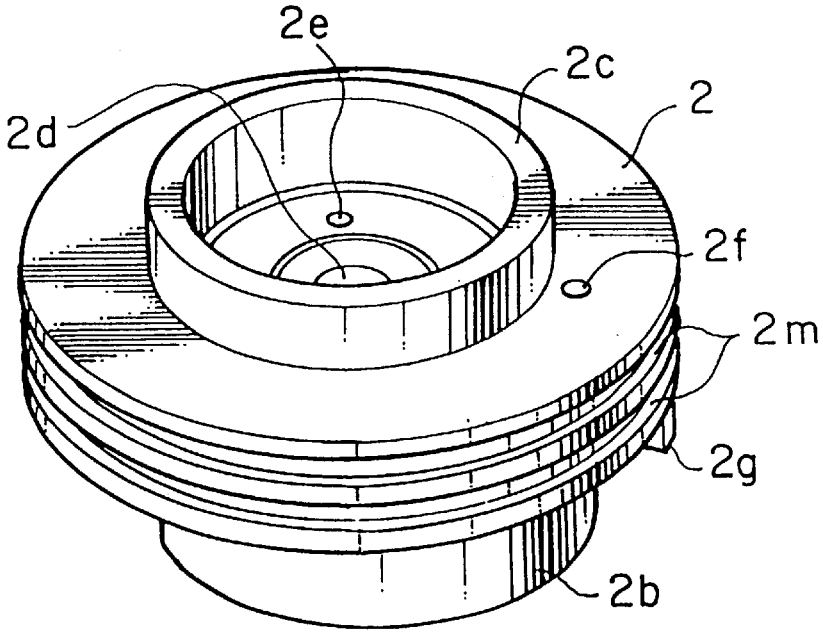
FIG. 55 is a perspective view of the float scroll member in the embodiment as viewed from the upper.

A fifteenth embodiment of the invention will be described with reference to FIGS. 50 to 55. FIGS. 50 to 53 are longitudinal cross-sectional views, respectively, of the compressor, while FIGS. 54 and 55 are perspective views of the float scroll member from the upper.

The present embodiment is arranged similarly to the first embodiment. However, a turning intermediate-pressure hole 32 is provided which communicates the back chamber 11 and the compassion chamber 6 with each other at the time the orbital scroll member 3 has pressure intermediate between the suction pressure and the discharge pressure, and the oil-supply hole 4*c* is excepted. Furthermore, vertical case is shown in FIGS. 50 to 55. However, the present embodiment is applicable to the horizontal case shown in FIGS. 47 to 49. With the arrangement, since the pressure in the back chamber 11 comes to intermediate pressure higher than the suction pressure, and the load of the thrust bearing 3*d* is reduced, it is possible to reduce the friction loss at the thrust bearing 3*d* without the fact that the stability of motion of the orbital scroll member 3 hurts. As a result, there is an advantage that the running range of high efficiency can be widened in area. Further, since the supply of the lubricating oil into the suction chamber 60 is suppressed, heating of the suction gas is suppressed. As a result, there is an advantage that efficiency of the compressor can be improved.

Figure 50:
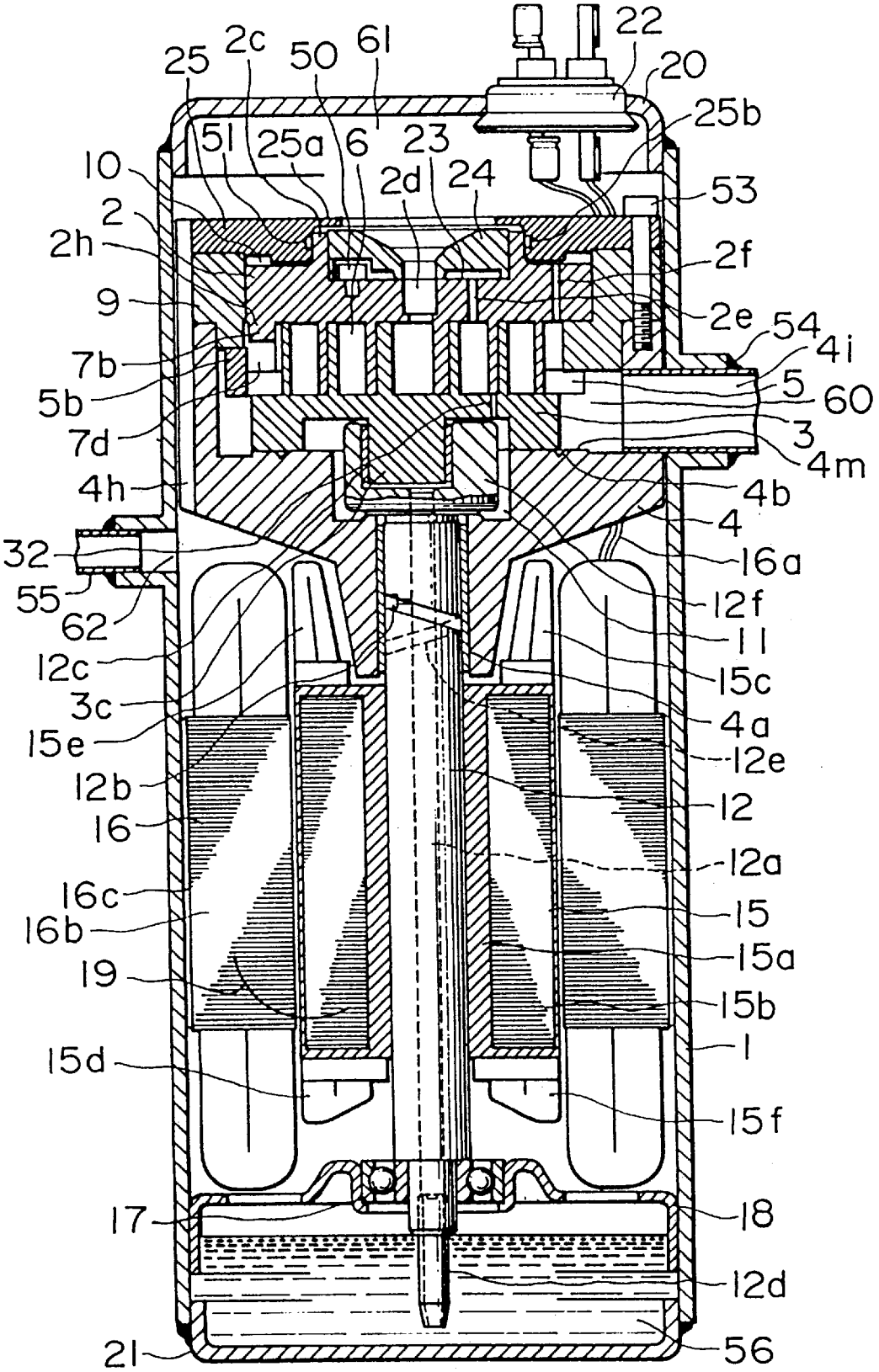
FIG. 50 is a longitudinal cross-sectional view of a scroll fluid machine in a fifteenth embodiment of the invention.
Figure 51:
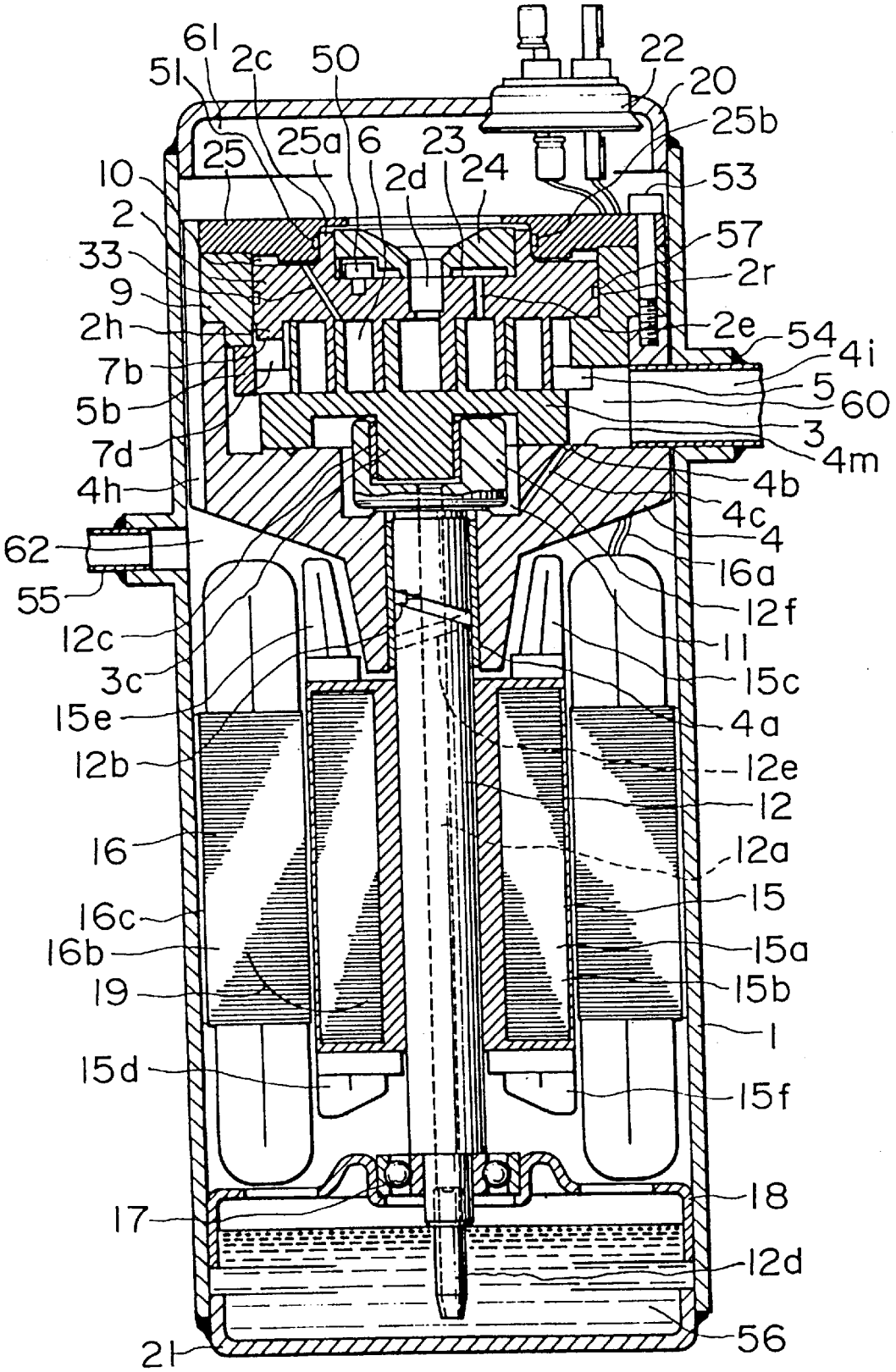
FIG. 51 is a longitudinal cross-sectional view of the scroll fluid machine in the embodiment.

A modification will further be described with reference to FIG. 51. As shown in FIG. 51, the modification is arranged similarly to the embodiment shown in FIG. 50. However, a float intermediate-pressure hole 33 which communicates the compression chamber 6 and the upper chamber 10 with each other at the time when the float scroll member 2 is in the pressure intermediate between the suction pressure and the discharge pressure, a seal groove 2*r* and a seal 57 which forms a gas-tight seal with respect to the float scroll member 2 while the float scroll member 2 is allowed to be slid thereon in an axial direction are provided. With such arrangement, since the pressure in the upper chamber 10 comes into intermediate pressure higher than the suction pressure, a range is widened within which the float scroll member 2 can be so pushed down sufficiently as to be run. As a result, there is an advantage that the running region of high efficiency can be widened in area.

A modification will further be described with reference to FIG. 52. As shown in FIG. 52, the present modification is arranged similarly to the embodiment shown in FIG. 50. However, an upper adiabatic cover 34 and a lower adiabatic cover 35 made of material less in thermal conductivity are covered on the frame 4. Further, the present modification is of structure which maintains the upper chamber 10 to the intermediate pressure. However, the similarity is applied to the structure in which the upper chamber 10 is maintained to the suction pressure as shown in the first embodiment, or to the structure in which the back chamber 11 is maintained to the intermediate pressure as shown in FIG. 50. Moreover, the modification can be applied also to the horizontal type as in the embodiment shown in FIGS. 47 to 51. With the arrangement, there is an advantage that, since heating of the suction chamber 60 can be restrained, the compressor can be raised in efficiency. Furthermore, only one of the upper adiabatic cover 34 and the lower adiabatic cover 35 may be covered. As material of the adiabatic covers 34 and 35, heat-resistant plastics are considered. Here, both the adiabatic covers 34 and 35 are provided with projections 34*a* and 35*a* inside the inserting end, and a groove 4*x* is provided at an outer peripheral position of the frame 4 corresponding thereto. Accordingly, resiliency of both the adiabatic covers 34 and 35 is utilized to press both the adiabatic covers 34 and 35 into the frame 4 until the projections 34*a* and 35*a* reach the groove 4*x*, whereby equipment of both the adiabatic covers 34 and 35 is completed. As a result, there is an advantage that assembling ability of the compressor can be improved.

A modification will further be described with reference to FIG. 53. As shown in FIG. 53, the present modification is arranged similarly to the first embodiment. As shown in FIG. 54, however, an outer peripheral groove 2*m* is provided in the outer periphery of the float scroll member 2, and a resilient ring 77 is equipped thereat. Here, as material of the resilient ring 77, rubber, plastics and metal are considered. Thus, the float scroll member 2 is movable axially and, simultaneously, the float scroll member 2 is made movable horizontally (in a direction orthogonal to the axial direction) only by a gap between the outer periphery of the float scroll member 2 and the inner periphery of the fixed table 9. Accordingly, in case where the side surfaces of the scroll wraps 2*b* and 3*b* are abutted against each other by shape accuracy errors and deformation thereof, a force which is generated thereat can be relieved. Thus, there is an advantage that the reliability of the compressor can be improved.

In connection with the above, as shown as a perspective view from the upper in FIG. 55, the float scroll member is arranged such that two outer peripheral grooves 2*m* are provided, and the resilient rings 77 are equipped thereat respectively. Thus, there is an advantage that, since an attitude of the float scroll member 2 is stabilized, the reliability of the compressor can further by improved. In the present embodiment, case is shown where two outer peripheral grooves 2*m* are provided. However, it may be of course that three or more outer peripheral grooves 2*m* are provided.

Figure 56:
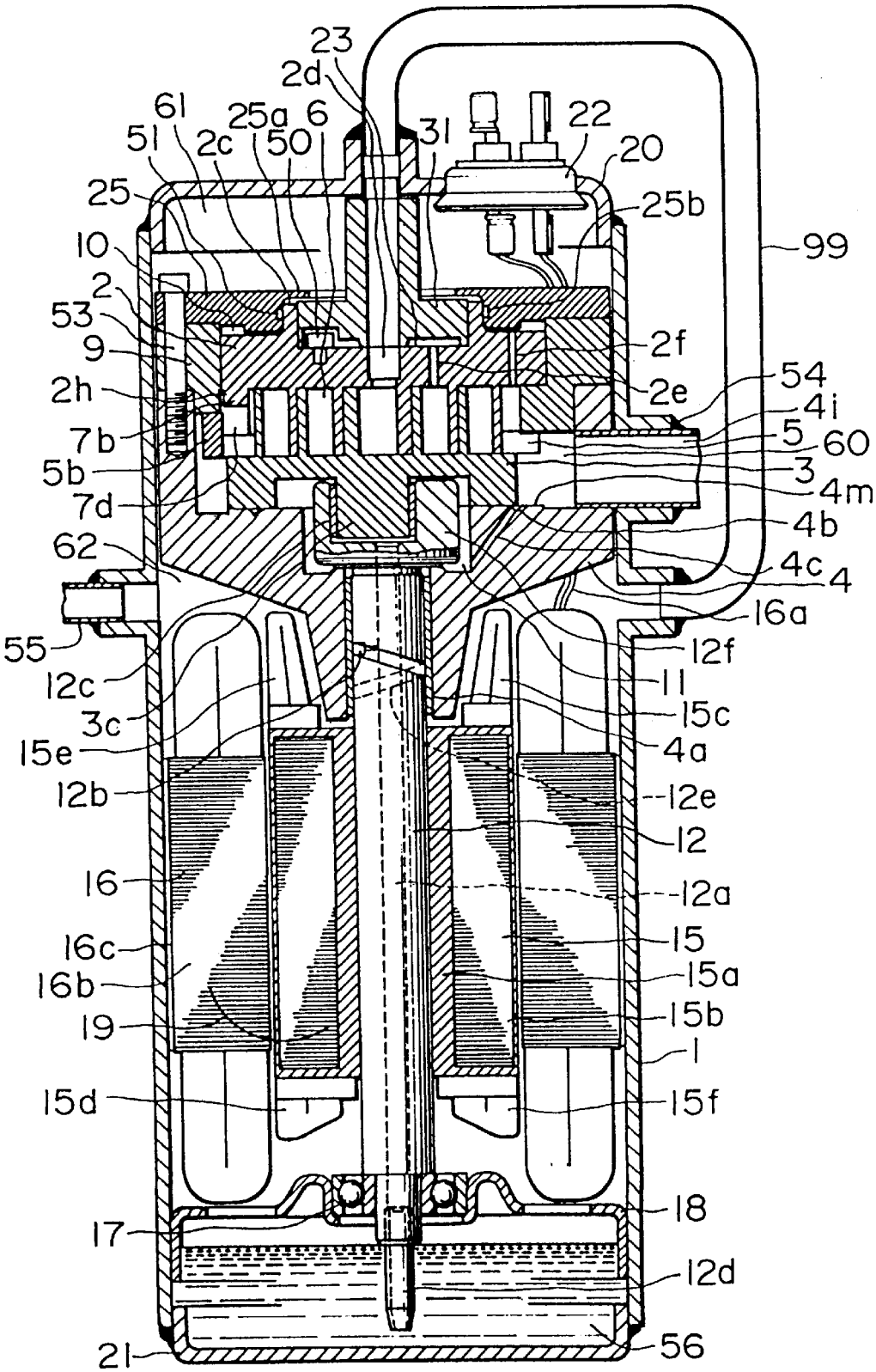
FIG. 56 is a longitudinal cross-sectional view of a sixteenth embodiment of the invention.
Figure 57:
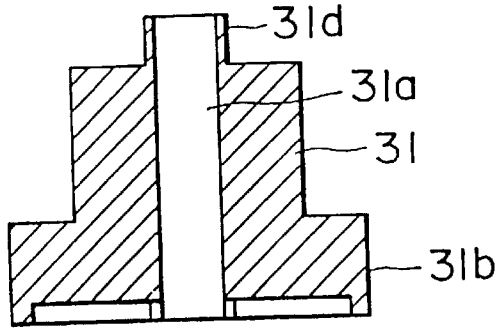
FIG. 57 is a longitudinal cross-sectional view f a connection pipe in the embodiment.

A sixteenth embodiment of the invention will be described with reference to FIGS. 56 to 59. FIG. 56 is a longitudinal cross-sectional view, while FIGS. 57 to 59 are, respectively, longitudinal cross-sectional views of the connection tube.

The present embodiment is arranged similarly to the first embodiment. However, the connection tube 31 having a discharge tube 31*a* is provided in place of the center cover 24, and a direct path 99 is provided which has both ends thereof fixedly mounted respectively on the upper casing 20 and the cylindrical casing 1. Thus, almost all the discharge gas passes through the direct path 31, and enters the motor chamber 62. Accordingly, there is an advantage that heating of the suction chamber 60 due to the compression gas is prevented so that the compressor is raised in efficiency. Further, there is an advantage that, since a forward end 31*d* of the discharge tube 31*a* is only inserted into the upper casing 20, assembling of the discharge tube 31*a* is easy.

Figure 58:
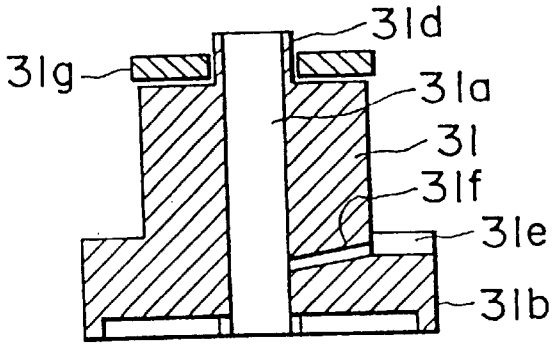
FIG. 58 is a longitudinal cross-sectional view of the connection pipe in the embodiment.
Figure 59:
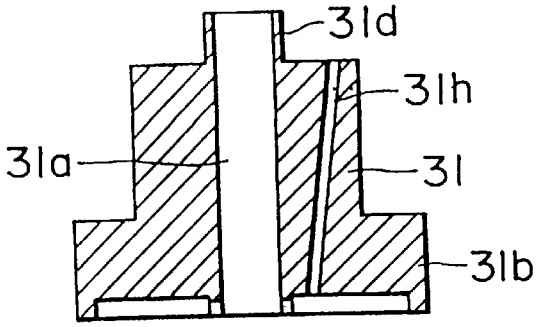
FIG. 59 is a longitudinal cross-sectional view of the connection pipe in the embodiment.

In connection with the above, the connection tube may be arranged as shown in FIGS. 58 and 59. In an example shown in FIG. 58, the connection tube is provided with an oil groove 31*e*, an oil hole 31*f* and a seal 31*g*. Thus, since almost all the discharge gas passes through the direct pass 31, and flows into the motor chamber 62, heating of the suction chamber 60 is further prevented. There is an advantage that the compressor can further be raised in efficiency. Moreover, the lubricating oil collected in the upper chamber 61 passes through the oil groove 31*e* and the oil hole 31*f*, is mixed with the discharge gas and is returned to the lower part of the motor chamber 62. As a result, there is an advantage that, since it is possible to avoid insufficiency of the lubricating oil, the reliability of the compressor can be improved.

Further, the connection tube shown in FIG. 59 is provided with an equalizer hole 31*h*. Thus, since the pressure on the upper surface of the release valve 23 is equalized to the discharge pressure, the release valve 23 upon over-compression is ensured to-operate. As a result, there is an advantage that, since it is ensured that the over-compression is avoided, it is possible to improve efficiency of the compressor upon running thereof at a low pressure ratio.

Figure 60:
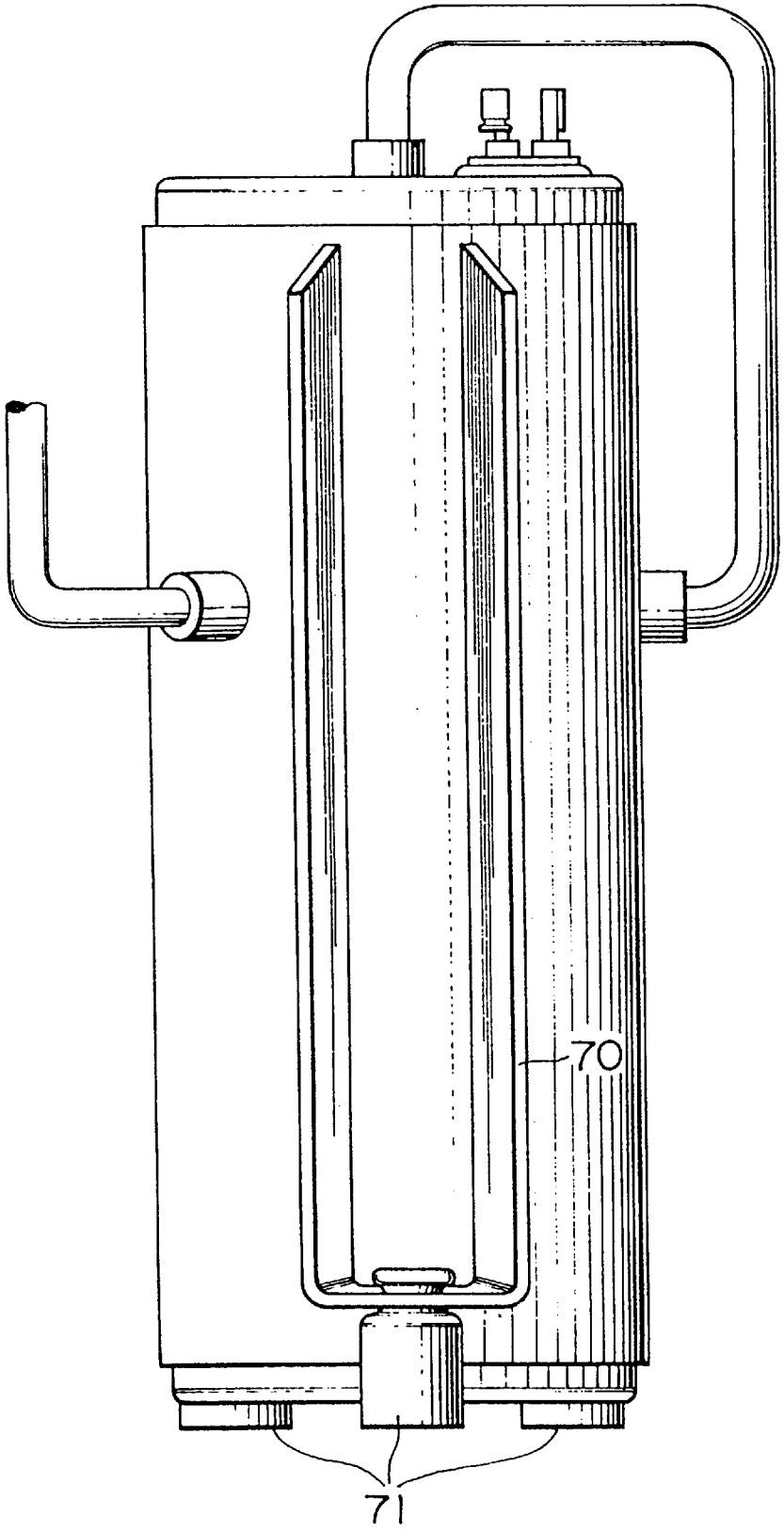
FIG. 60 is a side elevational view of a scroll fluid machine in a seventeenth embodiment of the invention.

A seventeenth embodiment of the invention will be described with reference to FIG. 60. FIG. 60 is a side elevational view of a compressor.

The present embodiment is arranged similarly to the embodiment shown in FIGS. 56 to 59. However, fins 70 are fixed to the outer periphery of the cylindrical casing 1. Thus, there is an advantage that, since the temperature of the compressor is reduced, the compressor can be raised in efficiency. Further, there is an advantage that, since installation tables 71 are fixed to the casing by the use of-lower parts of the fins, it is possible to easily manufacture the compressor.

Figure 61:
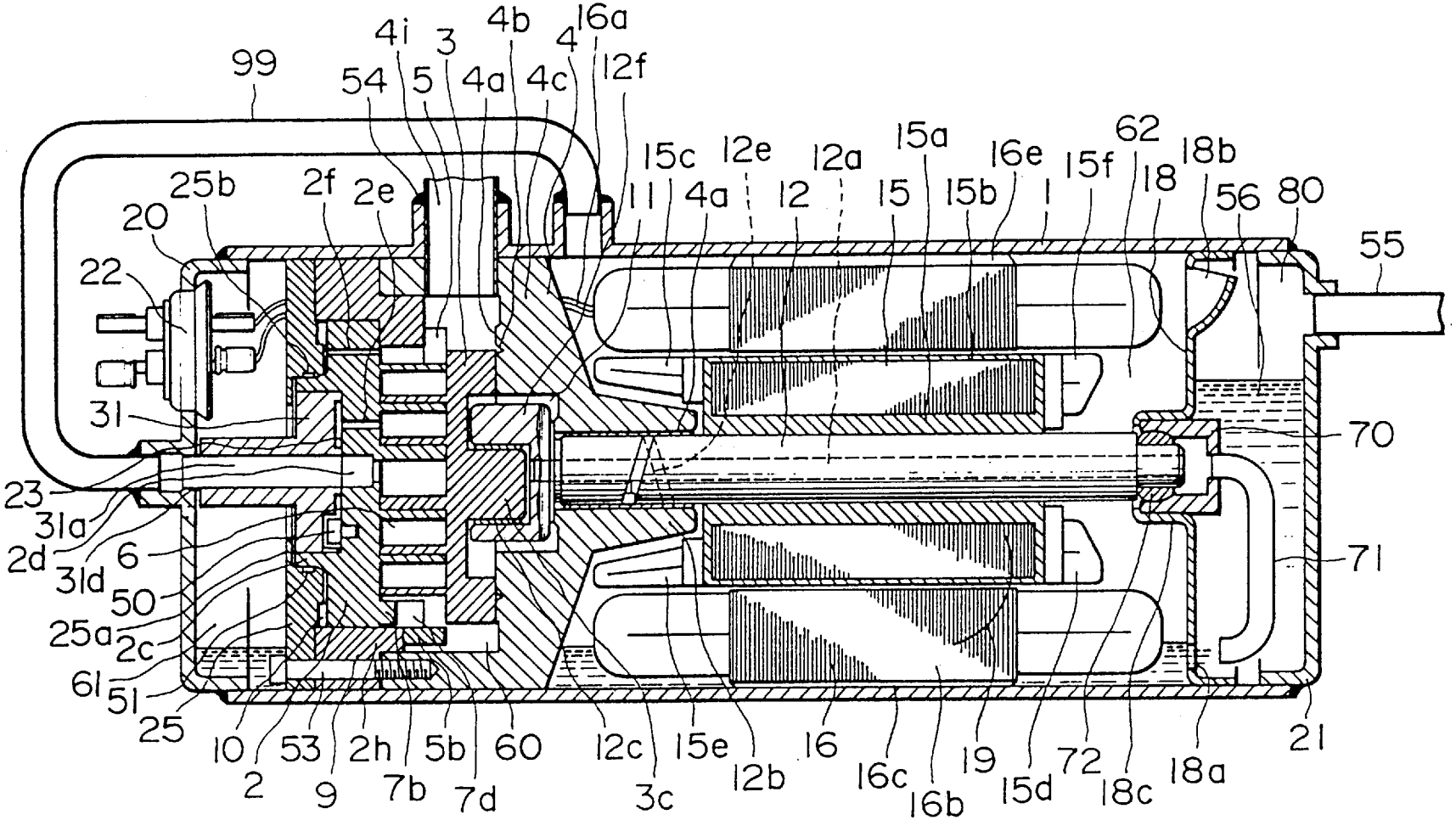
FIG. 61 is a longitudinal cross-sectional view of a scroll fluid machine in an eighteenth embodiment of the invention.
Figure 62:
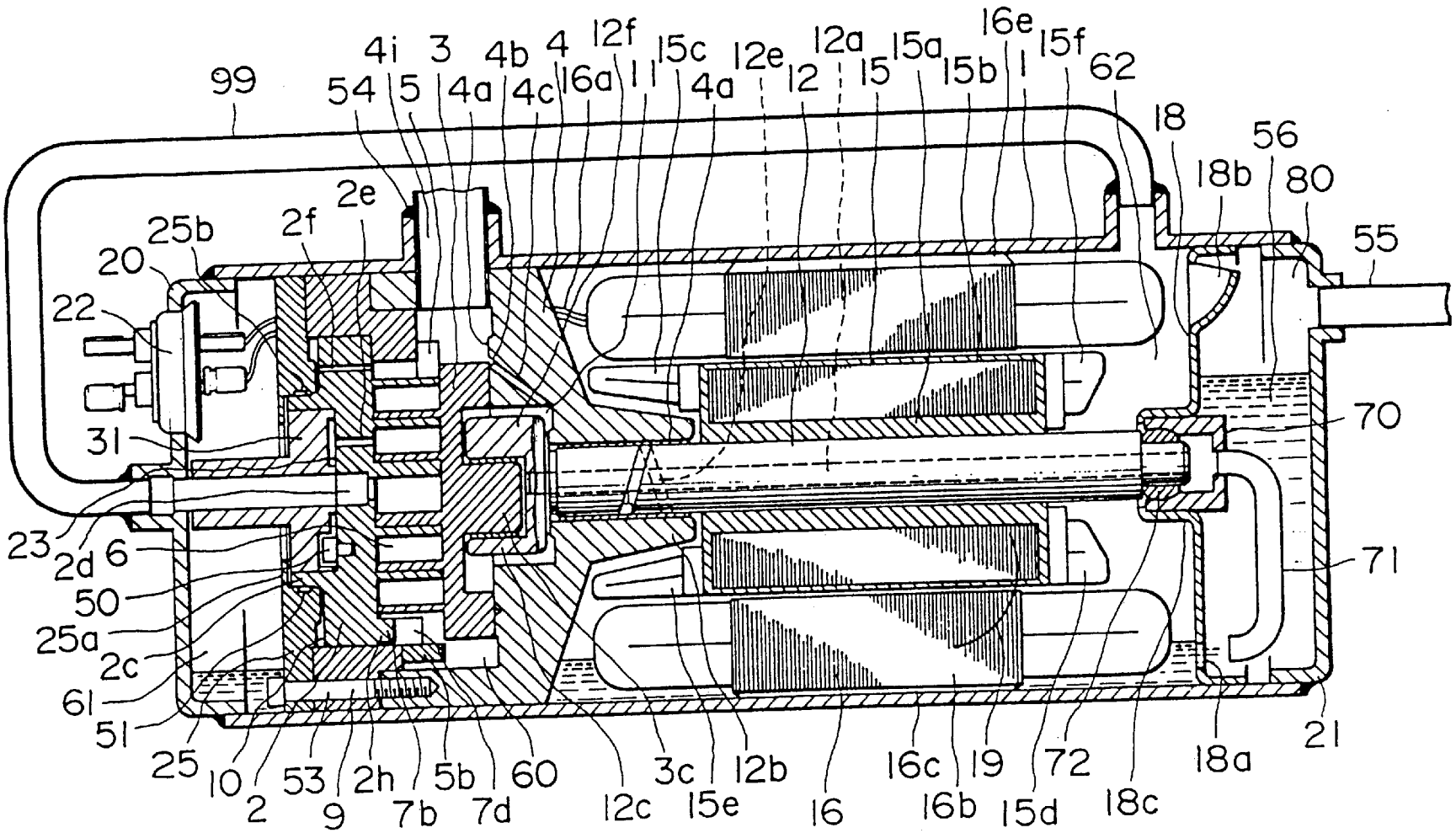
FIG. 62 is a longitudinal cross-sectional view of the scroll fluid machine in the embodiment.

An eighteenth embodiment of the invention will be described with reference to FIGS. 61 and 62. FIGS. 61 and 62 are longitudinal cross-sectional views of a compressor.

The present embodiment is arranged similarly to the embodiment shown in FIGS. 47 and 48. However, the connection tube 31 having the discharge tube 31*a* is provided in place of the center cover 24, and the direct pass 99 is provided whose both ends are fixed respectively to the upper casing 20 and the cylindrical casing 1. Moreover, the fixed oil-supply tube 71 and the bearing support 18 may be arranged as those in a twenty-sixth embodiment. Thus, there is an advantage that, since almost all the discharge gas passes through the direct pass 99, and enters the motor chamber 62, heating of the suction chamber 60 is prevented, and the compressor can be raised in efficiency. Furthermore, there is an advantage that, since the forward end 31*d* of the discharge tube 31*a* is sufficient only to be inserted into the upper casing 20, assembling is easy.

Further, as shown in FIG. 62, a position of the direct pass 99 which is fixed to the cylindrical casing 1 is on the side of the oil accumulation chamber 80 of the motor chamber 62. Moreover, the fixed oil-supply tube 71 and the bearing support 18 may be arranged as those in the twenty-sixth embodiment. Thus, since almost all the discharge gas passes through the direct pass 99, and enters the side of the oil accumulation chamber 80 of the motor chamber 62, heating of the frame 4 is restrained, and heating of the suction chamber 60 is prevented. Accordingly, there is an advantage that the compressor can be raised in efficiency.

Figure 63:
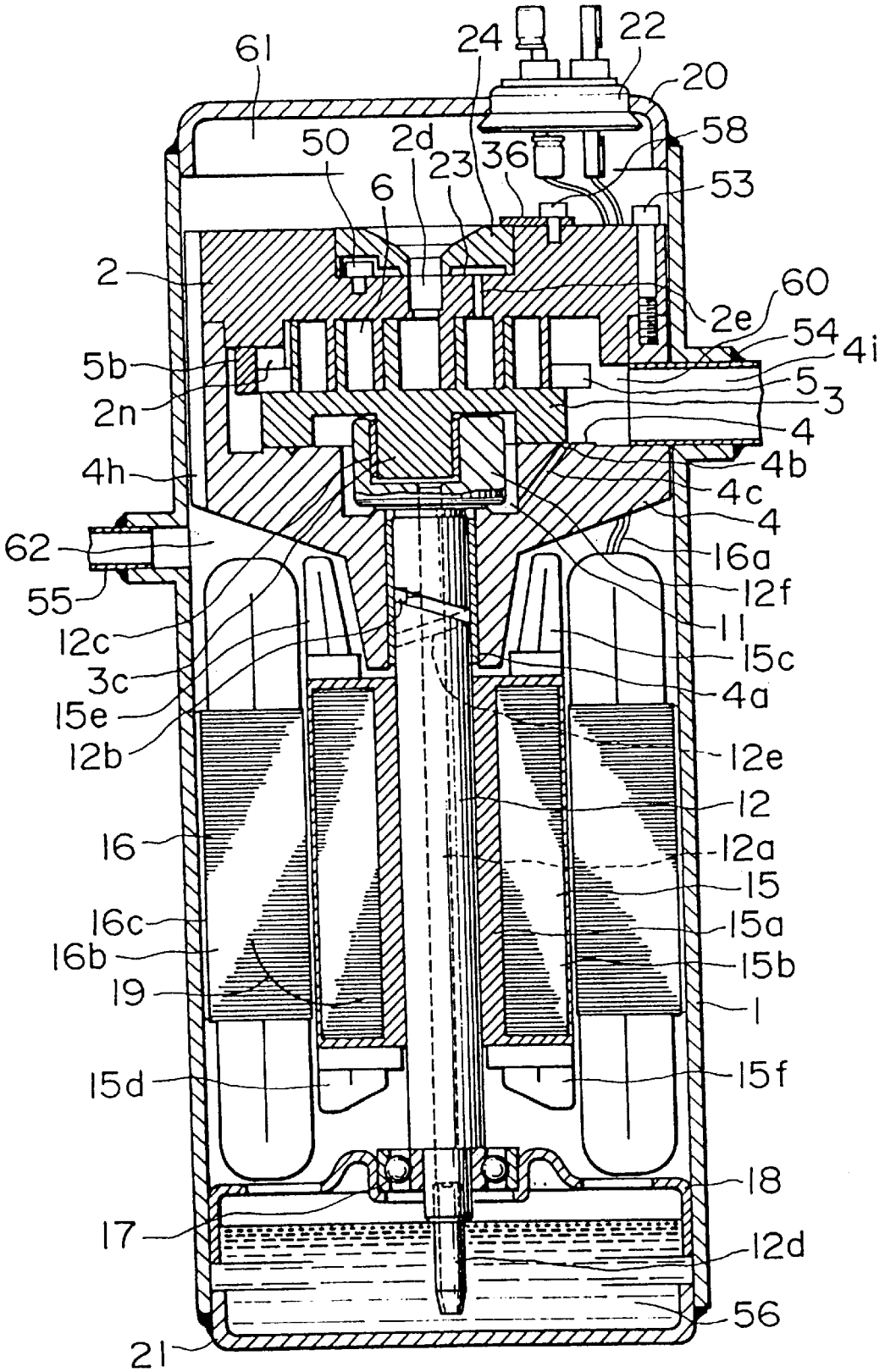
FIG. 63 is a longitudinal cross-sectional view of a scroll fluid machine in a nineteenth embodiment of the invention.
Figure 64:
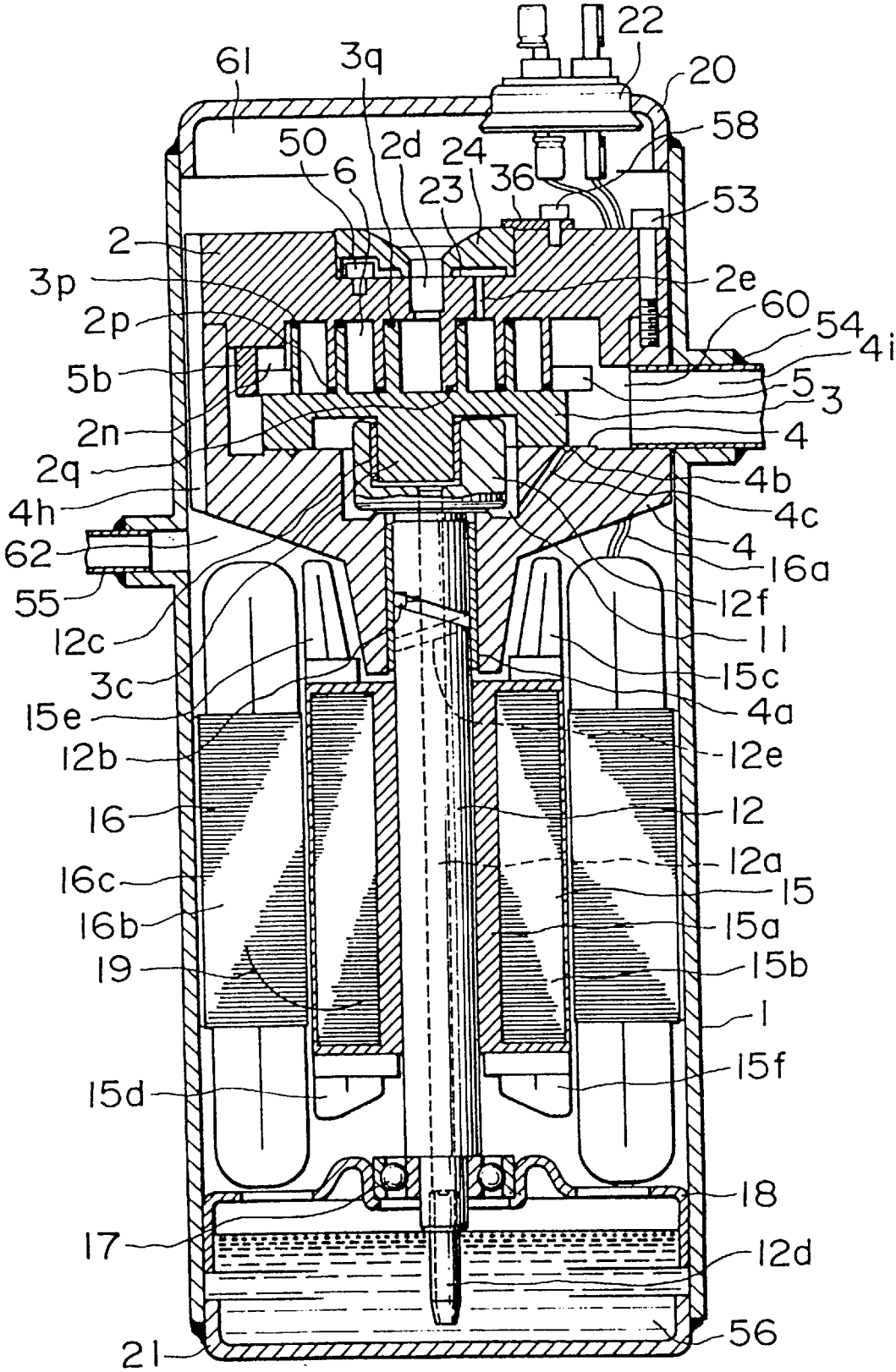
FIG. 64 is a longitudinal cross-sectional view of the scroll fluid machine in the embodiment.
Figure 65:
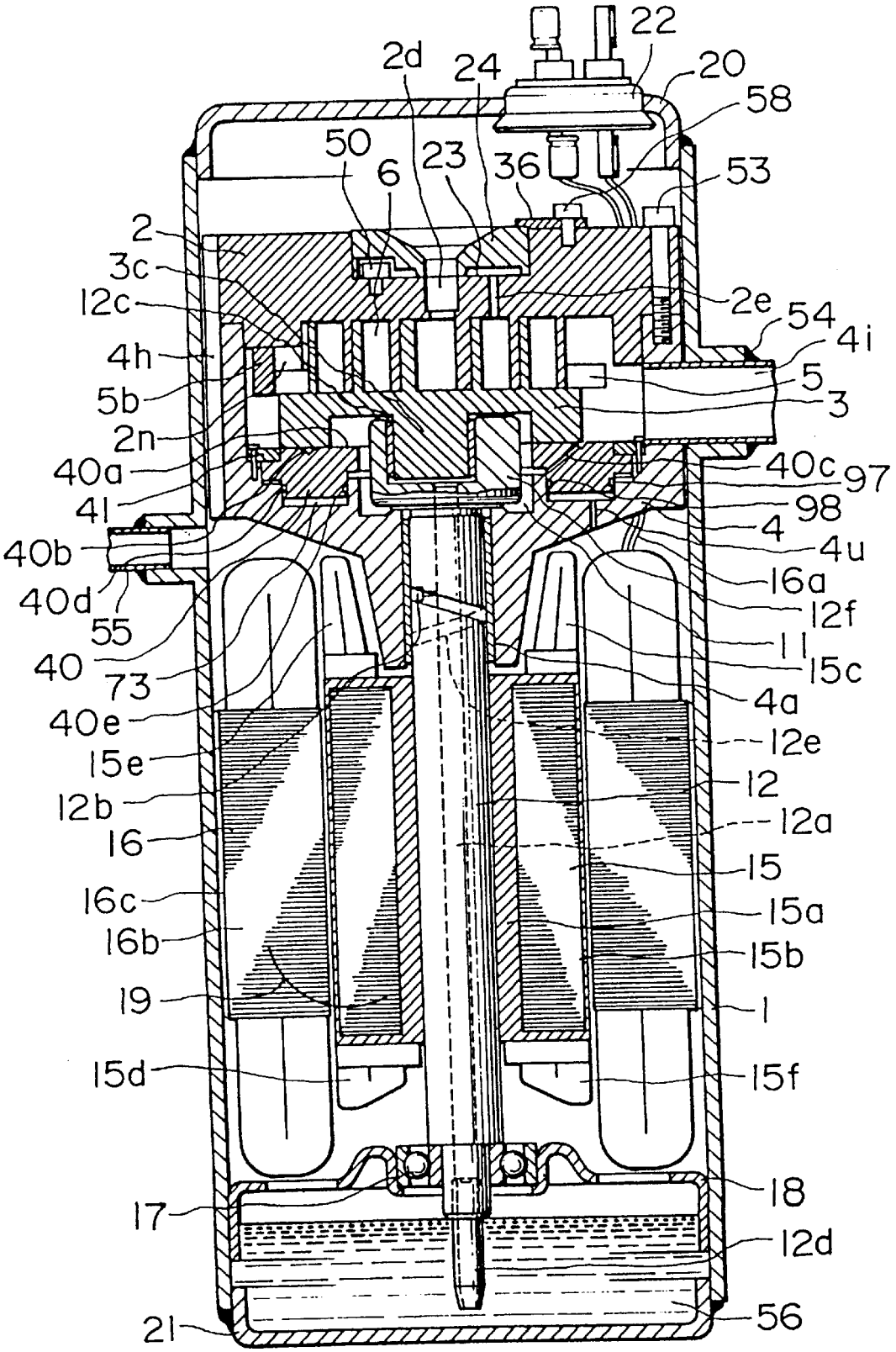
FIG. 65 is a longitudinal cross-sectional view of the scroll fluid machine in the embodiment.

A nineteenth embodiment of the invention will be described with reference to FIGS. 63 to 65. The present embodiment is one which is applied to a turning-type scroll compressor in which one of scroll members is fixed with respect to the casing. FIGS. 63 to 65 are, respectively, longitudinal cross-sectional views of the compressor.

The present embodiment is arranged similarly to the first embodiment. However, the fixed scroll member 2 is provided in place of the float scroll member, and the fixed table is removed. Thus, there is an advantage that, since the structure is simplified, assembling ability of the compressor can be improved. Further, since a fixed Oldham's groove 2*n* that is a sliding part with respect to the Oldham's ring 5 is provided on the fixed scroll member 2, the accuracy of the angular relationship between the orbital scroll member 3 and the fixed scroll member 2 is improved.

Moreover, as shown in FIG. 64, tip seals are provided respectively at the addendum of the fixed scroll member 2 and at the addendum of the orbital scroll member 3. Thus, there is an advantage that, since seal ability of the gap given between the addendum and the bottom, in order to avoid urging between the addendum and the bottom due to deformation of the scroll wrap upon running, is improved, the efficiency of the compressor can be improved.

Furthermore, as shown in FIG. 65, the float support member 40 and a support stopper 41 are provided on the back of the orbital scroll member 3. An upper surface of the float support member 40 comes into a thrust surface 40*a* for biasing the orbital scroll member 3 toward the scroll member 2, and an oil groove 40*b* is provided thereat. An oil-supply hole 40*c* is provided between the oil groove 40*b* and the back chamber 11. Seal grooves 40*d* and 40*e* are provided in a side surface thereof. Seals 97 and 98 are equipped thereto, respectively, which form gas-tight seals with respect to the frame 4, while axial movement of the float support member 40 is permitted. A support back chamber 73 is formed on the back of the float support member 40, and comes to discharge pressure by an equalizer hole 4*u*. Movement of the thrust surface 40*a* toward the scroll member 2 is limited by the support stopper 41. As a result, when the interval between the orbital scroll member 3 and the scroll member 2 comes into a level equal to or less than a predetermined interval, a force biasing the orbital scroll member 3 toward the scroll member 2 is limited or decreased. Further, since, when the addendum and the bottom of the wrap are urged against each other by the deformation of the scroll member upon running, the float support member 40 is moved downwardly, generation of an excessive urging force between the addendum and the bottom of the wrap is avoided. Accordingly, there is an advantage that the reliability of the compressor can be improved. Here, the leaf spring 61 may be arranged within the support back chamber 73 to bias the float support member 40 toward the scroll member 2. As a result, even in case where the discharge pressure is extremely low, and the float support member 40 cannot be pushed up only by the gas pressure in the support back chamber 73, it is made possible to push the float support member 40 up by the resilient force of the leaf spring 61. Accordingly, there is an advantage that the running range of the compressor in the high efficiency can be widened in area. Further, the support stopper 41 may be removed or be taken away. As a result, there are advantages that, since the turning scroll member 3 is always urged against the fixed scroll member 2, and the gap between the addendum and the bottom is always small, it is possible to improve the performance of the compressor. A nitrosulphurizing film, a phosphate manganese film or the like of creep possibility and/or abrasion possibility may be arranged between the support stopper 41 and the float support member 40.

Figure 66:
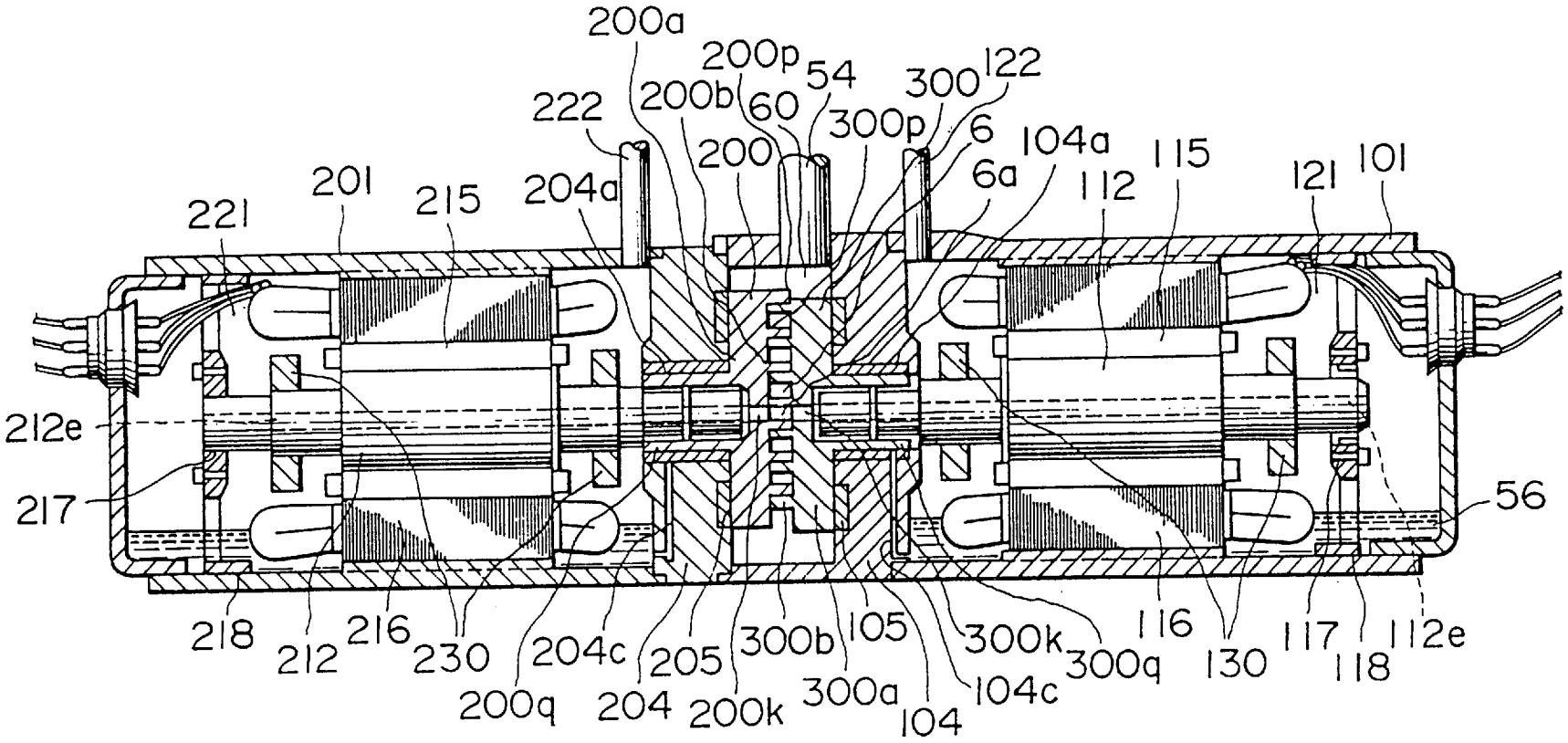
FIG. 66 is a longitudinal cross-sectional view of a scroll fluid machine in a twentieth embodiment of the invention.

A twentieth embodiment of the invention will be described with reference to FIG. 66. An example is shown in which the present embodiment is applied to a rotary-type scroll compressor in which both scroll. members deflect rotational centers thereof each other so as to be rotated in the same direction at the same speed. FIG. 66 is a longitudinal cross-sectional view of the compressor.

The scroll compressor according to the present embodiment is arranged such that forms of scroll wraps 300*b* and 200*b* of respective first and second scroll members 300 and 200 are similar to the forms of the scroll wraps 3*b* and 2*b* in the first embodiment. Arrangement and operation regarding other locations will chiefly be described.

A scroll boss 300*q* is provided on the side opposite to the scroll wrap 300*b* of an end plate 300*a* of the first scroll member 300, and is inserted into a first main bearing 104*a* which is fitted in force into a first frame 104. The first scroll member 300 is connected to a first shaft 112 by a spline shaft coupling inside the scroll boss 300*q*. A first rotor 115 is so arranged as to be fixed to the first shaft 112, and is combined with a first stator 116 which is so arranged as to be fixed to a first closed container 101 to form a motor that is a rotary driving part of the first scroll member 300. The first shaft 112 has an end thereof which is pivoted by a first subsidiary bearing 117. The first subsidiary bearing 117 is so arranged as to be fixed to the first closed container 101 by a first bearing support 118. Further, the first shaft 112 is provided at a center thereof with a through hole 112*e* which communicates with a discharge hole 300*k*. Moreover, two balance rings 130 are fixedly arranged on the first shaft 112. Motion balance or dynamic balance is taken in the connection state between the first scroll member 300 and the first shaft 112. Furthermore, a dynamic-pressure type thrust bearing 105 is provided between the first frame 104 and the end plate 300*a*. Further, the lubricating oil 56 is stored within a first motor chamber 121 and is supplied to the main bearing 104*a* by an oil-supply hole 104*c*. Moreover, a discharge pipe 122 is provided which connects the first motor chamber 121 and the outside to each other.

A scroll boss 200*q* is provided on the side opposite to a scroll wrap 200*a* of the end plate 200*a* of the second scroll member 200, and is inserted into a second main bearing 204*a* which is fitted in force into a second frame 204. The second scroll member 200 is connected to a second shaft 212 by a spline shaft coupling inside the scroll boss 200*q*. A second rotor 215 is so arranged as to be fixed to the second shaft 212, and is combined with a second stator 216 which is so arranged as to be fixed to a second closed container 201, to form a motor that is a rotary driving part of the second scroll member 200. The second shaft 212 has an end thereof which is pivoted by a second subsidiary bearing 217. The second subsidiary bearing 217 is so arranged as to be fixed to the second closed container 201 by a second bearing support 218. Moreover, the second shaft 212 is provided at a center thereof with a through hole 212*e* which communicates with a discharge hole 200*k*. Two balance rings 230 are so arranged as to be fixed to the second shaft 212. Thus, dynamic balance is taken under the connection state between the second scroll member 200 and the second shaft 212. Furthermore, a dynamic-pressure type thrust bearing 205 is provided between the second frame 204 and the end plate 200*a*. The lubricating oil 56 is collected within a second motor chamber 221, and is supplied to the main bearing 204*a* by an oil-supply hole 204*c*. Moreover, a discharge pipe 222 is provided which connects the second motor chamber 221 and the outside to each other.

The first scroll side and the second scroll side which are arranged in this manner are combined with each other so that center axes of the respective scroll members are eccentric from each other. The compression chamber 6 and a discharge space 6*a* to which the discharge holes 200*k* and 300*k* open are defined between the first scroll wrap 300*b* having a tip seal 300*p* and the second scroll wrap 200*b* having a tip seal 200*p*. The suction pipe 54 is provided which connects the suction chamber 60 and the outside of the compressor to each other.

Operation of the scroll fluid machine arranged as described above will subsequently be described. The shafts 112 and 212 are rotated respectively by two motors, and the scroll members 200 and 300 are rotated. As a result, the gas is drawn into the suction chamber 60 through the suction pipe 54, from the outside of the compressor, and enters the compression chamber 6 which is defined by the scroll members 200 and 300. Since the compression chamber 6 moves to the center of rotation while a volume thereof is reduced, the gas is compressed. The gas passes through the through holes 112*e* and 212*e* while cooling the rotors 115 and 215, and flows into the motor chambers 121 and 221. The gas is discharged to the outside of the compressor from the discharge pipes 122 and 222. Although the end plates 200*a* and 300*a* intend to move in such an orientation as to approach the frames 104 and 105 by the pressure of the gas, movement thereof is obstructed by the dynamic-pressure type thrust bearings 105 and 205. Accordingly, the gas is normally or regularly compressed. Since a load applied to the dynamic-pressure type thrust bearings 105 and 205 which are existed on the back of the scroll wrap becomes small or is reduced as compared with that of case where the thickness of the scroll wrap is uniform, a friction loss thereat is reduced. Accordingly, there is an advantage that the efficiency of the compressor can be improved. Furthermore, the lubricating oil 56 flows into the main bearings 300*q* and 200*q* through the oil-supply holes 104*c* and 204*c* by differential pressure, to lubricate a main bearing part. Thereafter, the lubricating oil 56 lubricates the dynamic-pressure type thrust bearings 105 and 205, and flows into the compression chamber 6 from the suction chamber 19. The lubricating oil 56 seals and lubricates a location between the scroll wraps. Thereafter, the lubricating oil 56 is returned to the motor chambers 121 and 221 together with the compression gas, and is collected.

According to the present embodiment, there are advantages that, since both the two scroll members 200 and 300 practice rotary motion, high speed running is made possible, and, although it is small-sized, it is possible to provide the compressor which is high in performance. Further, in the present embodiment, the scroll wraps 200*b* and 300*b* are in mesh with each other in order to rotate, in synchronism, the two scroll members. However, an Oldham's coupling may be provided between the two scroll members. Moreover, the present embodiment is arranged such that the first scroll side and the second scroll side are combined with each other such that the center axes of the respective scroll members are eccentric from each other in the vertical direction. However, the arrangement may be such that the first scroll side and the second scroll side are combined with each other in the horizontal direction, and a pipe may be provided which connects the bottom surfaces of the respective motor chambers 121 and 221 to each other. Thus, since the liquid levels of the lubricating oils 56 within both the motor chambers 121 and 221 can be flush with each other, it is possible to reduce the possibility that the rotors 115 and 215 and the reservoired lubricating oil 56 are in contact with each other, and it is possible to avoid drop of the compression performance upon running. Further, although not referred to the material of the scroll member, case is considered where both the scrolls are made of cast iron. In this case, manufacturing cost can be reduced. Cost is low, and the strength can also be secured. Thus, there is an advantage that it is possible to provide the compressor high in reliability. Moreover, of the cast irons, it is possible also to use material which is formed by an increase of a cooling rate by a metal mold. In this case, there is an advantage that, since cutting ability is improved, it is possible to provide the compressor which is further low in cost. Moreover, it is possible to make the scroll members 200 and 300 to an aluminum alloy. In this case, since the centrifugal force is reduced, falling-down of the scroll wraps 200*b* and 300*b* with respect to the end plates 200*a* and 300*a* is reduced so that it is possible to avoid local contact between the scroll wraps. Furthermore, it is possible to improve the workability and to reduce the weight. Thus, there is an advantage that it is possible to provide the compressor which is high in reliability, which is further low in cost and which is light in weight.

Further, in each of the above-described embodiments, it is considered that both the scroll members are made of an aluminum alloy. Of them, it is also possible to use an aluminum alloy which is low in weight content of silicon and which is capable of being cast. Generally, if both aluminum alloys are urged against each other for a long period of time, agglutination occurs. Accordingly, it is impossible for a structure in which there is no fixed table 9 and the addendum and the bottom of the scroll wrap are urged against each other substantially always, to make both the scroll wraps of the above-described aluminum alloy capable of being cast. However, as described in the present embodiment, since the fixed table 9 is used in order to avoid that the addendum and the bottom of the scroll wrap are urged against each other, it is possible to make both the scroll members of the aluminum alloy capable of being cast. In this manner, by the fact that both the scroll members are made of the aluminum alloy, there is an advantage that the compressor can be reduced in weight. Further, since it is possible to reduce the centrifugal force applied to the turning scroll 3, the distribution of the load on the thrust bearing 3*d* on the back of the turning scroll can be uniformized. As a result, abrasion of the thrust bearing 3*d* is equalized. Further, even after the abrasion has progressed, it is made possible to keep both the end plates 2*a* and 3*a* parallel to each other. Local urging and enlargement of the gap between the scroll wraps 2*b* and 3*b* are avoided. Thus, there is an advantage that it is possible to maintain the performance of the compressor. Furthermore, in case where both the scroll members are made of the aluminum alloy capable of being cast, creation is made easy by the casting, and the material is low in cost. Accordingly, there is an advantage that the manufacturing cost can be reduced.

Figure 67:
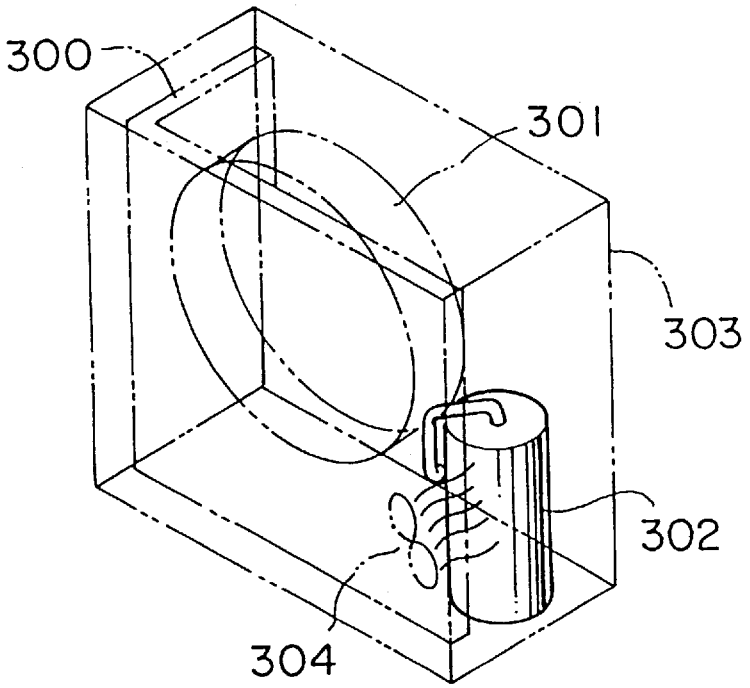
FIG. 67 is a perspective view of an outdoor unit in which a vertical compressor according to a twenty-first embodiment of the invention is arranged in the outdoor unit.
Figure 68:
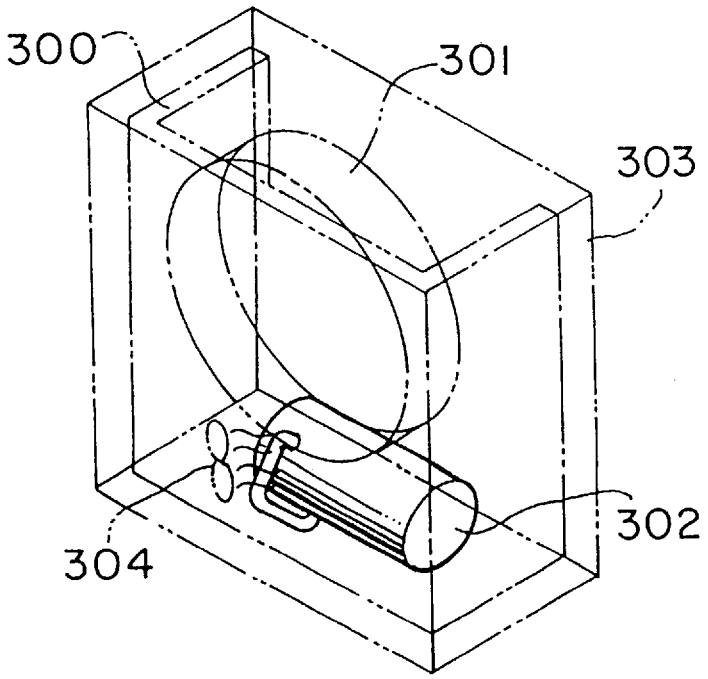
FIG. 68 is a perspective view of an outdoor unit in which a horizontal compressor according to the embodiment of the invention is arranged in the outdoor unit.

A twenty-first embodiment of the invention will be described with reference to FIGS. 67 to 69. The present embodiment is an example of the embodiments described above, in which a vertical compressor is used for an air-conditioner. FIGS. 67 and 68 are perspective views of an outdoor machine. Further, FIG. 69 is a longitudinal cross-sectional view when it is mounted on an outer wall of a house.

The compressor according to the present embodiment is arranged such that the direct pass 99 is provided. However, the compressor may, of course, be one in which this is not provided. A compressor 302, a heat exchanger 300, a fan 301 and a compressor fan 304 are provided within a case 303. Upon cooling running, the compressor fan 304 is always rotated. Upon heating running, just after running start and when temperature of the compressor is low, the compressor fan 304 is not rotated. When the compressor is elevated in temperature, the compressor fan 304 is rotated. Moreover, upon running in which the heat exchanger 300 is defrosted, a rotational direction of the compressor fan 304 is reversed. As a result, immediately after the start of the heating running and except for the defrosting running, the compressor 302 is cooled by the compressor fan 304. Accordingly, there is an advantage that the performance of the compressor 302 is improved. Furthermore, since the compressor fan 304 is not rotated immediately after the start of the heating running, the compressor 302 is elevated in temperature for a short period of time. Accordingly, there is an advantage that time taken from the start of the heating running to the fact that hot air is blasted can be reduced. Further, since the rotational direction of the compressor fan 304 is reversed upon defrosting running, heated air passes through the circumstance of the compressor 302 and is blown against the heat exchanger 300. Thus, there is an advantage that, since defrosting running time can be reduced, heating running time can be prolonged. Here, upon heating running, the rotational direction of the compressor fan 304 may always be reversed except for time immediately after the start of the heating running. As a result, there is an advantage that, since the compressor 302 can be cooled, and the heat exchanger 300 serving as an evaporator can be heated, efficiency of the heating running can be improved. Moreover, fins may be provided on the outer surface of the casing of the compressor. In this case, since cooling of the compressor is facilitated, the compressor fan 304 can be small-sized, and a consumption electric power thereat can be reduced.

Moreover, as shown in FIG. 68, the horizontal compressor can also be used for an air conditioner. The compressor 302 is arranged horizontally. Thus, the embodiment is similar to the embodiment shown in FIG. 67 except that the heat exchanger 300 comes into a revered C-shape and, accordingly, the description of operation and arrangement of the other portions will be omitted. With the arrangement, there is an advantage that, since the heat transmission area of the heat exchanger 300 can be taken large, it is possible to reduce the outdoor machine.

Figure 69:
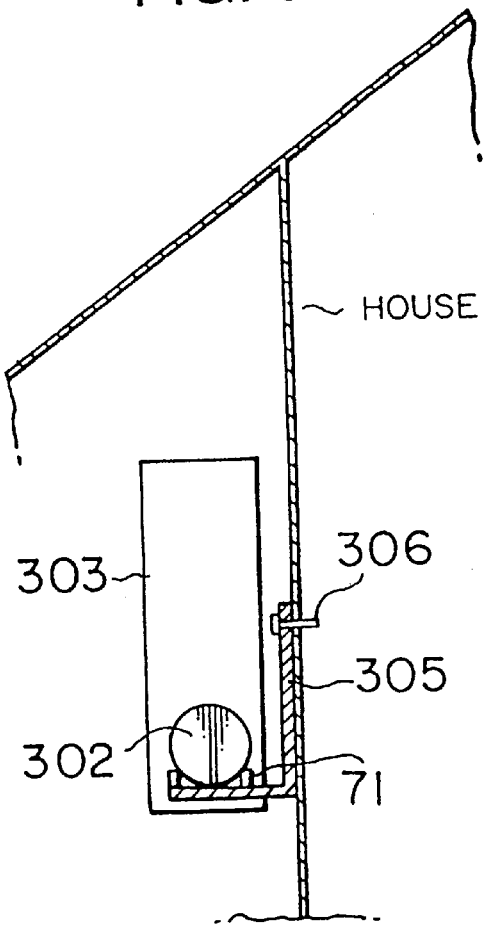
FIG. 69 is a longitudinal cross-sectional view of the outdoor unit in which the horizontal compressor according to the embodiment is loaded is mounted on a wall of a house.

Furthermore, FIG. 69 shows an example in which the horizontal compressor which is small in size and which is light in weight is used to an outdoor machine of wall-mounted type. The compressor 302 according to the example is a horizontal type. Of course, however, it may be a compressor if it is a vertical type. The interior of the outdoor machine is similar to that of the embodiment illustrated in FIG. 68. However, the compressor 302 is mounted on a swing frame 305 through the installation frame 71, and the swing frame 305 is hooked to a swing bolt 306, whereby the outdoor machine is installed. For this reason, there is an advantage that installation operation of the outdoor machine can be facilitated. Further, there is an advantage that, since it is made possible to install the outdoor machine without the use of a space under the eaves, the space under the eaves can effectively be used. Moreover, there is also an advantage that, in case of an outdoor machine which is loaded on a horizontal compressor, since the weight is substantially equally applied, it is possible to reduce the required strength of the swing bolt 306.

Figure 70:
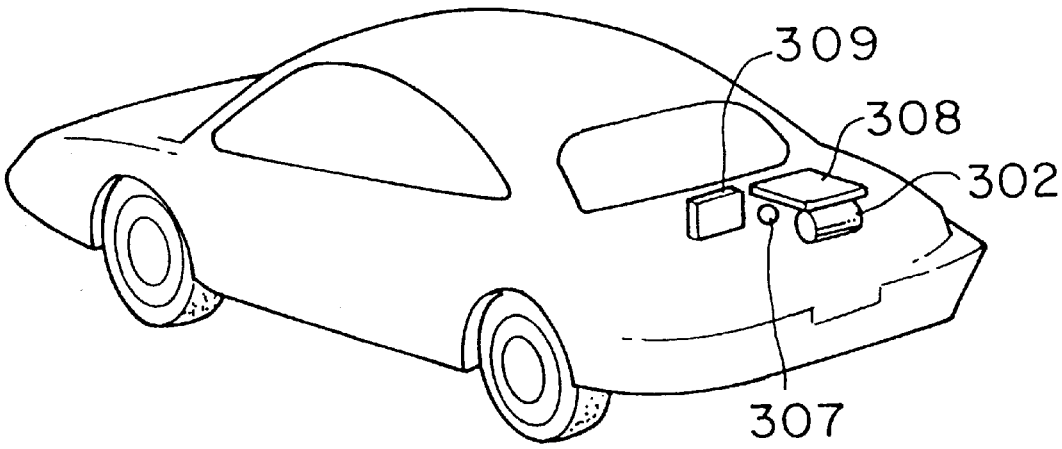
FIG. 70 is a perspective view in which a car air-conditioning system which loads a horizontal compressor according to a twenty-second embodiment of the invention is arranged in an electric vehicle.

A twenty-second embodiment of the invention will be described with reference to FIG. 70. The present embodiment is an example in which a horizontal compressor which is small in size and which is light in weight is used to an electric vehicle. FIGS. 70 is a perspective view of the vehicle. Here, the compressor 302 according to the present embodiment is of a horizontal type. However, it may be of course that the compressor is of a vertical type. An outdoor heat exchanger 308, an indoor heat exchanger 309 and a four-way valve 307 are arranged together at the rear of the vehicle. Since power of a compressor of a prior-art car air-conditioning system is given through a driving belt from an engine, a position where the compressor is installed is limited. Since, however, the compressor according to the present embodiment builds therein the motor, it is possible to install the compressor in the vicinity of a position where other components of the air-conditioning system are arranged. As a result, there is an advantage that, since it is possible to collect all the air-conditioning system to a single location, the degree of freedom of the lay-out within the vehicle increases.

Figure 71:
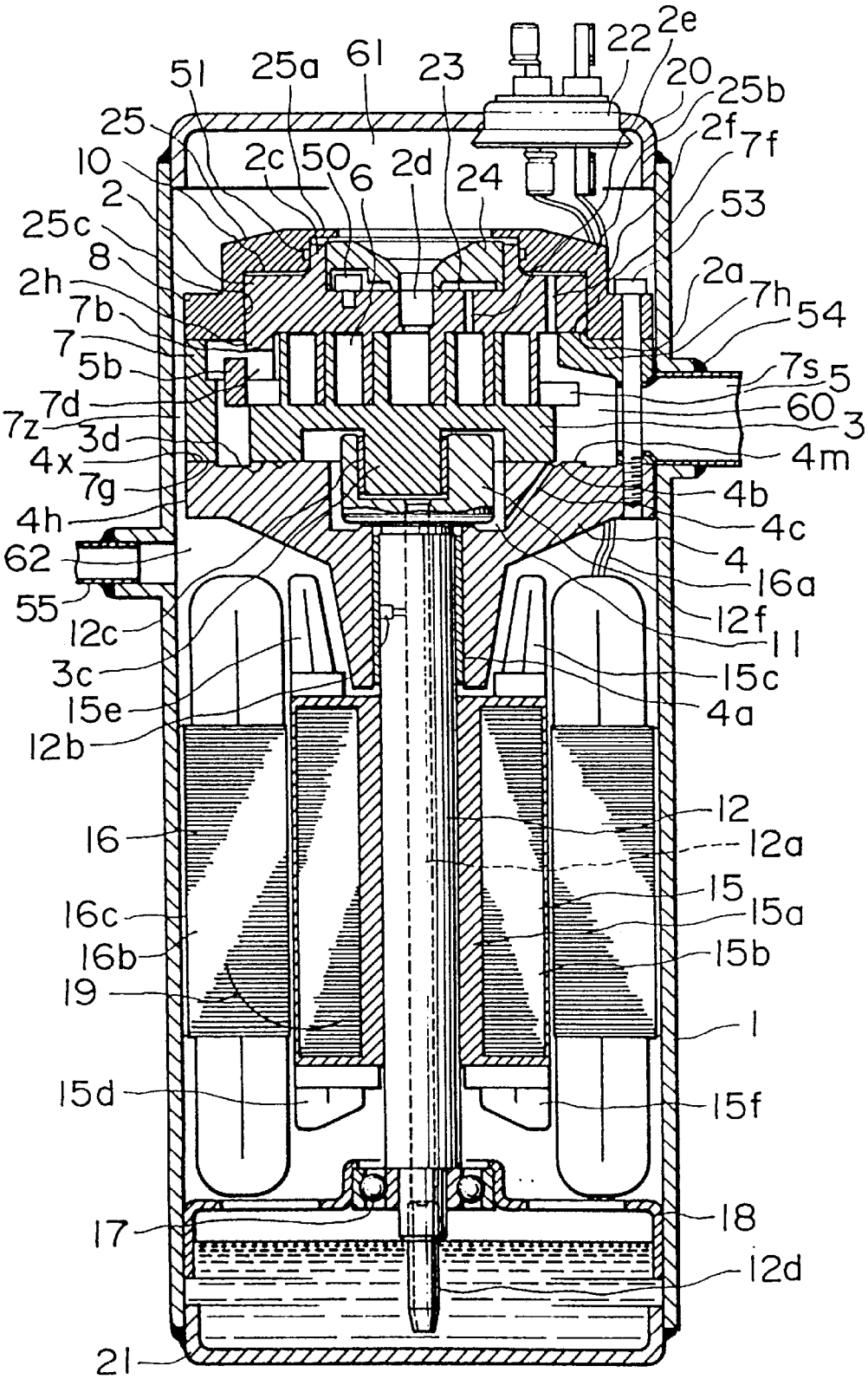
FIG. 71 is a longitudinal cross-sectional view of a twenty-third embodiment.
Figure 72:
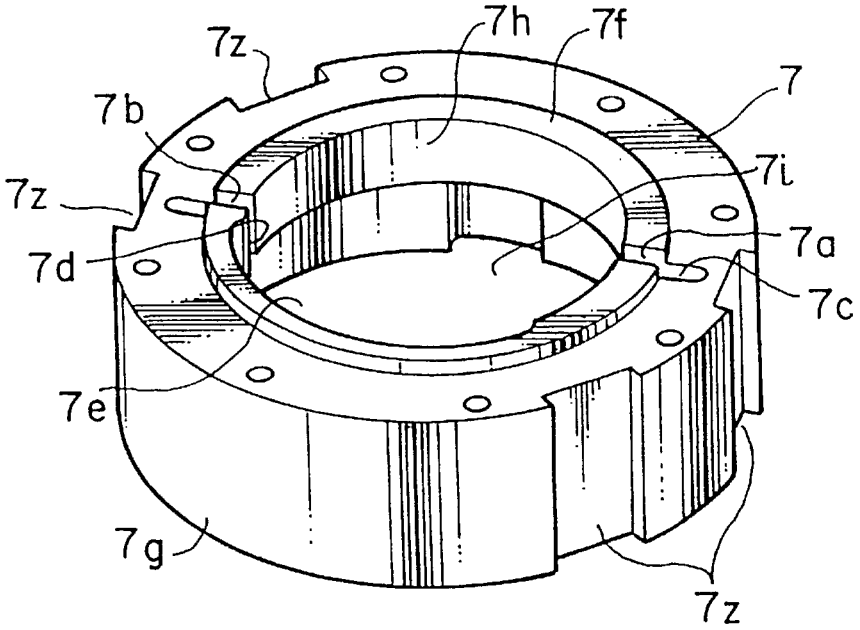
FIG. 72 is a perspective view of a stopper member in the twenty-third embodiment from the upper.
Figure 73:
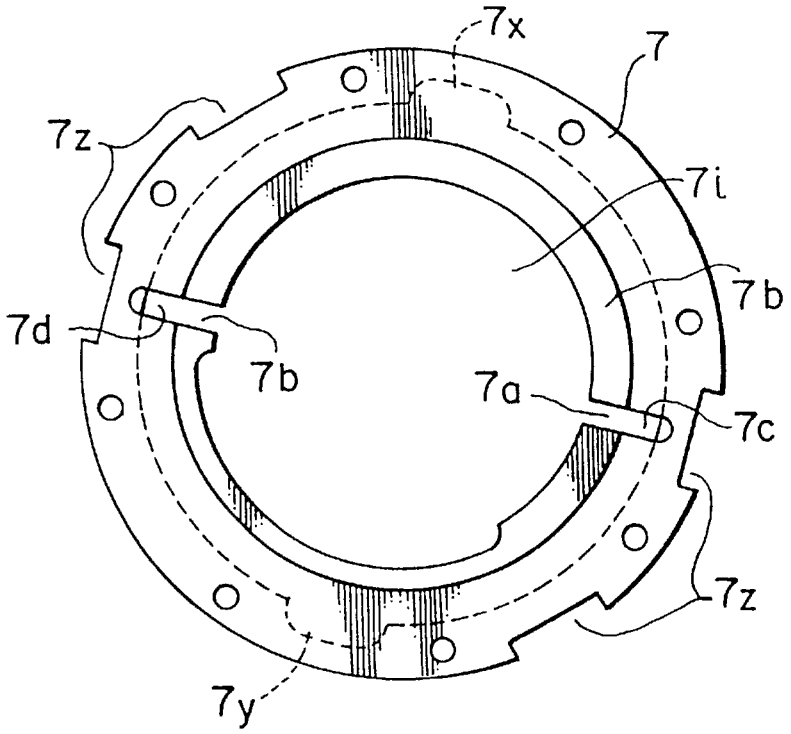
FIG. 73 is a top plan view of the stopper member in the twenty-third embodiment.

Another embodiment shown in FIGS. 71 to 73 will be described. Two planar surfaces which are parallel to each other having an upper surface that is the non-turning reference-surface opposite surface 7*f* and a lower surface that is the thrust reference-surface opposite surface 7*g* are provided on the stopper member 7. As a result, there is an advantage that workability of the stopper member is improved. Furthermore, a scroll wrap insertion hole 7*i* having the dimension through which the turning scroll member 3 cannot pass opens at the center of the non-turning reference-surface opposite surface 7*f*. A large opening is provided in a lower part of the stopper member 7 because a space in which the turning scroll member 3 moves in turning is necessary. As a result, the overhang 7*h* is formed on the upper part of the stopper member 7. The detent grooves 7*a* and 7*b* are provided above the overhang 7*h*, and the fixed Oldham's grooves 7*c* and 7*d* are provided below the overhang 7*h*. The detent grooves 7*a* and 7*b* and the fixed Oldham's grooves 7*c* and 7*d* have a common side surface. Further, the inner peripheral cut-out 7*e* is provided in the overhang 7*h* in order to avoid interference with respect to the outer periphery of the scroll wrap 3*b* in keeping with the orbital motion. Moreover, inner peripheral grooves 7*x* and 7*y* are provided in the inner peripheral surface of the overhang 7*h* at a lower part thereof as a relief of the Oldham's projections 3*e* and 3*f* of the turning scroll 3. Furthermore, communication grooves 7*z* which serve as flow passages of the gas and the oil are provided in the outer peripheral surface of the overhang 7*h*. Further, a suction hole 7*s* is provided in the side surface of the overhang 7*h*.

A thrust member is integrated with the frame 4. An upper part of the frame 4 is provided on a surface at which the sliding thrust surface 4*m* and the thrust reference surface 4*x* of the thrust part are flush with each other. Moreover, the oil groove 4*b* is provided in the sliding thrust surface 4*m*. The oil-supply hole 4*c* which communicates from the back chamber 11 opens at the oil groove 4*b*. In the present embodiment, there are four oil grooves 4*b*. However, in case where pressure within the back chamber 11 is desired to be made to a higher level, the number of the oil-supply holes 4*c* is reduced, or the oil-supply holes are reduced in diameter. Furthermore, the communication groove 4*h* which serves as a flow passage for the gas and the oil is provided in the outer peripheral surface. Further, the main bearing 4*a* is provided on the center.

The Oldham's ring 5 is provided at an upper surface thereof with the fixed projections 5*a* and 5*b*, and is provided at a lower surface thereof with the turning projections 5*c* and 5*d*.

The float rail member 25 is provided at a lower part of an inner periphery thereof with a rail surface 25*c* which serves as a trajectory for vertical movement of the non-turning scroll member 2, at an upper part thereof with the cover presser 25*a* and at an upper part of the inner periphery with the ring groove 25*b*. The seal ring 51 which is heat resistance and which is soft or resilient material is inserted into the ring groove 25.

It is considered that surface coating in which the thickness thereof decreases (creeps) in a manner of the passage of time is provided on a lower surface of the end plate 2*a* which is in contact with the non-turning reference-surface opposite surface 7*f*. Thus, there are provided peculiar advantages that, since the addendum and the bottom of each of both the scroll members 2 and 3 approach each other in a manner of the passage of time, it is made possible to reduce the gap between the addendum and the bottom which occurs by friction due to the accidental approach between the addendum and the bottom of each of both the scroll members 2 and 3, and it is possible to maintain high performance for a long period of time. As such coating, surface coating is considered due to nitrosulphurizing treatment and phosphate manganese coating treatment, for example. Since these coatings have holes therein, if pressure is applied to the coatings to retain the same for a long period of time, the holes therein are gradually broken. Accordingly, the thickness is reduced in a manner of the passage of time.

Further, it is considered that surface coating easy to be worn off or abraded is provided on the lower surface of the end plate 2*a* which is in contact with the non-turning reference-surface opposite surface 7*f*. The non-turning scroll member 2 can be moved along the detent grooves 7*a* and 7*b* with respect to the teeth of the stopper member 7 by a diameter gap between the outer periphery of the non-turning scroll member 2 and the rail surface 25*c*. In fact, both move relatively to each other by a force due to the compression gas in a horizontal direction. This means that the non-turning reference-surface opposite surface 7*f* and the lower surface of the end plate 2*a* are rubbed together. Thus, the coating on the lower surface of the end plate 2*a* wears a little by a little. As a result, since the addendum and the bottom of each of both the respective scroll members 2 and 3 approach each other in a manner of the passage of time, the gap between the addendum and the bottom which is caused by the abrasion due to the accident approach between the addendum and the bottom of each of both the scroll members 2 and 3 can be reduced. Thus, there is a peculiar advantage that it is possible to maintain high performance over a long period of time. As such coating, surface coating is considered due to nitrosulphurizing treatment and phosphate manganese coating treatment, for example.

Figure 74:
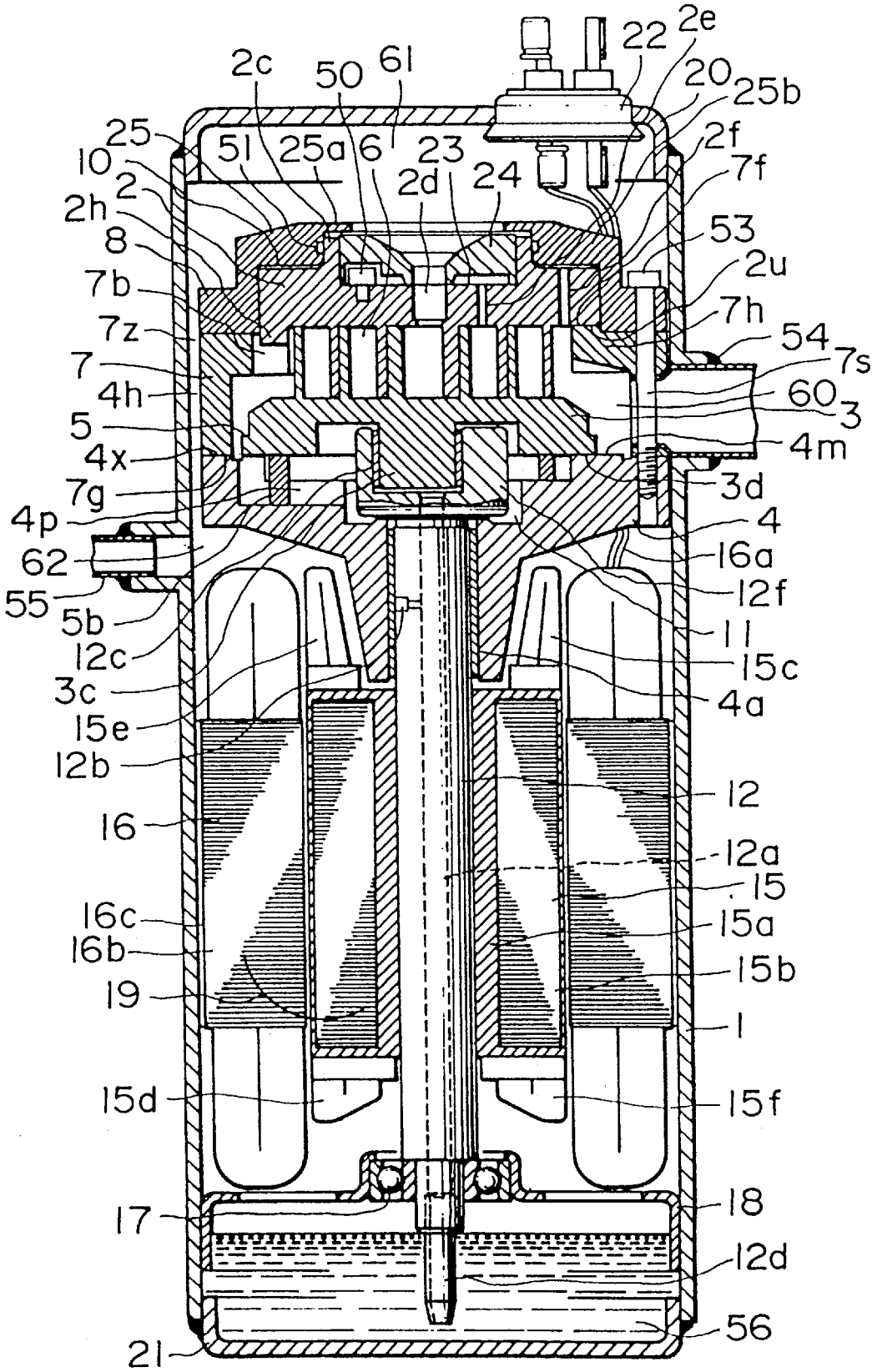
FIG. 74 is a longitudinal cross-sectional view of a twenty-fourth embodiment.
Figure 75:
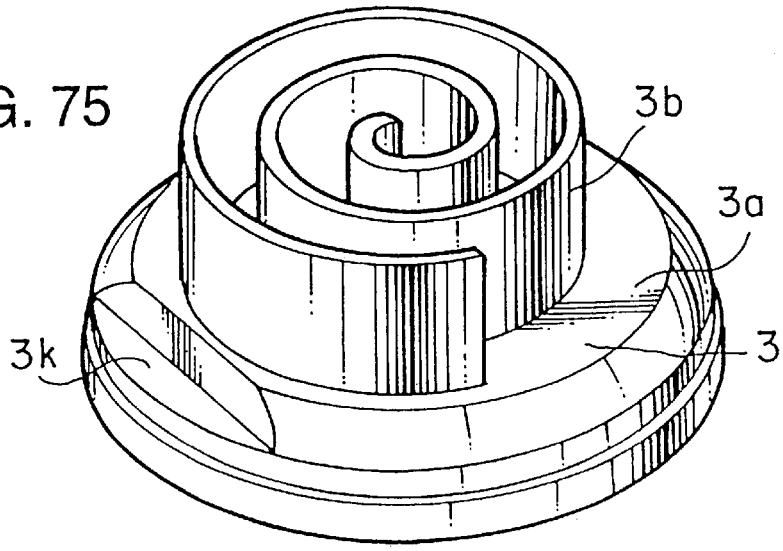
FIG. 75 is a perspective view of a turning scroll member in the twenty-fourth embodiment as viewed from the upper.
Figure 76:
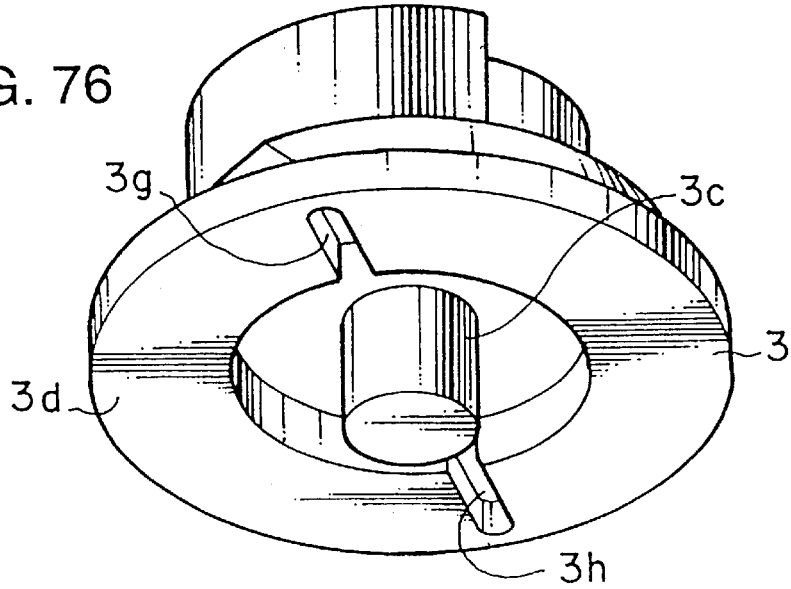
FIG. 76 is a perspective view of the turning scroll member in the twenty-fourth embodiment as viewed from the lower.
Figure 77:
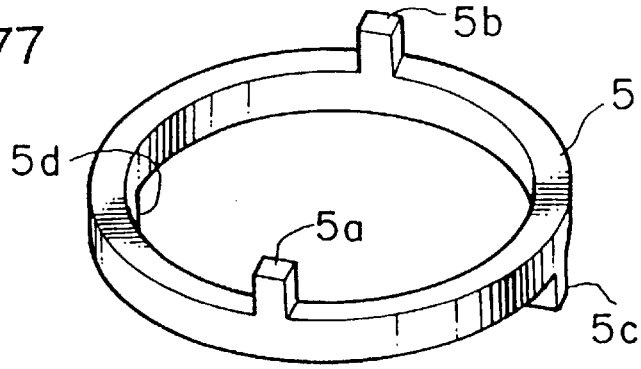
FIG. 77 is a perspective view of an Oldham's ring in the twenty-fourth embodiment from the upper.

Another embodiment of the invention will subsequently be described with reference to FIG. 74 which is a longitudinal cross-sectional view, FIG. 75 which is a perspective view of the turning scroll member from the upper, FIG. 76 which is a perspective view from the lower and FIG. 77 which is a perspective view of the Oldham's ring from the upper. Here, the present embodiment is similar to the embodiment illustrated in FIGS. 71 to 73 except that the Oldham's ring 5 is arranged between the turning scroll member 3 and the frame 4. Accordingly, the description of the arrangement and operation of other portions will be omitted. The turning Oldham's grooves 3*g* and 3*h* are provided in the back of the turning scroll. Fixed Oldham's grooves 4*p* and 4*q* (4*q* is not shown) are provided in the frame 4. As a result, there is no necessity for being provided with the turning Oldham's groove in the outer periphery of the turning scroll member. Thus, there is a peculiar advantage that workability of the turning scroll member can be improved. Moreover, the outermost parts of the fixed Oldham's grooves 4*p* and 4*q* elongate toward the outer periphery of the frame 4, to always connect the back chamber 11 and the suction chamber 60 to each other. Thus, the lubricating oil 56 which flows into the back chamber 11 is led to the suction chamber 60, and the pressure in the back chamber 11 is made substantially to the suction pressure. As a result, there is a peculiar advantage that, since a hole which communicates the back chamber 11 and the suction chamber 60 to each other becomes useless, the workability is improved. Furthermore, since the outer peripheral corner of the upper surface of the end plate 3*a* is chamfered, the flow passage resistance of the suction gas can be reduced. Accordingly, there is also a peculiar advantage that the compression efficiency can be improved. Further, there is also a peculiar advantage that, since the Oldham's ring 5 is made to a circle, the workability is improved.

Figure 78:
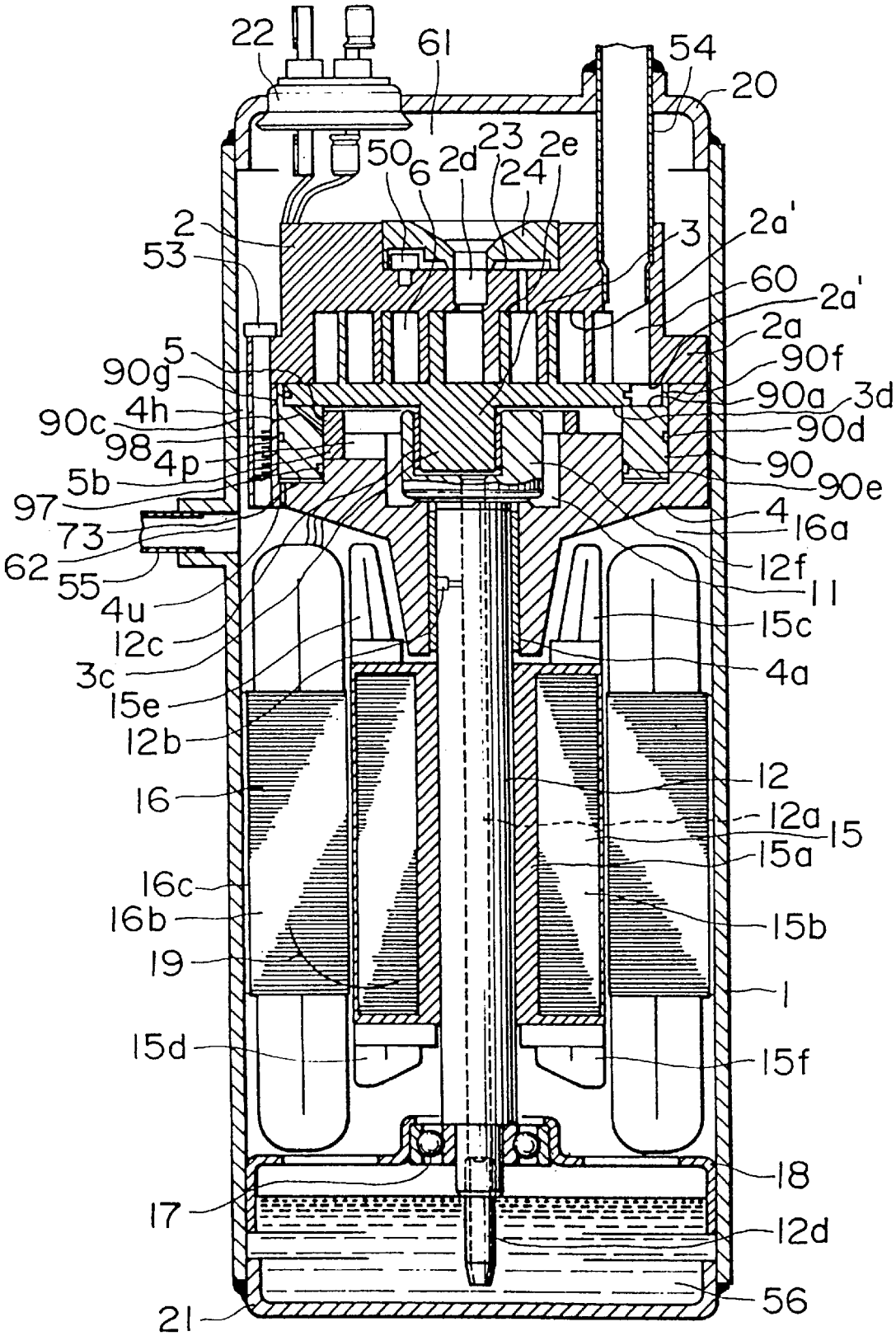
FIG. 78 is a longitudinal cross-sectional view of a twenty-fifth embodiment.

Another embodiment in which the present invention is enforced into a thrust float type scroll compressor in which the non-turning scroll member is fixed with respect to the casing and in which the thrust member is movable axially will subsequently be described with reference to FIG. 78 which is a longitudinal cross-sectional view.

A thrust member 90 is arranged such that a stopper 90*f* which performs a role of a stopper member projects onto an outer periphery of an upper surface which is made to a sliding thrust surface 90*a*, and the upper surface of the stopper 90*f* is in contact with the non-turning scroll member 2. There is an advantage that, since the thrust surface 90*a* and the stopper 90*f* are provided in parallel with each other in the same direction, the working can easily be practiced while a distance between the two surfaces is managed accurately by a lathe. Further, the distance between the thrust surface 90*a* and the upper surface of the stopper 90*f* is one of sizes that determines the gap between the addendum and the bottom of the scroll wrap. However, there is an advantage that the accuracy of the size can easily be produced, whereby it is possible to provide a scroll fluid machine which is low in variation of the performance and the reliability upon mass production. An oil-supply hole 90*c* is provided between the back chamber 11 and an oil groove 90*g* which is provided in the sliding thrust surface 90*a*. A seal groove 90*e* is provided, on the inner peripheral side, in the side surface of the thrust member 90, and a seal groove 90*d* is provided, on the outer peripheral side, in the side surface of the thrust member 90. The seals 97 and 98 are equipped respectively on the seal grooves 90*d* and 90*e*. The thrust member 90 is equipped on the bottom surface of the frame 4, while the thrust back space 73 is defined on the back of the frame 4. Here, there are provided advantages that, since the thrust member 90 may be rotated about the axis, a detent becomes useless, the structure of the compressor is simplified, and the workability is improved. Moreover, since parallel displacement within the orbital motion surface is permitted, the gap at the side surface of the thrust member 90 is made possible to large setting until the fact that sealing ability can be secured by the seals 97 and 98. Thus, there is also an advantage that the workability is improved. The discharge gas flows into the thrust back space 73 from the pressure guide hole 4*u* so that the thrust back space 73 comes substantially into the discharge pressure. Thus, an approach force is given which pushes the thrust member 90 upwardly. By the approach force, upon normal running, the upper surface of the stopper 90*f* of the thrust member 90 is urged against the lower surface of the end plate 2*a* which is located on the same surface as the addendum of the scroll wrap of the non-turning scroll member 2. Here, there are provided advantages that, since the addendum of the scroll wrap of the non-turning scroll member 2 and the lower surface of the end plate 2*a* are located on the same surface, management of the gap between the addendum and the bottom of the scroll wrap is made easy, and it is possible to provide a scroll fluid machine which is low in-variation of the performance and the reliability upon mass production. Moreover, when the addendum and the bottom of the wrap intend to be urged against each other by the deformation of the scroll member upon running, the thrust member 90 moves downwardly. Accordingly, urging between'the addendum and the bottom of the wrap is avoided. Thus, it is possible to secure the reliability of the compressor. Here, a resilient body like the leaf spring 162 shown in FIG. 27 and the heat resistant rubber may be arranged on the support back chamber 73. As a result, there is a peculiar advantage that, even in case where the discharge pressure is extremely low, and the thrust member 90 is not pushed up only by the gas pressure in the support back chamber 73, the thrust member 90 can be pushed up by the resilient force and, accordingly, the running range of the compressor at high efficiency can be widened in area. A creep member 2*a*', i.e., nitrosulphurizing film, a phosphate manganese film or the like which is capable of creeping and/or capable of being abraded may be arranged between the upper surface of the stopper 90*f* and the lower surface of the end plate 2*a*.

Figure 79:
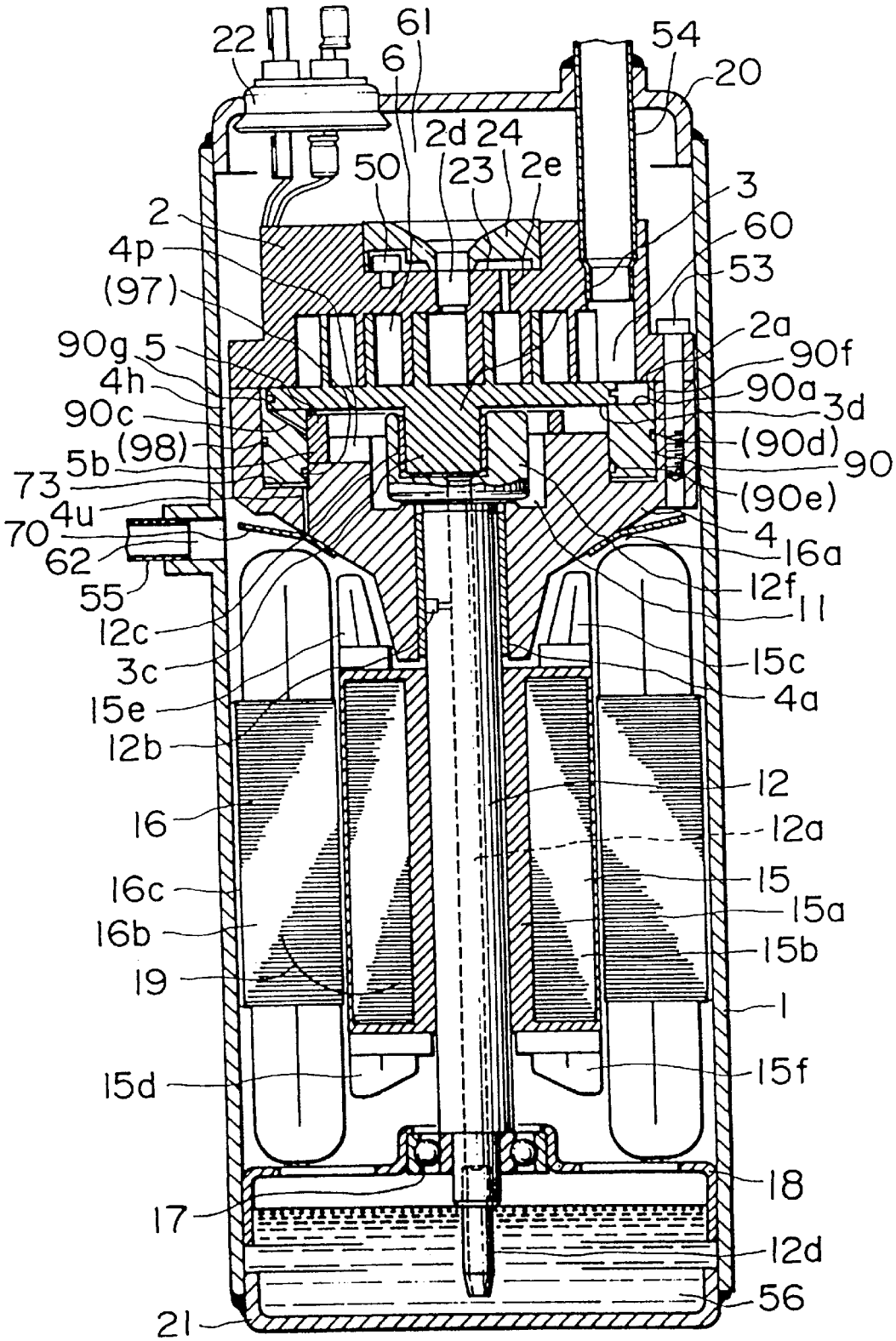
FIG. 79 is a longitudinal cross-sectional view of a twenty-sixth embodiment.

Another embodiment of the present invention will subsequently be described with reference to FIG. 79 which is a longitudinal cross-sectional view. Here, the present embodiment is similar to the embodiment shown in FIG. 78 except that the oil receiver 70 is provided, the pressure introduction hole that is the passage of the gas is made to the oil guide passage 4*u* which comes chiefly into the passage of the oil, either one or both of the seal groove 90*e* and the seal groove 90*d* is removed, the seals 97 and 98 are also removed in keeping therewith, and the gap thereat is reduced. Accordingly, the description of the arrangement and operation of other portions will be omitted. Since the discharge gas which passes through the flow passage 4*h* contains a lot of lubricating oil, a part of the oil in the discharge gas is collected in the oil receiver 70. The pressure in the thrust back space 73 is reduced less than the discharge pressure by the gap at the side surface of the thrust member 90 which has no seal. By this differential pressure, the oil which is collected within the oil groove 70 flows into the thrust back space 73 from the oil guide passage 4*u*. As a result, there is an advantage that, since the thrust back space 73 plays a role of a damper with respect to vibration of the thrust member 90, it is possible to enlarge the running range of high reliability and high efficiency. Here, in case where only the seal 97 at the inner periphery of the side surface of the thrust member 90 is removed, the pressure in the back chamber 11 is slightly raised. Accordingly, there are advantages peculiar to the present embodiment that the force which pushes up the turning scroll member 3 increases, the sliding loss at the slide thrust surface 90*a* can be reduced, and the compression performance is improved. Moreover, the oil which passes through the thrust back space 73 is included in the lubricating oil which lubricates the slide thrust surface 90*a* so that the temperature of the oil is lowered. As a result, there is a peculiar advantage that a resistant load increases, and the reliability is improved.

Figure 80:
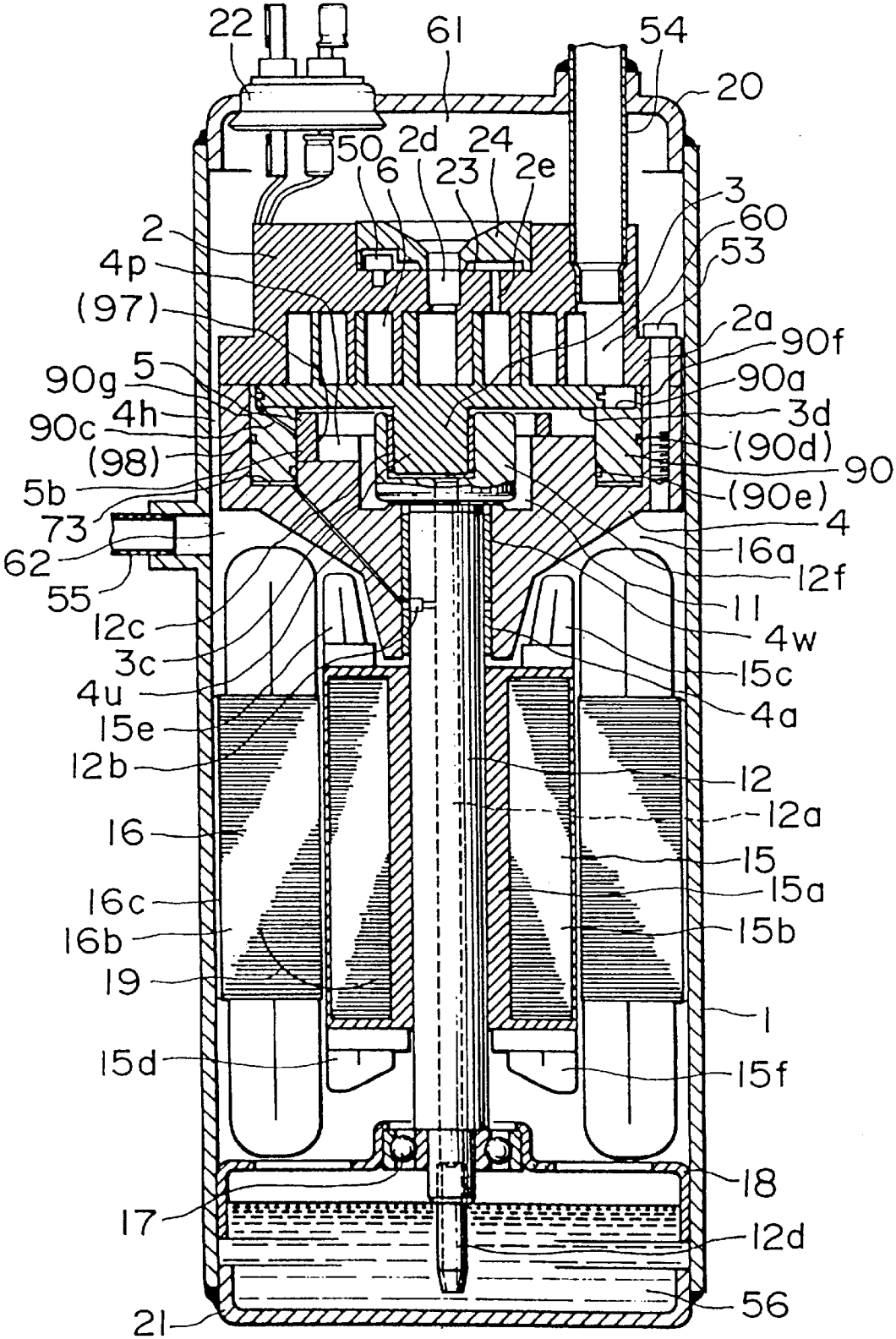
FIG. 80 is a longitudinal cross-sectional view of a twenty-seventh embodiment.

Another embodiment of the present invention will subsequently be described with reference to FIG. 80 which is a longitudinal cross-sectional view. The present embodiment is similar to the embodiment shown in FIG. 79 except that the main bearing is divided into an upper main bearing 4*w* and the lower main bearing 4*a*, a groove is defined therebetween, the lateral oil-supply hole 12*b* opens at a position thereat, and the oil guide passage 4*u* is provided between the groove and the thrust back space 73. Accordingly, the description of the arrangement and operation of the other portions will be omitted. The oil which flows out from the lateral oil-supply hole 12*b* enters the thrust back space 73 through the oil guide passage 4*u*. As a result, it is made possible to provide a damper for the axial motion of the thrust member. Thus, there is an advantage that the running range of the high reliability and the high efficiency can be widened in area.

Figure 81:
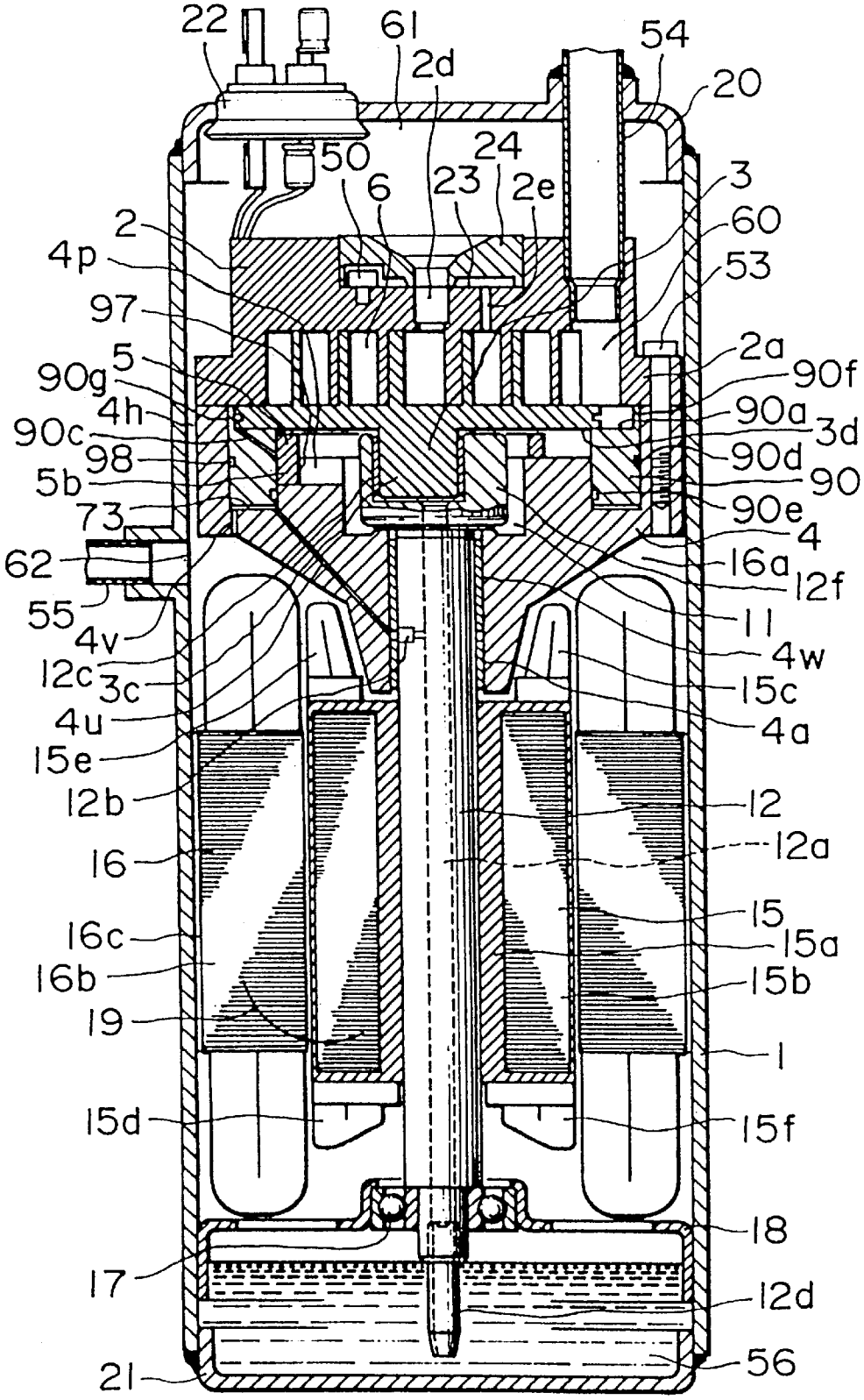
FIG. 81 is a longitudinal cross-sectional view of a twenty-eighth embodiment.

Another embodiment of the present invention will subsequently be described with reference to FIG. 81 which is a longitudinal cross-sectional view. The present embodiment is similar to the embodiment shown in FIG. 80 except that the seals 97 and 98 at the side surface of the thrust member are both provided, and an exhaust hole 4*v* which connects the thrust back space and the motor chamber to each other is provided. Accordingly, the description of the arrangement and operation of the other portions will be omitted. The oil which flows out from the lateral oil-supply hole 12*b* passes through the oil guide hole 4*u* by the centrifugal force, and enters the thrust back space 73. The gas which enters the thrust back space 73 prior to the running passes through the exhaust hole 4*v*, and is exhausted to the motor chamber 92. As a result, even if there are the seals both at side surfaces of the thrust member, the oil can be introduced into the thrust back space 73. Accordingly, it is possible to provide a damper for the axial motion of the thrust member, while leakage to the suction chamber 60 of the discharge gas is prevented. Thus, there is an advantage peculiar to the present embodiment that the reliability is raised, and the volumetric efficiency is improved. It is possible to provide the compressor which is further improved in compression performance.

Figure 82:
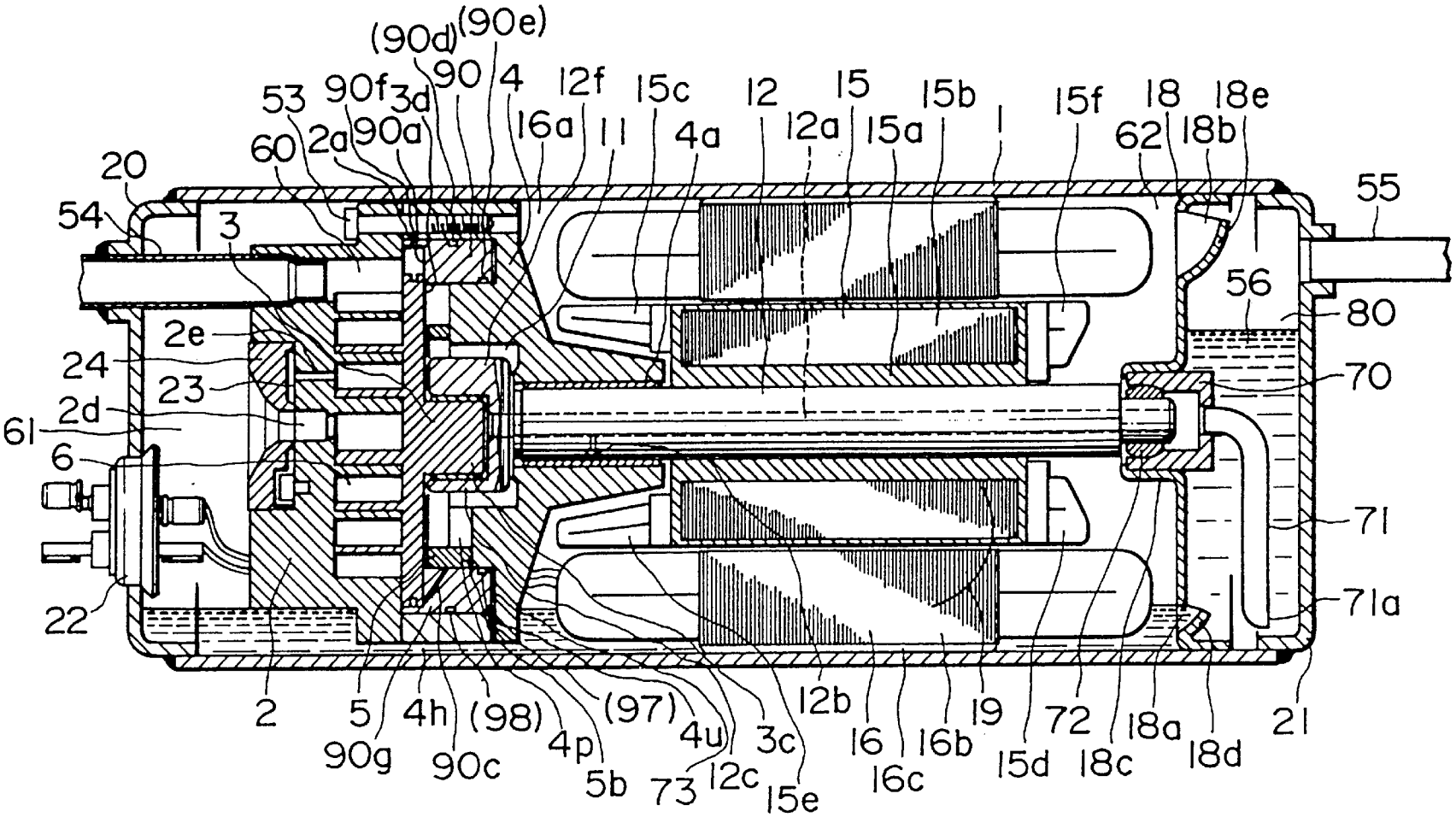
FIG. 82 is a longitudinal cross-sectional view of a twenty-ninth embodiment.

Another embodiment in which the present invention is enforced to a horizontal thrust float type scroll compressor will subsequently be described with reference to FIG. 82 which is a longitudinal cross-sectional vies. The present embodiment is similar to the embodiment shown in FIG. 79 except for a mechanism for accumulating therein lubricating oil and a mechanism for supplying the lubricating oil to the main bearing and the thrust back space. Accordingly, the description of the arrangement and operation of the other portions will be omitted.

The bearing support 18 having an upper part thereof at which the ventilation hole 18*b* and the air cover 18*e* are provided, a lower part thereof at which the oil introduction hole 18*a* and the oil introduction cover 18*d* are provided, and a center part thereof at which the bearing hole 18*c* is provided is fixed to the cylindrical casing 1, to define the oil accumulation chamber 80. Further, the discharge pipe 55 is put out from the oil accumulation chamber 80. Furthermore, the bearing housing 70 is fitted in press in which the fixed oil-supply tube 71 is fixed to the bearing hole 18*c*. Moreover, the oil guide passage 4*u* opens to the flow passage 4*h* at a lower part thereof. Because of the horizontal type, there is the lubricating oil 56 in the opening at the side of the flow passage 4*h* of the oil guide passage 4*u*. As a result, a special mechanism for introducing the oil into the thrust back space 73 becomes useless. Thus, there is an advantage that the workability is improved. The compression gas in the motor chamber 62 passes through the ventilation hole 18*b* while impinging against the ventilation cover 18*e*, and flows into the oil accumulation chamber 80. Thus, since the pressure in the motor chamber 62 is elevated as compared with the pressure in the oil accumulation chamber 80, the lubricating oil 56 in the motor chamber 62 passes through the oil guide hole 18*a*, and flows into the oil accumulation chamber 80. At this time, the gas also simultaneously flows into the oil accumulation chamber 80. Bubbles rise in the lubricating oil within the oil accumulation chamber 80. However, since the bubbles rise along the bearing support 18 by the oil guide cover 18*d*, it is possible to avoid that the bubbles enter the oil hole 71*a*. Thus, there is a peculiar advantage that the reliability can be improved. As described above, there is provided an advantage peculiar to the present embodiment that, since it is made possible to store the lubricating oil 56 within the small-sized compressor without the fact that the oil level in the motor chamber 62 is splashed to the rotor 15 and the shaft 12, it is possible to realize the horizontal compressor having high reliability, by the small size. There is an advantage peculiar to the present embodiment that, since the lubricating oil 56 can pass through the fixed oil-supply tube 71 to lubricate the subsidiary bearing 72, and can enter the oil-supply hole 12*a*, it is possible to realize the horizontal compressor having high reliability, by the small size.

What is claimed is:

1. A scroll compressor comprising, two scrolls including respective scroll wraps to form a compression chamber therebetween so that a volume of the compression chamber is decreased to compress a fluid therein by an orbital motion between the scrolls around an axis the two scrolls comprising an orbiting scroll and a rotationally stationary scroll, a frame supporting the scrolls thereon, a drawing force generator for generating a drawing force urging axially the rotationally stationary scroll toward the orbiting scroll, and a contacting force limiter for bearing at least a part of the drawing force to prevent the at least a part of the drawing force from being borne by a contact between the scrolls, when an axial distance between the scrolls is not more than a predetermined axial distance, wherein the contacting force limiter prevents the axial distance between the scrolls from being less than the predetermined axial distance.

2. A scroll compressor according to claim 1, wherein the drawing force generator includes a spring generating the drawing force.

3. A scroll compressor according to claim 1 wherein the drawing force generator includes the fluid compressed by the compression chamber.

4. A scroll compressor according to claim 1, wherein the drawing force generator comprises means for applying a drawing force to a relatively radially-outer portion of the scrolls smaller than the drawing force applied to a relatively radially-inner portion of the scrolls.

5. A scroll compressor according to claim 1, wherein the contacting force limiter has a positioning surface extending substantially perpendicularly to the axis of one of the scrolls and the drawing force generator has another positioning surface extending substantially perpendicularly to the axis, a contact between the positioning surfaces bears the at least a part of the drawing force to prevent the at least a part of the drawing force from being borne by the contact between the scrolls.

6. A scroll compressor according to claim 1, wherein the contacting force limiter bears only a part of the drawing force and another part of the drawing force is born between the scrolls.

7. A scroll compressor according to claim 1, wherein another part of the drawing force is born by a contact between the scrolls.

8. A scroll compressor according to claim 1, further comprising a creep member between the scrolls.

9. A scroll compressor according to claim 1, wherein the contacting force limiter is connected to the one of the scrolls so that the at least a part of the drawing force is borne by the contact force limiter to prevent the at least a part of the drawing force from being borne by the contact between the scrolls, the one of the scrolls is prevented from performing an orbital motion, and another one of the scrolls is allowed to perform the orbital motion.

10. A scroll compressor comprising, two scrolls including respective scroll wraps to form a compression chamber therebetween so that a volume of the compression chamber is decreased to compress a fluid therein by an orbital motion between the scrolls around an axis, a frame supporting the scrolls thereon, a drawing force generator for generating a drawing force urging axially one of the scrolls toward another one thereof, and a contacting force limiter for bearing at least a part of the drawing force to prevent the at least a part of the drawing force from being borne by a contact between the scrolls, when an axial distance between the scrolls is not more than a predetermined axial distance, wherein the contacting force limiter is fixed axially with respect to the frame and is connected to the one of the scrolls to bear the at least a part of the drawing force so that the at least a part of the drawing force is prevented from being born by the contact between the scrolls.

11. A scroll compressor comprising, two scrolls including respective scroll wraps to form a compression chamber therebetween so that a volume of the compression chamber is decreased to compress a fluid therein by an orbital motion between the scrolls around an axis, a frame supporting the scrolls thereon, a drawing force generator for generating a drawing force urging axially one of the scrolls toward another one thereof, and a contacting force limiter for bearing at least a part of the drawing force to prevent the at least a part of the drawing force from being borne by a contact between the scrolls, when an axial distance between the scrolls is not more than a predetermined axial distance, further comprising a creep member between the one of the scrolls and the contacting force limiter, the creep member being deformed plastically in accordance with a lapse of time by a compression force therebetween to decrease the axial distance between the scrolls in accordance with the lapse of time.

12. A scroll compressor comprising, two scrolls including respective scroll wraps to form a compression chamber therebetween so that a volume of the compression chamber is decreased to compress a fluid therein by an orbital motion between the scrolls around an axis, a frame supporting the scrolls thereon, a drawing force generator for generating a drawing force urging axially one of the scrolls toward another one thereof, a contacting force limiter for bearing at least a part of the drawing force to prevent the at least a part of the drawing force from being borne by a contact between the scrolls, when an axial distance between the scrolls is not more than a predetermined axial distance, and a creep member between the contact force limiter and the one of the scrolls.

13. A scroll compressor comprising, two scrolls including respective scroll wraps to form a compression chamber therebetween so that a volume of the compression chamber is decreased to compress a fluid therein by an orbital motion between the scrolls around an axis, a frame supporting the scrolls thereon, a drawing force generator for generating a drawing force urging axially one of the scrolls toward another one thereof, and a contacting force limiter for bearing at least a part of the drawing force to prevent the at least a part of the drawing force from being borne by a contact between the scrolls when an axial distance between the scrolls is not more than a predetermined axial distance, wherein the contacting force limiter prevents the axial distance between the scrolls from being less than the predetermined axial distance, and bears the substantial whole of the drawing force to prevent the drawing force from being born by the contact between the scrolls when the axial distance between the scrolls is equal to the predetermined axial distance.

* * * * *